US009561664B2

(12) United States Patent
Nakamura et al.

(10) Patent No.: US 9,561,664 B2
(45) Date of Patent: Feb. 7, 2017

(54) LIQUID STORAGE CONTAINER AND LIQUID SUPPLY SYSTEM

(71) Applicant: SEIKO EPSON CORPORATION, Tokyo (JP)

(72) Inventors: Hiroyuki Nakamura, Nagano (JP); Atsushi Kobayashi, Nagano (JP); Tadahiro Mizutani, Nagano (JP); Izumi Nozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/420,233

(22) PCT Filed: Aug. 7, 2013

(86) PCT No.: PCT/JP2013/004784

§ 371 (c)(1),
(2) Date: Feb. 6, 2015

(87) PCT Pub. No.: WO2014/024492

PCT Pub. Date: Feb. 13, 2014

(65) Prior Publication Data

US 2015/0224782 A1 Aug. 13, 2015

(30) Foreign Application Priority Data

Aug. 8, 2012 (JP) ..... 2012-176496
Aug. 8, 2012 (JP) ..... 2012-176497
(Continued)

(51) Int. Cl.
*B41J 29/393* (2006.01)
*B41J 2/175* (2006.01)

(52) U.S. Cl.
CPC ..... *B41J 2/17556* (2013.01); *B41J 2/175* (2013.01); *B41J 2/1752* (2013.01); *B41J 2/1754* (2013.01);
(Continued)

(58) Field of Classification Search
None
See application file for complete search history.

(56) References Cited

U.S. PATENT DOCUMENTS 5,821,965 A * 10/1998 Oda et al. ..... 347/86
6,000,789 A * 12/1999 Takagi ..... B41J 2/17513 347/86
(Continued)

FOREIGN PATENT DOCUMENTS

CN 102407678 A 4/2012
EP 1203667 5/2002
(Continued)

OTHER PUBLICATIONS

The Extended European Search Report for the corresponding European Application No. 13827519.3 dated Nov. 24, 2016.

*Primary Examiner* — Matthew Luu
*Assistant Examiner* — Tracey McMillion
(74) *Attorney, Agent, or Firm* — Global IP Counselors, LLP

(57) ABSTRACT

A liquid storage container is provided with a liquid storage part capable of storing a liquid, and a liquid supply part for supplying the liquid to the outside. The liquid supply part has a porous member containing holes for circulating the liquid, and a biasing member which is disposed between the porous member and the liquid storage part and which biases the porous member from the liquid storage part towards the outside.

8 Claims, 37 Drawing Sheets

(30) Foreign Application Priority Data

| | | |
|---|---|---|
| Aug. 8, 2012 | (JP) | 2012-176498 |
| Aug. 31, 2012 | (JP) | 2012-191446 |
| Jun. 14, 2013 | (JP) | 2013-125321 |

(52) U.S. Cl.
CPC ..... *B41J 2/17513* (2013.01); *B41J 2/17553* (2013.01)

(56) References Cited

U.S. PATENT DOCUMENTS

| | | | | |
|---|---|---|---|---|
| 6,012,808 | A | 1/2000 | Koitabashi et al. | |
| 6,082,852 | A | 7/2000 | Soga et al. | |
| 2001/0050017 | A1 | 12/2001 | Ohsawa et al. | |
| 2003/0227525 | A1 | 12/2003 | Kim et al. | |
| 2005/0185034 | A1 | 8/2005 | Anma et al. | |
| 2007/0052772 | A1 | 3/2007 | Kawamura et al. | |
| 2009/0027462 | A1* | 1/2009 | Berg | B41J 2/17513 347/86 |
| 2011/0234719 | A1 | 9/2011 | Mizutani et al. | |
| 2012/0056956 | A1 | 3/2012 | Kodama et al. | |

FOREIGN PATENT DOCUMENTS

| | | | |
|---|---|---|---|
| JP | 06-040041 | A | 2/1994 |
| JP | 08-183814 | A | 7/1996 |
| JP | 08-224884 | A | 9/1996 |
| JP | 09-286115 | A | 11/1997 |
| JP | 09-300646 | A | 11/1997 |
| JP | 2005-205893 | A | 8/2005 |
| JP | 2007-090873 | A | 4/2007 |
| JP | 2011-206936 | A | 10/2011 |
| JP | 2011-207066 | A | 10/2011 |
| WO | 2010/050954 | A1 | 5/2010 |

* cited by examiner

Fig. 12A
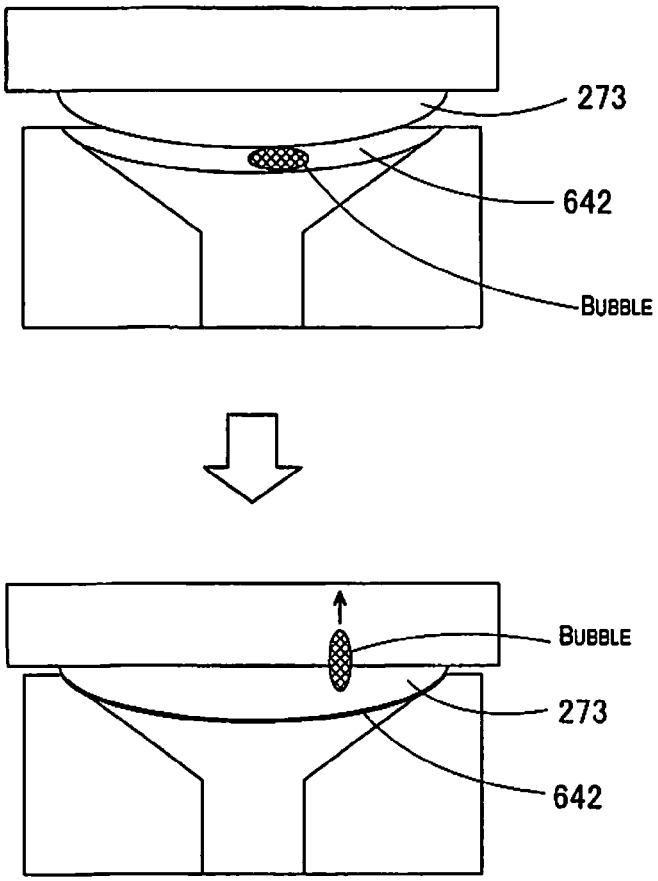
Fig. 12B
Fig. 13
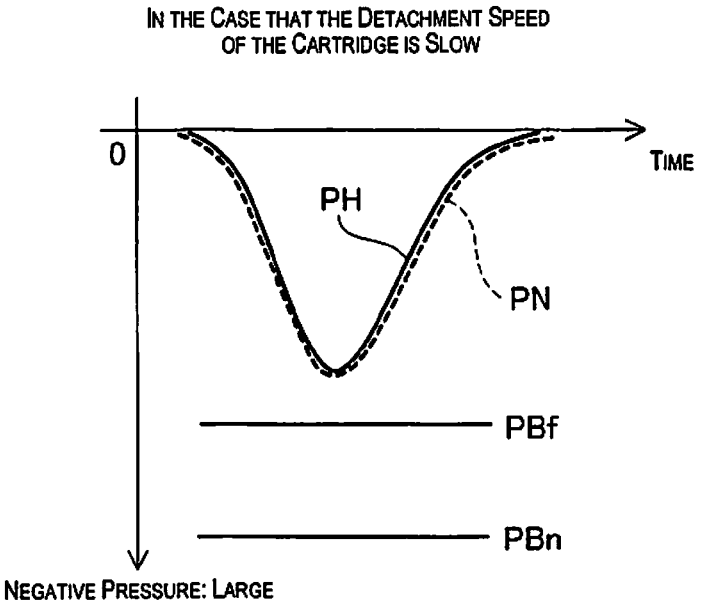

LIQUID STORAGE CONTAINER AND LIQUID SUPPLY SYSTEM

CROSS-REFERENCE TO RELATED APPLICATIONS

This application is a national phase application of International Application No. PCT/JP2013/004784 filed on Aug. 7, 2013. This application claims priority to Japanese Application No. 2012-176496 filed on Aug. 8, 2012, Japanese Application No. 2012-176497 filed on Aug. 8, 2012, Japanese Application No. 2012-176498 filed on Aug. 8, 2012, Japanese Application No. 2012-191446 filed on Aug. 31, 2012, and Japanese Application No. 2013-125321 filed on Jun. 14, 2013. The entire disclosures of Japanese Application Nos. 2012-176496, 2012-176497, 2012-176498, 2012-191446 and 2013-125321 are hereby incorporated herein by reference.

TECHNOLOGICAL FIELD

The present invention relates to a liquid storage container and a liquid supply system.

BACKGROUND TECHNOLOGY

In a liquid consumption device in which a liquid storage container is mounted, as described in Japanese Unexamined Patent Application Publication No. 2005-205893, when the liquid storage container is mounted on the liquid consumption device, the liquid is supplied from the liquid storage container to the liquid consumption device by contacting a liquid supply part provided in the liquid storage container and a liquid introduction port provided in the liquid consumption device. For example, in the ink-jet printer described in Japanese Unexamined Patent Application Publication No. 2011-207066, a foam is provided in a liquid supply part of the ink cartridge, and a metal filter is provided in the liquid introduction port of the ink-jet printer, and the liquid supply is performed by contacting these parts.

SUMMARY

However, in the technology described in Japanese Unexamined Patent Application Publication No. 2005-205893 or Japanese Unexamined Patent Application Publication No. 2011-207066, the problems such as variations in dimension of the liquid supply part or the liquid introduction port, changes of installation environment, deteriorations due to the repetition of attachment and detachment, etc. have not been considered. Therefore, the technology in which the liquid is stably and promptly supplied to the liquid introduction part of the liquid consumption device is desired by making the liquid supply part well contact with the liquid introduction port even if these problems occur.

The present invention was made to solve at least a part of the aforementioned problems, and can be actualized as the following embodiments or applied examples.

A liquid storage container according to a first aspect includes a liquid storage part capable of storing liquid, and a liquid supply part supplying the liquid to an outside. The liquid supply part is provided with a porous member including holes to flow the liquid, and a biasing member provided between the porous member and the liquid storage part to bias the porous member in a direction from the liquid storage part to the outside.

With such structure, the porous member is biased to the outside, that is, a direction from the liquid storage part to the porous member by the biasing member. Therefore, in a case in which the storage container is mounted on the liquid consumption device, even when the problems such as variations in the dimensions of the liquid supply part or the liquid introduction port, the changes of installation environment, deteriorations due to the repetition of attachment and detachment, etc. occur, the porous member is brought into good contact with the porous member provided in the liquid introduction port of a liquid consumption device. Therefore, the liquid inside the liquid storage part can be stably supplied to the liquid consumption device. The biasing member may be directly contacted with the porous member, or may be indirectly contacted via another member.

The liquid storage container according to a second aspect is the liquid storage container described in the first aspect, in which a support member is provided between the porous member and the liquid storage part, and supports the porous member.

With such structure, the porous member is brought into good contact with the porous member provided in the liquid introduction port of the liquid consumption device. The support member may directly support the porous member, or may indirectly support another member.

The liquid storage container according to a third aspect is the liquid storage container described in the second aspect, in which the support member is provided with flow holes to be capable of flowing the liquid between the liquid storage part and the porous member.

With such structure, the flow of the liquid between the liquid storage part and the porous member is not blocked by the support member, so that the liquid can be supplied to the liquid introduction port of the liquid consumption device.

The liquid storage container according to a fourth aspect is the liquid storage container described in the third aspect, in which a flow channel formation member is provided between the support member and the porous member, and includes holes to form a flow channel in a direction from the liquid storage part to the porous member.

With such structure, the pressure loss of the liquid passed through the flow holes of the support member is reduced by the flow channel formation member, and therefore, the liquid can be uniformly flowed to the porous member. Further, it can prevent the porous member from getting into the flow holes of the support member by arranging the flow channel formation member. Thus, when the liquid storage container is mounted on the liquid consumption device, it is possible to suppress the entering of the air between the porous member and the porous member provided in the liquid introduction port of the liquid consumption device.

The liquid storage container according to a fifth aspect is the liquid storage container described in the fourth aspect, in which an average of equivalent diameters of the holes provided in the flow channel formation member is greater than an average of equivalent diameters of the holes provided in the porous member.

With such structure, the capillary force of the porous member in container side can be greater than the capillary force of the flow channel formation member, so that the meniscus of the liquid can be formed to the outside. Thus, when the liquid storage container is mounted on the liquid consumption device, it is possible to promptly supply the liquid to the liquid introduction part of the liquid consumption device.

The liquid storage container according to a sixth aspect is the liquid storage container described in any one of the second to fifth aspects, in which the biasing member and the support member are integrally formed.

With such structure, the production cost of the liquid storage container can be reduced.

The liquid storage container according to a seventh aspect is the liquid storage container described in any one of the first to sixth aspects, in which an average of equivalent diameters of holes provided on a surface of the porous member in an opposite side of the liquid storage part is smaller than an average of equivalent diameters of holes provided on a surface of the porous member in a liquid storage part side.

With such structure, the porous member can increase the capillary force of the outside (porous member side provided in the liquid introduction port of the liquid consumption device), so that the meniscus of the liquid surface can be formed more outside. Therefore, when the liquid storage container is mounted on the liquid consumption device, it is possible to promptly supply the liquid to the liquid introduction part of the liquid consumption device.

The liquid storage container according to an eighth aspect is the liquid storage container described in any one of the first to seventh aspects, in which the porous member is provided in a manner of projecting along a direction from the liquid storage part to the porous member.

With such structure, when the porous member contacts with the porous member provided in the liquid introduction port of the liquid consumption device, the tensile stress applied to the porous member can be suppressed, so that the deterioration of the porous member in the liquid supply container can be suppressed.

The liquid storage container according to a ninth aspect is the liquid storage container described in any one of the first to eighth aspects, the liquid supply part includes a second porous member, and the second porous member is fixed in a top end of the liquid supply part in a manner of covering an opening of the top end of the liquid supply part.

With such structure, the porous member is made in a double structure, so that the structure of the liquid supply part can be reinforced. Thus, even though the liquid storage container is repeatedly attached and detached on the liquid consumption device, it is hard to break or damage the porous member. Further, the second porous member is fixed in the top end of the liquid supply part, so that in case, even when the second porous member is broken or damaged, it is possible to easily replace it to a new one. Therefore, it is possible to continuously use the liquid storage container for a long term.

A liquid storage container according to a tenth aspect includes a liquid storage part capable of storing liquid, and a liquid supply part. The liquid supply part is provided with a porous member including holes to flow the liquid, and a flow channel formation member provided between the porous member and the liquid storage part and including holes to form a flow channel in a direction from the liquid storage part to the porous member. An average of equivalent diameters of the holes provided in the flow channel formation member is greater than an average of equivalent diameters of the holes provided in the porous member.

With such structure, the capillary of the porous member can be made greater than the capillary of the flow channel formation member, so that the meniscus of the liquid can be formed in the outside. Therefore, when the liquid storage container is mounted on the liquid consumption device, it is possible to promptly supply the liquid to the liquid introduction part of the liquid consumption device.

A liquid storage container according to an eleventh aspect includes a liquid storage part capable of storing liquid, and a liquid supply part. The liquid supply part is provided with a porous member including holes to flow the liquid, and a flow channel formation member provided between the porous member and the liquid storage part and including holes to form a flow channel in a direction from the liquid storage part to the porous member. The porous member is provided in a manner in which an average of equivalent diameters of holes provided on a surface in an opposite side of the liquid storage part is smaller than an average of equivalent diameters of holes provided on a surface in a liquid storage part side.

With such structure, the porous member can increase the capillary force of the outside, so that the meniscus of the liquid surface can be formed more outside. Therefore, when the liquid storage container is mounted on the liquid consumption device, it is possible to promptly supply the liquid to the liquid introduction part of the liquid consumption device.

The liquid storage container according to a twelfth aspect is the liquid storage container described in the tenth or eleventh aspect, in which a liquid storage chamber is partitioned from the liquid storage part by a partition wall and communicates to the liquid storage part via a communication hole and communicating to the liquid supply part. A first part of the flow channel formation member is positioned in the liquid supply part, and a second part of the flow channel formation member is positioned in the first part of the liquid storage chamber.

In this liquid storage container, when the air is accumulated in the liquid storage chamber, the air blocks the liquid supply part, so that the liquid is not supplied. In this liquid storage container, the first part of the flow channel formation member is positioned in the liquid supply part, and the second part of the flow channel formation member is positioned in the first position of the liquid storage chamber. With this structure, the flow channel formation member retains the liquid and functions as a flow channel of the liquid. With this, even when the air is entered into the liquid storage chamber, the flow channel of the liquid is easily maintained. Therefore, in this liquid storage container, the liquid is easily and stably supplied from the liquid supply part.

The liquid storage container according to a thirteenth aspect is the liquid storage container described in the tenth or eleventh aspect, in which a liquid storage chamber is partitioned from the liquid storage part by a partition wall and communicates to the liquid storage part via a communication hole and communicating to the liquid supply part. A second flow channel formation member, which is different from the flow channel formation member, is positioned in a first part of the liquid storage chamber.

In this liquid storage container, when the air is accumulated in the liquid storage chamber, the air blocks the liquid supply part, so that the liquid is not supplied. In this liquid storage container, the second flow channel formation member which is different from the flow channel formation member is positioned in the first part of the liquid storage chamber. With such structure, the flow channel formation member and the second flow channel formation member retains the liquid and functions as a flow channel of the liquid. With this, even when the air is entered into the liquid storage chamber, the flow channel of the liquid is easily maintained. Therefore, in this liquid storage container, the liquid is easily and stably supplied from the liquid supply part.

The liquid storage container according to a fourteenth aspect is the liquid storage container described in the twelfth aspect, in which a second flow channel formation member, which is different from the flow channel formation member, is positioned in a second part of the liquid storage chamber.

In this liquid storage container, the second flow channel formation member, which is different from the flow channel formation member, is positioned in the second part of the liquid storage chamber, so that in the liquid storage chamber, the second flow channel formation member retains the liquid and functions as a flow channel of the liquid. Therefore, even when the air is entered into the liquid storage chamber, the flow channel of the liquid is maintained more easily.

The liquid storage container according to a fifteenth aspect is the liquid storage container described in the twelfth or thirteenth aspect, in which a capillary force generation structure capable of contacting with the flow channel formation member is positioned in the second part of the liquid storage chamber.

In this liquid storage container, the capillary force generation structure capable of contacting with the flow channel formation member is positioned in the second part of the liquid storage chamber, so that the liquid is easily guided from the second part of the liquid storage chamber to the flow channel formation member. With this, even when the air is entered into the liquid storage chamber, the flow channel of the liquid is maintained more easily.

The liquid storage container according to a sixteenth aspect is the liquid storage container described in the tenth or eleventh aspect, in which a negative pressure adjustment structure capable of applying a negative pressure to the liquid, an atmosphere communication structure capable of adjusting the negative pressure, a liquid remaining amount measurement structure capable of measuring a remaining amount of the liquid, and a capillary force generation structure are arranged in the liquid storage part. The flow channel formation member is capable of contacting with the capillary force generation structure.

In this liquid storage container, the capillary force generation structure is provided in the liquid storage part, and it is possible to contact the flow channel formation member, which is provided in the liquid supply part, with the capillary force generation structure. In this liquid storage container, even when the empty of the remaining amount of the liquid inside the liquid storage part is determined via the liquid remaining amount measurement structure, the liquid retained in the capillary force generation structure can be supplied to the flow channel formation member. With this, even when the empty of the remaining amount of the liquid inside the liquid storage part is determined, the liquid can be supplied from the liquid supply part for a certain period of time. Further, according to this liquid storage container, the flow channel of the liquid is maintained by the capillary force generation structure and the flow channel formation member, so that it easily prevents the air from blocking the liquid supply part.

A liquid storage container according to a seventeenth aspect capable of supplying liquid to a liquid ejection device includes a liquid storage part capable of storing liquid, and a liquid supply part communicating to the liquid storage part and being capable of supplying the liquid to the liquid ejection device. A negative pressure adjustment structure capable of applying a negative pressure to the liquid, an atmosphere communication structure capable of adjusting the negative pressure, a liquid remaining amount measurement structure capable of measuring a remaining amount of the liquid, and a capillary force generation structure are arranged in the liquid storage part. A flow channel formation member contacting with the capillary force generation structure, and a porous member contacting with the flow channel formation member and being biased in a direction from the liquid storage part to the outside by the flow channel formation member and having greater bubble point pressure than the flow channel formation member are arranged in the liquid supply part.

In this liquid storage container, the capillary force generation structure is provided in the liquid storage part, and the flow channel formation member provided in the liquid supply part contacts with the capillary force generation structure. In this liquid storage container, even when the empty of the remaining amount of the liquid inside the liquid storage part is determined via the liquid remaining amount measurement structure, the liquid remained in the capillary force generation structure can be supplied to the flow channel formation member. With this, even when the empty of the remaining amount of the liquid inside the liquid storage part is determined, the liquid can be supplied from the liquid supply part for a certain period of time. Further, in this liquid storage container, the flow channel of the liquid is maintained by the capillary force generation structure and the flow channel formation member, so that it easily prevents the air from blocking the liquid supply part. Further, in this liquid storage container, the porous member contacting the liquid supply part and the flow channel formation member and being biased by the flow channel formation member towards the outside from the liquid storage part is arranged. The bubble point pressure of this porous member is greater than the bubble point pressure of the flow channel formation member. With this structure, the meniscus formed in the porous member can be maintained.

The liquid storage container according to an eighteenth aspect is the liquid storage container described in the seventeenth aspect, in which the capillary force generation structure is a second flow channel formation member.

In this liquid storage container, the liquid can be retained in the second flow channel formation member provided as the capillary force generation structure.

The liquid storage container according to a nineteenth aspect is the liquid storage container described in the seventeenth aspect, in which the capillary force generation structure is a groove provided between the liquid storage part and the liquid remaining amount measurement part.

In this liquid storage container, the liquid can be retained in the groove provided as the capillary force generation structure.

The liquid storage container according to a twentieth aspect is the liquid storage container described in any one of the first to nineteenth aspects, in which the porous member is fixed in a top end of the liquid supply part in a manner of covering an opening of the top end of the liquid supply part.

With such structure, in case, even when the porous member is broken or damaged, it is possible to easily replace to a new one. Therefore, it is possible to continuously use the liquid storage container for a long term.

The liquid storage container according to a twenty-first aspect is the liquid storage container described in any one of the first to nineteenth aspects, in which the porous member is fixed in the liquid supply part in a manner of covering an opening of the liquid supply part, and is a film having greater bubble point than the flow channel formation member.

With this structure, in case, even when the porous member is broken or damaged, it is possible to easily replace to a new one. Therefore, it is possible to continuously use the liquid storage container for a long term. In addition, the bubble point pressure of the porous member is greater than the bubble point pressure of the flow channel formation member. With this structure, the meniscus formed in the porous member can be maintained.

A liquid supply system according to a twenty-second aspect includes the liquid storage container described in any one of the first to twentieth aspects, a holder capable of mounting the liquid storage container, and a head arranging a nozzle to eject the liquid. The holder includes a liquid introduction part capable of introducing the liquid. The liquid introduction part includes a porous member in holder side, and when the liquid storage container is mounted on the holder, the porous member in container side contacts with the porous member in holder side.

With this structure, the porous member in container side is brought into good contact with the porous member in holder side, so that the liquid inside the liquid storage part can be stably supplied to the head.

Other than the aforementioned liquid storage container, liquid consumption device, or liquid supply system, the present invention may be configured as a production method for the liquid storage container, the liquid consumption device, or the liquid supply system, an application method for the liquid storage container, the liquid consumption device, or the liquid supply system, etc.

BRIEF DESCRIPTION OF THE DRAWINGS

FIGS. 12A and 12B are explanatory diagrams showing an effect by which the meniscus pressure of the container-side-filter satisfies formula (1) and formula (2);

FIG. 13 is a diagram showing pressure changes in each part when a detachment speed of the cartridge is slow;

DETAILED DESCRIPTION OF EMBODIMENTS

A. First Embodiment

Figure 1:
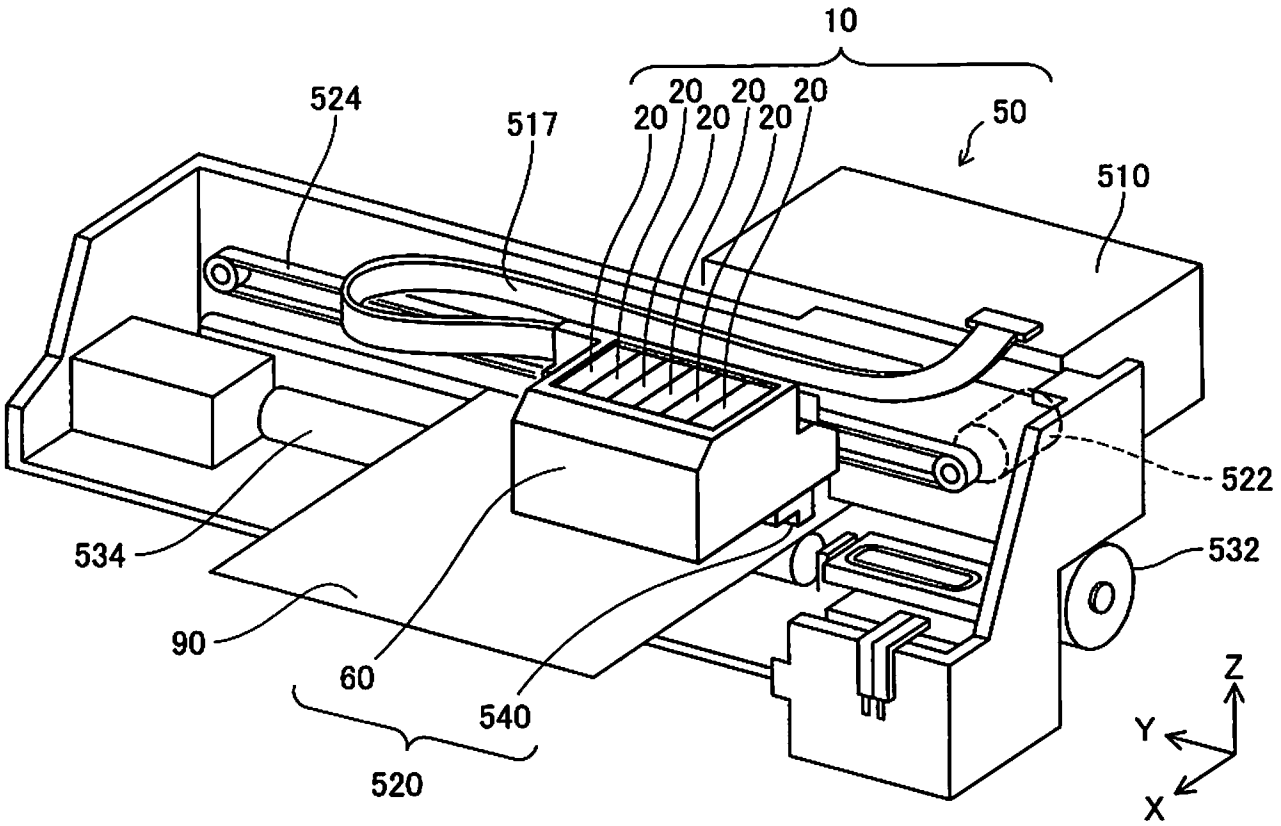
FIG. 1 is a perspective view showing a configuration of a liquid supply system.

FIG. 1 is a perspective view showing a configuration of a liquid supply system 10 according to the first embodiment of the present invention. The liquid supply system 10 is provided with cartridges 20 as a liquid storage container in which the ink is stored inside, and a printer 50 as a liquid consumption device. In FIG. 1, XYZ axes, which are orthogonal to each other, are drawn. The XYZ axes in FIG. 1 correspond to the XYZ axes in other drawings. Hereinafter, the XYZ axes are allotted in the drawings if necessary. In a using posture of the printer 50, −Z-axis direction is a vertical direction, and a surface of +X-axis direction of the printer 50 is the front surface.

The printer 50 includes a main scanning feeding mechanism, a sub-scanning feeding mechanism, and a head driving mechanism. The main scanning feeding mechanism reciprocates a carriage 520 connected to a driving belt 524 in a main scanning direction by using a power of a carriage motor 522. The sub-scanning feeding mechanism conveys a print sheet 90 in the sub-scanning direction by using a paper feeding roller 534 moved by a paper feeding motor 532 as the power. In the present embodiment, the main scanning direction of the printer 50 is the Y-axis direction, and the sub-scanning direction is the X-axis direction. The head driving mechanism performs ejecting the ink by driving the print head 540 provided in the carriage 520. The printer 50 is provided with a control unit 510 for controlling each of the aforementioned mechanisms. The control unit 510 is connected with the carriage 520 via a flexible cable 517.

The carriage 520 is provided with a holder 60 in which cartridges 20 are mounted, and the print head 540 in which a plurality of nozzles 541 (see FIG. 6) for ejecting the ink is arranged facing to the print sheet 90. The holder 60 is capable of mounting the plurality of cartridges 20 and is arranged in the upper side of the print head 540. The cartridges 20 mounted on the holder 60 align in the Y-axis direction. In an example shown in FIG. 1, the holder 60 is capable of independently mounting six cartridges, and for example, each of the six cartridges such as black, yellow, magenta, cyan, light cyan, and light magenta is mounted. As the holder 60, it is possible to use any plural types of cartridges other than the aforementioned cartridges.

Figure 2:
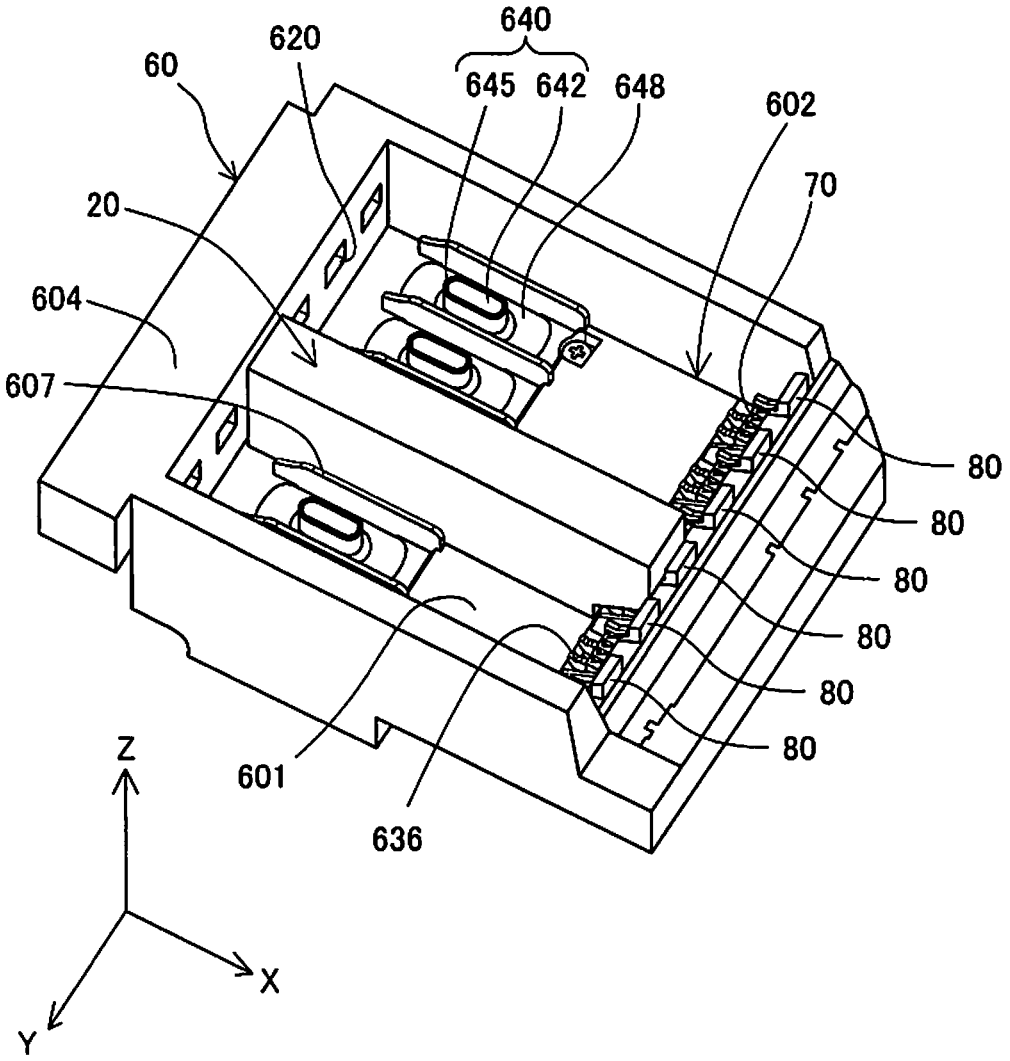
FIG. 2 is a perspective view of a holder in which cartridges are mounted.

FIG. 2 is a perspective view of the holder 60 in which the cartridges 20 are mounted. FIG. 2 shows a state in which one cartridge 20 is mounted on the holder 60. The holder 60 is provided with a cartridge storage chamber 602 in which the cartridges 20 are mounted from the upper side. The cartridge storage chamber 602 is partitioned by partition walls 607, and they partition into a plurality of slots (mounting space) capable of mounting each cartridge 20. Such partition walls 607 function as a guide when the cartridges 20 are inserted to the slots. By the way, it is possible that the partition walls 607 may be omitted.

In the cartridge storage chamber 602, a lever 80, a recessed part 620, a projecting part 636, a liquid introduction part 640, and a contact mechanism 70 are provided in every slot.

The levers 80 are provided in the +X-axis direction side of the cartridge storage chamber 602, and the recessed parts 620 are provided on the wall surface of the −X-axis direction side of the cartridge storage chamber 602. When the cartridges 20 are mounted along the partition walls 607 from the upper side of the cartridge storage chamber 602, the cartridges 20 are locked by these levers 80 and recessed parts 620. When the cartridges 20 are mounted in the cartridge storage chamber 602, the liquid supply parts 280 (see FIG. 3) of the cartridges 20 are connected to the liquid introduction parts 640 provided on the bottom surface 601 of the cartridge storage chamber 602.

The liquid introduction part 640 includes a device-side-cylindrical-body 645 provided on the bottom surface 601 of the cartridge storage chamber 602, and a device-side-filter 642 provided on a top surface (surface in the +Z-axis side) of the device-side-cylindrical-body 645. The device-side-filter 642 is formed by porous member such as, for example, a metallic mesh, a metallic non-woven fabric, a resin filter, etc. In the inside of the device-side-cylindrical-body 645, an ink flow chamber 646 communicating with the print head 540 is formed into a funnel shape along the Z-axis direction (see FIG. 6A). The device-side-filter 642 provided on the top surface of the device-side-cylindrical-body 645 contacts with a container-side-filter 273 provided in the liquid supply part 280 of the cartridge 20 (see FIG. 6A). An elastic member 648 is provided surrounding the liquid introduction part 640. The elastic member 648 tightly contacts with the surrounding of the liquid supply part 280 of the cartridge 20 in a state in which the cartridge 20 is mounted on the holder 60. Therefore, the elastic member 648 prevents the ink from leaking to the outside from the liquid supply part 280.

The contact mechanism 70 is electrically connected to the control unit 510 via a flexible cable 517. The contact mechanism 70 is electrically connected to a terminal group 400 provided in a circuit substrate 40 (see FIG. 3) of the cartridge 20 in a state in which the cartridge 20 is mounted on the holder 60. With this, the contact mechanism 70 and the terminal group 400 of the cartridge 20 are electrically contacted, and therefore, each type of information can be transmitted between the control unit 510 and the cartridge 20.

Figure 3:
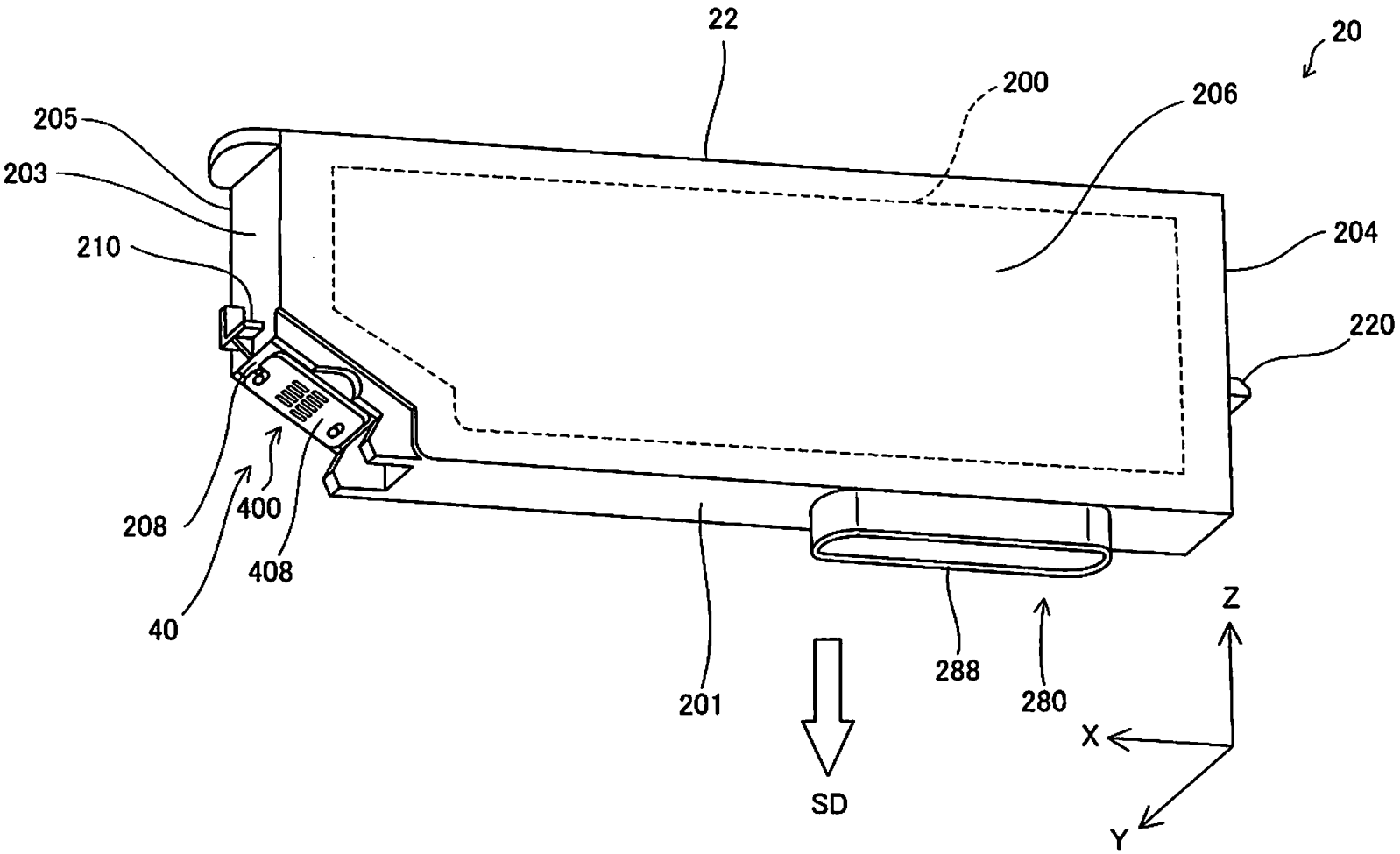
FIG. 3 is a perspective view showing a configuration of a cartridge.

FIG. 3 is a perspective view showing a configuration of the cartridge 20. The cartridge 20 is provided with a case 22 formed by synthetic resin such as polypropylene (PP), etc., a liquid storage part 200 formed in the case 22, a liquid supply part 280 provided on the bottom surface of the case 22, and the circuit substrate 40. An arrow SD shown in FIG. 3 indicates a direction to which the cartridge 20 is mounted on the holder 60.

In the front surface 203 (the surface in +X-axis direction side) of the case 22, a first projecting part 210 is provided. The first projecting part 210 is locked by the lever 80 (see FIG. 2) provided in the cartridge storage chamber 602 when the cartridge 20 is mounted on the holder 60.

In the back surface 204 (the surface in the −X-axis direction) of the case 22, a second projecting part 220 is provided. The second projecting part 220 is locked by the recessed part 620 provided in the cartridge storage chamber 602 when the cartridge 20 is mounted on the holder 60.

In a corner part where the front surface 203 and the bottom surface 201 (the surface in the −Z-axis direction) of the case 22 are intersected, an inclined surface 208 is provided. In the inclined surface 208, the circuit substrate 40 is provided. In the front surface 408 of the circuit substrate 40, the terminal group 400 that contacts with the contact mechanism 70 (FIG. 2) of the holder 60 is provided. In the back surface of the circuit substrate 40, a memory device such as an EEPROM, etc. electrically connected to the terminal group 400 is mounted.

The liquid supply part 280 communicates with the liquid storage part 200 inside the case 22. The liquid supply part 280 is provided with a container-side-cylindrical-body 288 in which the top end (the end part in the −Z-axis direction)

is opened. The top end part of the container-side-cylindrical-body 288 tightly contacts with the elastic member 648 provided on the bottom surface 601 of the holder 60 in the state that the cartridge 20 is mounted on the holder 60.

Figure 4:
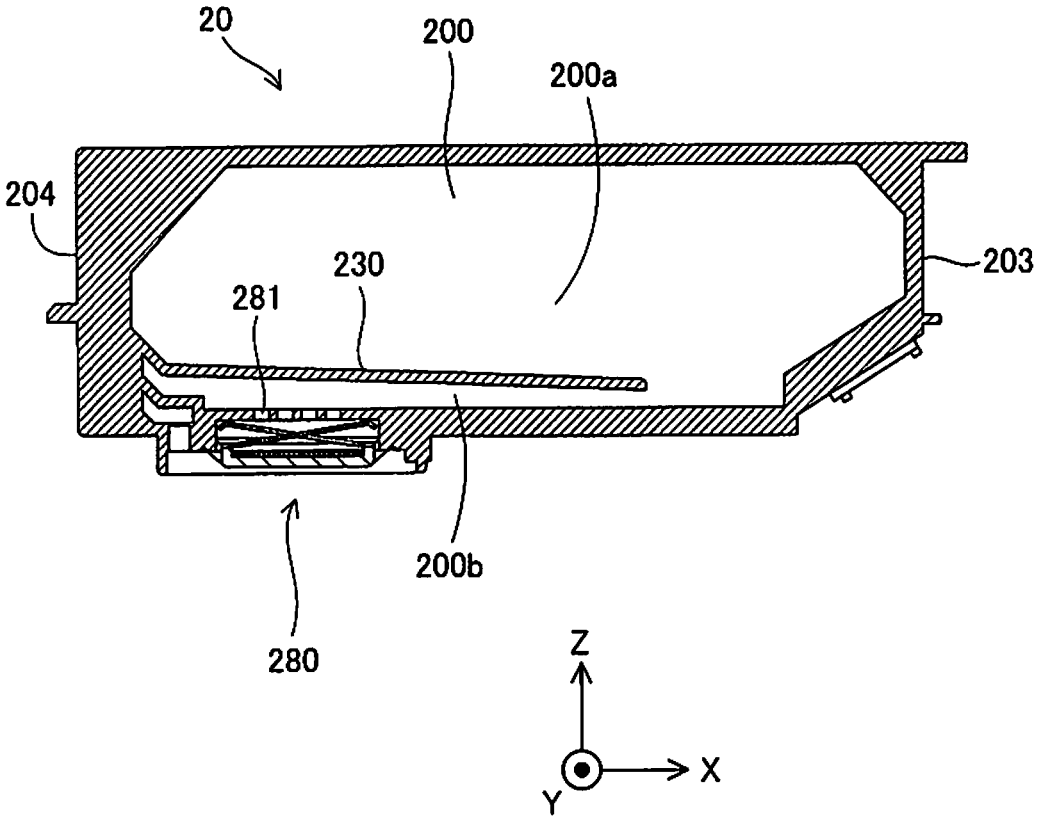
FIG. 4 is a diagram showing a ZX cross-sectional surface of the cartridge.

FIG. 4 is a diagram showing a ZX cross-sectional surface of the cartridge 20. In the inside of the cartridge 20, the liquid storage part 200 is formed. In the bottom surface of the liquid storage part 200, communication openings 281 to supply liquid to the liquid supply part 280 are provided. In the upper part of the communication openings 281, a divider 230, which partitions the liquid storage part 200 into an upper space 200*a* and a lower space 200*b*, is provided. The divider 230 contacts with two side surfaces (the surface in the +Y-axis direction side and the surface in the −Y-axis direction side) and the back surface 204 of the case 22, and inclines in the −Z-axis direction (vertically downward) from the back surface 204 side to the front surface 203 side. When the air (air bubble) is entered from the liquid supply part 280 to the inside of the cartridge 20, the lower space 200*b* formed by this divider 230 becomes a space where the air bubble is accumulated. However, this divider 230 may be omitted.

Figure 5:
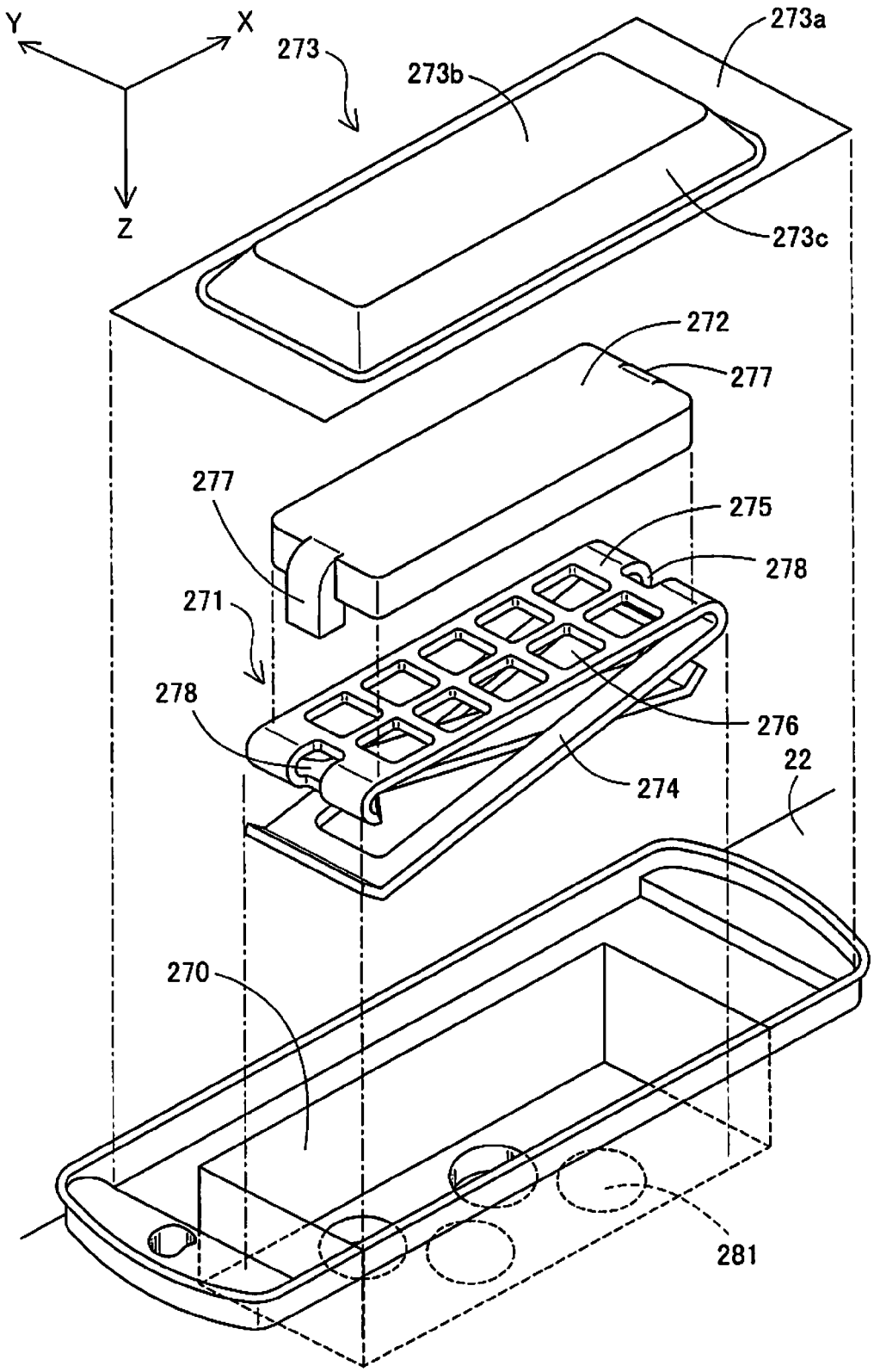
FIG. 5 is an exploded perspective view of a liquid supply part.
Figure 6A:
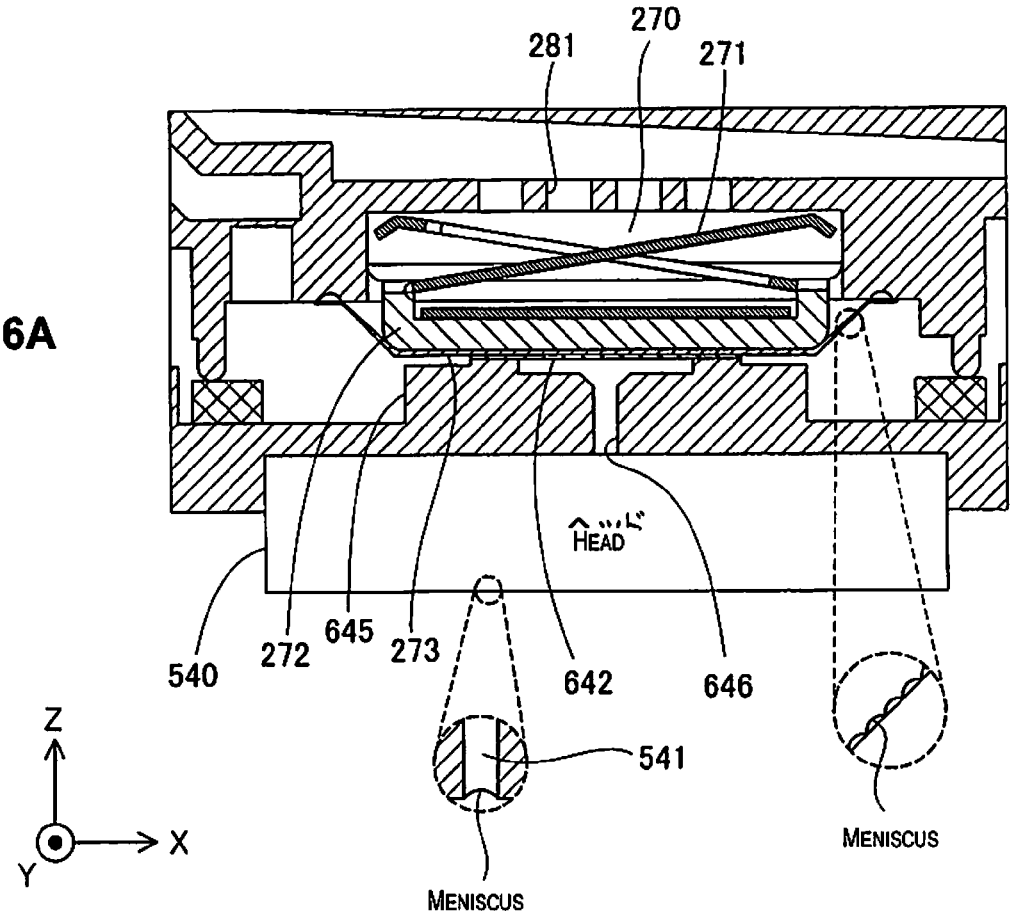
FIG. 6A is a ZX cross-sectional view showing a state in which the liquid supply part contacts with the liquid introduction part.

FIG. 5 is an exploded perspective view of the liquid supply part 280. FIG. 6A is a ZX cross-sectional view in a state in which the liquid supply part 280 contacts with the liquid introduction part 640. As shown in these drawings, the liquid supply part 280 is configured by which the plate spring 271, the foam 272 as a flow channel formation member, and the container-side-filter 273 as a porous member in container side are arranged in the recessed part 270 provided on the bottom surface 201 of the case 22. The communication openings 281 are arranged in a part between the recessed part 270 and the liquid storage part 200 within the case 22.

The container-side-filter 273 is a porous member provided in the outermost surface of the liquid supply part 280. A peripheral edge part 273*a* of the container-side-filter 273 is welded to the case 22 surrounding the recessed part 270. A central part 273*b* of the container-side-filter 273 is formed in a planer shape, and is projected toward the outer side (−Z-axis direction side) farther than the peripheral edge part 273*a* of the container-side-filter 273. In a state in which the cartridge 20 is mounted on the holder 60, the device-side-filter 642 provided in the holder 60 contacts with the central part 273*b* of the container-side-filter 273. In a state in which the cartridge 20 is mounted on the holder 60, an inclined part 273*c* between the peripheral edge part 273*a* of the container-side-filter 273 and the central part 273*b* does not contact with the device-side-filter 642 and forms meniscus of the ink (see FIG. 6A). By this meniscus, in a state in which the cartridge 20 is mounted on the holder 60, the leakage of the liquid from the inclined part 273*c* of the container-side-filter 273 is suppressed. Further, the central part 273*b* of the container-side-filter 273 contacts with the foam 272 and the inclined part 273*c* does not contact with the foam 272.

As the container-side-filter 273, it is preferable to employ a filter capable of being welded to the case 22 and having a small pressure loss and a high meniscus pressure. As such filter material, for example, a filter forming through-holes, which are made in a film by a press-processing, etc., a symmetric membrane such as MMM film, etc. made by PALL Corporation, or a symmetric membrane such as, for example, a woven fabric can be employed. The phrase "meniscus pressure" means the pressure which withstands without braking meniscus of the ink (liquid), and it is also called as "bubble point pressure".

For the formation method of the container-side-filter 273, before the filter material is welded to a part surrounding the recessed part 270 within the case 22, the filter material may be preliminary processed and formed in order to distinguish the peripheral edge part 273*a*, the central part 273*b*, and the inclined part 273*c*. Further, when the filter material is welded to the part surrounding the recessed part 270 within the case 22, it may be a deformation method in order to distinguish the peripheral edge part 273*a*, the central part 273*b*, and the inclined part 273*c*.

The plate spring 271 is integrally provided with the biasing member 274 and the support member 275. The plate spring 271 has a height which is approximately the same as the depth of the recessed part 270 provided in the case 22 or slightly higher than its depth. The plate spring 271 is arranged inside the recessed part 270 in the manner in which the support member 275 side is directed to the container-side-filter 273 (−Z-axis direction side). The biasing member 274 is formed in the manner in which legs provided in both ends of the long plate shaped support member 275 are bent to intersect in the +Z-direction side. A plurality of flow holes 276 which communicate in the Z-axis direction are provided in the plate shaped support member 275. When the cartridge 20 is mounted on the holder 60, the biasing member 274 has the function in which the container-side-filter 273 indirectly contacts with the device-side-filter 642 via the foam while pressing. At the time of pressing, the support member 275 flatly and indirectly supports the container-side-filter 273 via foam 272, and the container-side-filter 273 is brought into surface contact with the device-side-filter 642.

Figure 6B:
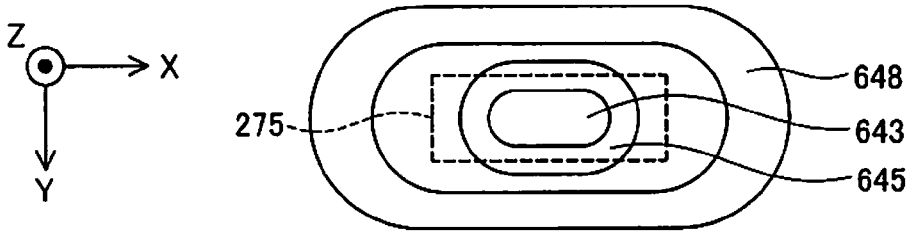
FIGS. 6B and 6C are diagrams showing an example of a position relationship of a support member, a device-side-cylindrical-body, and a device-side-filter in a plan view

FIG. 6B is a diagram showing an example of a position relationship of the support member 275, the device-side-cylindrical-body 645, and the device-side-filter 642 in a plan view. Here, the foam 272 is made of soft material, and when the plate spring 271 is deformed by biasing, the part in the container-side-filter 273 having an excellent adhesion with the device-side-filter 642 is the part which is biased to the support member 275. In this part, the pressure loss in the case of the ink supply is reduced in comparison with a case in which the adhesion is not good because it is not biased. Further, an effective area 643, which is an area surely flowing the ink in the device-side-filter 642, is an area where the device-side-filter 642 and the top end surface of the device-side-cylindrical-body 645 are not overlapped within the area surrounding by the top end surface of the device-side-cylindrical-body 645. Then, the container-side-filter 273 and the device-side-filter 642 are preferably tightly contacted in the manner in which the support member 275 entirely covers the effective area 643. That is, it is preferable that in the plan view, the length (distance in the X-axis direction) of the support member 275 equals to the length (distance in the X-axis direction) of the effective area of the device-side-filter 632, or it is longer than that, and in addition, the width (distance in the Y-axis direction) of the support member 275 equals to the width (distance in the Y-axis direction) of the effective area, or it is greater than that (see FIG. 6B). The effect can be obtained by which at least, the width (distance in the Y-axis direction) of the support member 275 equals to width (distance of the Y-axis direction) of the effective area, or it is greater than that.

Further, the ink supplied from the cartridges 20 to the print head 540 requires a flow rate in a certain level or more. It is preferable to enlarge the effective area 643 in order to increase the flow rate of the ink per a unit of time. On the other hand, the space where the cartridges 20 are arranged on the holder 60 is limited, so that it is necessary to reduce the width of the Y-axis direction of the cartridges 20 (see FIG. 2). Therefore, it is preferable to reduce the width of the Y-axis direction of the liquid supply part 280 positioned on the bottom surface 201 of the case 22 of the cartridge 20 When the foam 272 is made of a soft material, in the plan view, when the width (distance in the Y-axis direction) of the support member 275 is defined as Y1, the width (distance in the Y-axis direction) of the circumference of the device-side-cylindrical-body 645 is defined as Y2, and the width (distance in the Y-axis direction) of the effective area is defined as Y3, the relationship of Y2≥Y1≥Y3 is preferably satisfied (see FIG. 6C).

On the other hand, in a case in which the foam 272 is made of a hard material and it is not deformed even when the plate spring 271 biases it, the part in which the container-side-filter 273 has excellent tightness with the device-side-filter 642 is the part tightly contacting with the foam 272. Then, it is preferable that in the plan view, the length (distance in the X-axis direction) of the foam 272 equals to the length (distance in the X-axis direction) of the effective area of the device-side-filter 642, or it is longer than that, and in addition, the width (distance in the Y-axis direction) of the foam 272 equals to the width (distance in the Y-axis direction) of the effective area, or it is greater than that (see FIG. 6B). The effect can be obtained by which at least, the width (distance in the Y-axis direction) of the foam 272 equals to the width (distance in the Y-axis direction) of the effective area, or it is greater than that.

Figure 6C:
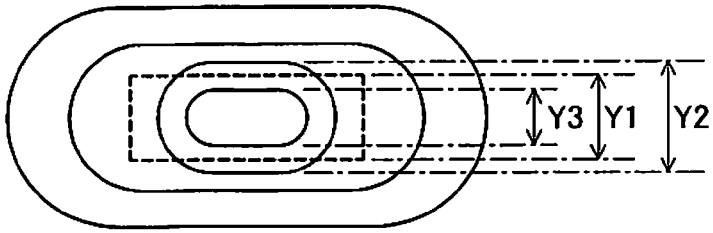

Further, in a case in which the foam 272 is made of a hard material, in the plan view, when the width (distance in the Y-axis direction) of the foam 272 is defined Y1, the width (distance in the Y-axis direction) of the circumference of the device-side-cylindrical-body 645 is defined as Y2, and the width (distance in the Y-axis direction) of the effective area is defined as Y3, the relationship of Y2≥Y1≥Y3 is preferably satisfied (see FIG. 6C).

In the present embodiment, the biasing member 274 and the support member 275 are integrally formed with the plate spring 271. However, these members may be separately configured. In this case, the biasing member 274 is not limited to the plate spring 271 as long as it has the function biasing the container-side-filter 273 to the outside, and it may be configured by other elastic body such as a coil, an elastic rubber, etc.

The foam 272 is a porous member arranged between the plate spring 271 and the container-side-filter 273. The foam 272 planarly spreads the liquid, which is supplied from the inside of the liquid storage part 200 through the flow holes 276 provided in the support member 275 of the plate spring 271, to the container-side-filter 273. The thickness of the foam 272 is set in the thickness capable of planarly spreading the liquid supplied from the flow holes 276. Further, in a state in which the container-side-filter 273 is biased to the device-side-filter 642 by the plate spring 271, rigidity of the foam 272 becomes rigidity approximately in which the flow channel in the foam 272 is not closed. Projection parts 277 bent toward the plate spring 271 side are provided in the end parts of the +X-axis direction side and −X-axis direction side of the foam 272. This projection parts 277 fit to the recessed parts 278 provided in the end parts of the +X-axis direction side and −X-axis direction side of the plate spring 271. Therefore, the foam 272 is positioned with respect to the plate spring 271.

Figure 7:
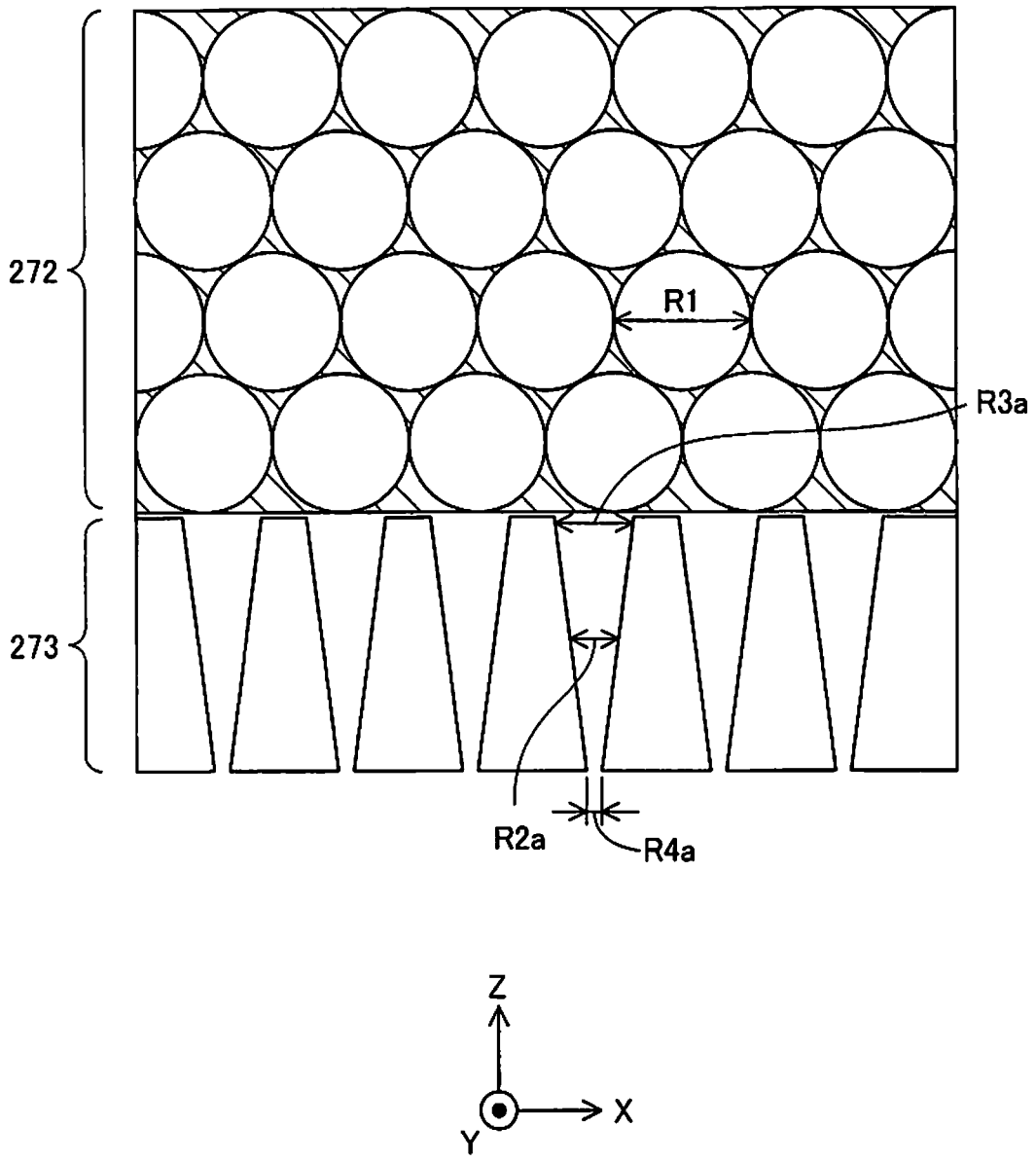
FIG. 7 is an explanatory diagram schematically showing an aspect of a cross-sectional surface configuration of foam and a container-side-filter when the filter forming through-holes, which are made in a film by a press-processing, etc., is used as the container-side-filter.

FIG. 7 is an explanatory diagram schematically showing an aspect of the cross-sectional surface configuration of the foam 272 and the container-side-filter 273 when the filter forming through-holes, which are made in the film by the press-processing, etc., is used as the container-side-filter 273. With, this aspect, an average of an equivalent diameter R1 of holes formed in the foam 272 is greater than the average of the equivalent diameter R2*a* of the cross-sectional surface on the surface configured in the X-axis and the Y-axis of the holes formed in the container-side-filter 273. Further, with this aspect, in the container-side-filter 273, the equivalent diameter R4*a* of the cross-sectional surface on the surface configured in the X-axis and the Y-axis of the holes formed on the surface of the −Z-axis direction side (the side in device-side-filter 642) is smaller than the equivalent diameter R3*a* of the cross-sectional surface on the surface configured in the X-axis and the Y-axis of the holes formed on the surface of the +Z-axis direction side (foam 272 side). The phrase "equivalent diameter" is defined as a cross-sectional circle diameter corresponding to the cross-section of the holes.

Figure 8:
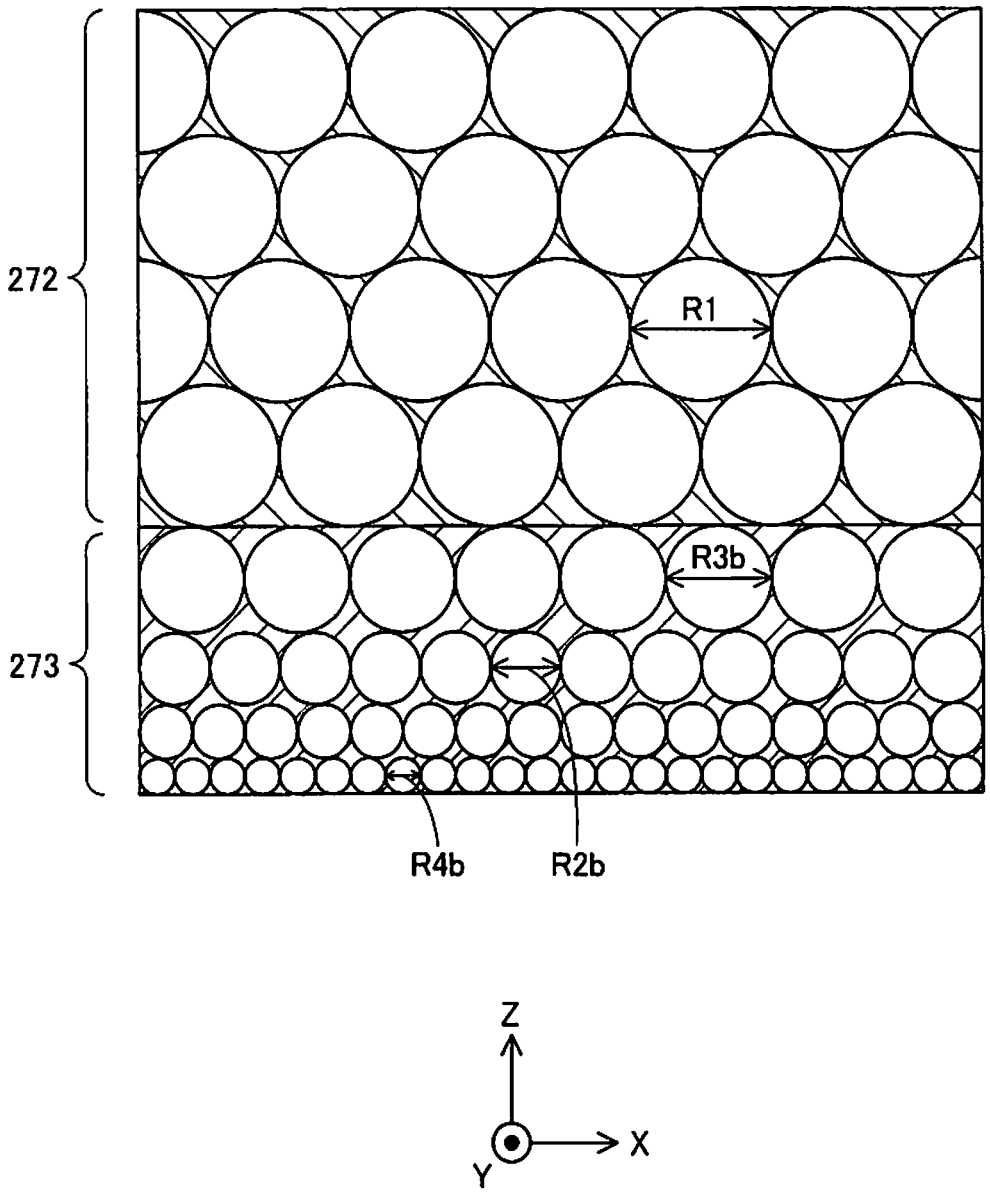
FIG. 8 is an explanatory diagram schematically showing an aspect of a cross-sectional surface configuration of the foam and the container-side-filter when a MMM film made by PALL Corporation is used as the container-side-filter.

FIG. 8 is an explanatory diagram schematically showing an aspect of the cross-sectional surface configuration of the foam 272 and the container-side-filter 273 when MMM film made by PALL Corporation is used as the container-side-filter 273. With this aspect, the average of the equivalent diameter R1 of the cross sectional surface on the surface configured in the X-axis and Y-axis of the holes formed on the foam 272 is greater than the average of the equivalent diameter R2*b* of the cross-sectional surface on the surface configured in the X-axis and Y-axis of the holes formed in the container-side-filter 273. Further, with this aspect, in the container-side-filter 273, the average of the equivalent diameter R4*b* of the cross-sectional surface on the surface configured in the X-axis and Y-axis of the holes formed on the surface of the −Z-axis direction side (the side in the device-side-filter 642) is smaller than the average of the equivalent diameter R3*b* of the cross-sectional surface on the surface configured in the X-axis and Y-axis of the holes formed on the surface of the +Z-axis direction side (foam 272 side). By the way, the holes in the MMM film are not limited to the spherical space, but the configuration in which one space is formed by connecting a plurality of spherical spaces is included.

Figure 9:
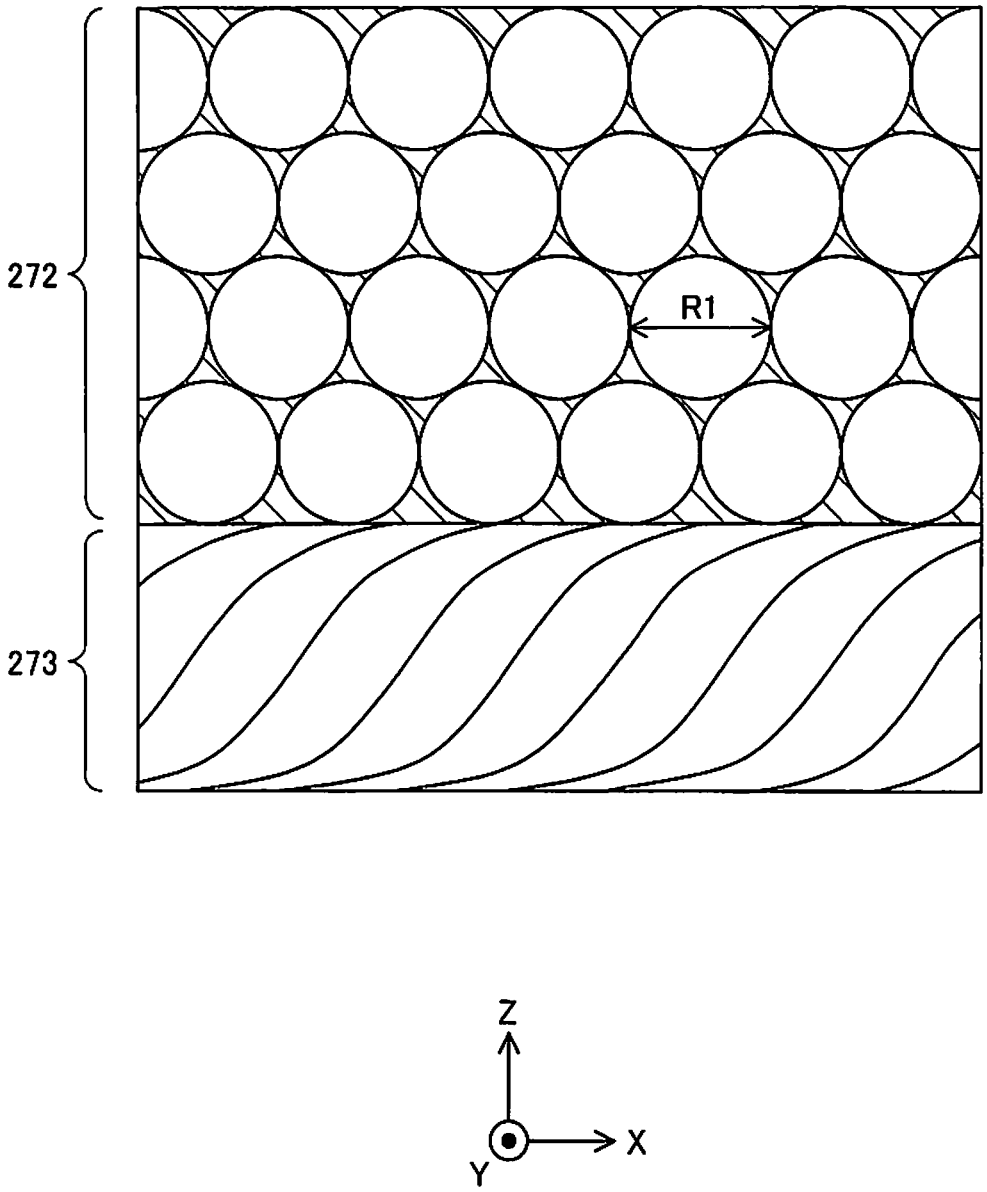
FIG. 9 is an explanatory diagram schematically showing an aspect of a cross-sectional surface of the foam and the container-side-filter when the woven fabric made by FILTRONA Corporation is used as the container-side-filter.
Figure 10:
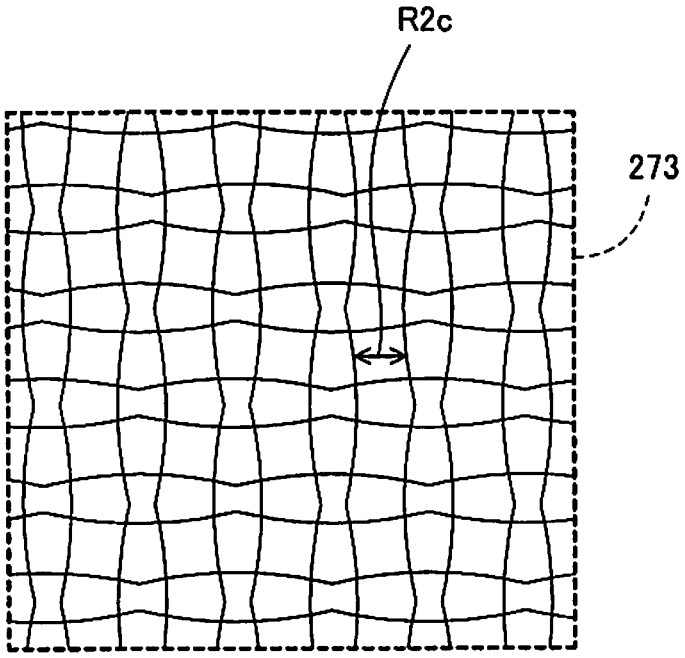
FIG. 10 is an explanatory diagram showing a cross-sectional surface configuration of a surface configured in the X-axis and the Y-axis of the container-side-filter 273 shown in FIG. 9.

FIG. 9 is an explanatory diagram schematically showing an aspect of the cross-sectional surface configuration of the foam 272 and the container-side-filter 273 when the woven fabric made by FILTRONA Corporation is used as the container-side-filter 273. FIG. 10 is an explanatory diagram showing the cross-sectional surface configuration configured in the X-axis and Y-axis of the container-side-filter 273 shown in FIG. 9. With this aspect, the average of the equivalent diameter R1 (FIG. 9) of the cross-sectional surface on the surface configured in the X-axis and Y-axis of the holes formed in the foam 272 is greater than the average of the equivalent diameter R2*c* (FIG. 10) of the cross-sectional surface on the surface configured in the X-axis and Y-axis of the holes formed on the container-side-filter 273.

According to the first embodiment described above, when the cartridge 20 is mounted on the holder 60, the container-side-filter 273 is biased to the device-side-filter 642 by the biasing member 274, so that variations of the pressing force of the container-side-filter 273 with respect to the device-side-filter 642 can be absorbed. As a result, even when the cartridges 20 (liquid supply part 280) and the printer 50 (liquid introduction part 640) have individual differences or environmental changes, plastic deformation due to the repetition of the attachment and the detachment, etc., the container-side-filter 273 and the device-side-filter 642 can be adhered in excellent contact state. As a result, the ink inside the cartridges 20 can be stably supplied to the printer 50.

Further, in the present embodiment, the plate spring 271 is provided with the planer shaped support member 275, and the container-side-filter 273 is biased by the biasing member 274 via this support member 275. Therefore, the container-side-filter 273 can evenly contact with the device-side-filter 642.

Further, in the present embodiment, since the foam 272 is arranged between the plate spring 271 and the container-side-filter 273, the flow channel area of the ink reduced by the flow holes 276 of the support member 275 can be re-expanded in the foam 272. Therefore, the pressure loss caused by the flow holes 276 of the support member 275 can be reduced. Further, since the flow channel area of the ink in the foam 272 can be expanded, the ink can planarly and uniformly flow to the container-side-filter 273. Further, in the present embodiment, since the foam 272 is arranged between the plate spring 271 and the container-side-filter 273, it can prevent the container-side-filter 273 from getting into the flow holes 276 of the support member 275. Therefore, when the cartridges 20 are mounted on the holder 60, it can prevent a gap from expanding between the container-side-filter 273 and the device-side-filter 641, and the occurrence of the air bubble in its gap can be suppressed.

Further, in the present embodiment, as the container-side-filter 273, in the aspects (FIGS. 7 to 10) in which either one of the asymmetric membrane and the symmetric membrane is employed, the equivalent diameter R1 of the cross-sectional surface on the surface configured in the X-axis and Y-axis of the holes formed in the foam 272 is greater than the equivalent diameters R2*a*, R2*b*, R2*c* of the cross-sectional surface on the surface configured in the X-axis and Y-axis of the holes formed in the container-side-filter 273, and therefore, the capillary force of the container-side-filter 273 becomes higher than that of the foam 272. As a result, when the cartridges 20 are not mounted on the holder 60, the meniscus of the ink is formed in the container-side-filter 273 provided in the outermost surface of the cartridges 20. Therefore, when the cartridges 20 are mounted on the holder 60, the ink can be smoothly supplied to the print head 540.

Further, in the present embodiment, in the aspect (FIGS. 7 and 8) in which the asymmetric membrane is employed as the container-side-filter 273, the equivalent diameters R4*a*, R4*b* of the cross-sectional surface on the surface configured in the X-axis and Y-axis of the holes formed on the surface of the −Z-axis direction side (side in the device-side-filter 642) are smaller than the equivalent diameters R3*a*, R3*b* of the cross-sectional surface on the surface configured in the X-axis and Y-axis of the holes formed on the surface of the +Z-axis direction side (foam 272 side). Therefore, the capillary force in the outside (side in the device-side-filter 642) of the container-side-filter 273 becomes higher than that in the inside (foam 272 side). As a result, when the cartridges 20 are not mounted on the holder 60, the meniscus of the ink is formed more outside within the container-side-filter 273. Therefore, when the cartridges 20 are formed in the holder 60, the liquid can be smoothly supplied to the print head 540.

In the aspects (FIGS. 7 to 10) in which any of the asymmetric membrane and the symmetric membrane is employed, bubble point pressure of the container-side-filter 273 is higher than the bubble point pressure of the foam 272. As a result, when the cartridges 20 are not mounted on the holder 60, the meniscus of the ink is formed in the container-side-filter 273 provided in the outermost surface of the cartridges 20. Therefore, when the cartridges 20 are mounted on the holder 60, the ink can be smoothly supplied to the print head 540.

Further, the bubble point pressure of the device-side-filter 642 can be set to be higher than the bubble point pressure of the container-side-filter 273. With such setting, when the cartridges 20 are mounted on the holder 60, in a case in which the air is stuck between the container-side-filter 273 and the device-side-filter 642, the air is pulled toward the container-side-filter 273 which is low bubble point pressure, so that possibility of the defect such as a nozzle-out due to the air entering into the print head 540, etc. becomes low.

Further, in the present embodiment, the container-side-filter 273 has a shape projecting toward the device-side-filter 642, so that when the container-side-filter 273 and the device-side-filter 642 are contacted, the tensile stress exerting to the container-side-filter 273 can be suppressed. As a result, for example, by pulling the container-side-filter 273 upwardly by the device-side-cylindrical-body 645 of the liquid introduction part 640, the breakage or the damage of the container-side-filter 273 can be suppressed.

Further, in the present embodiment, the biasing member 274 and the support member 275 are uniformly formed, so that the production cost of the cartridge 20 is reduced, and in addition, the number of assembling processes of the cartridge 20 can be reduced.

Figure 15:
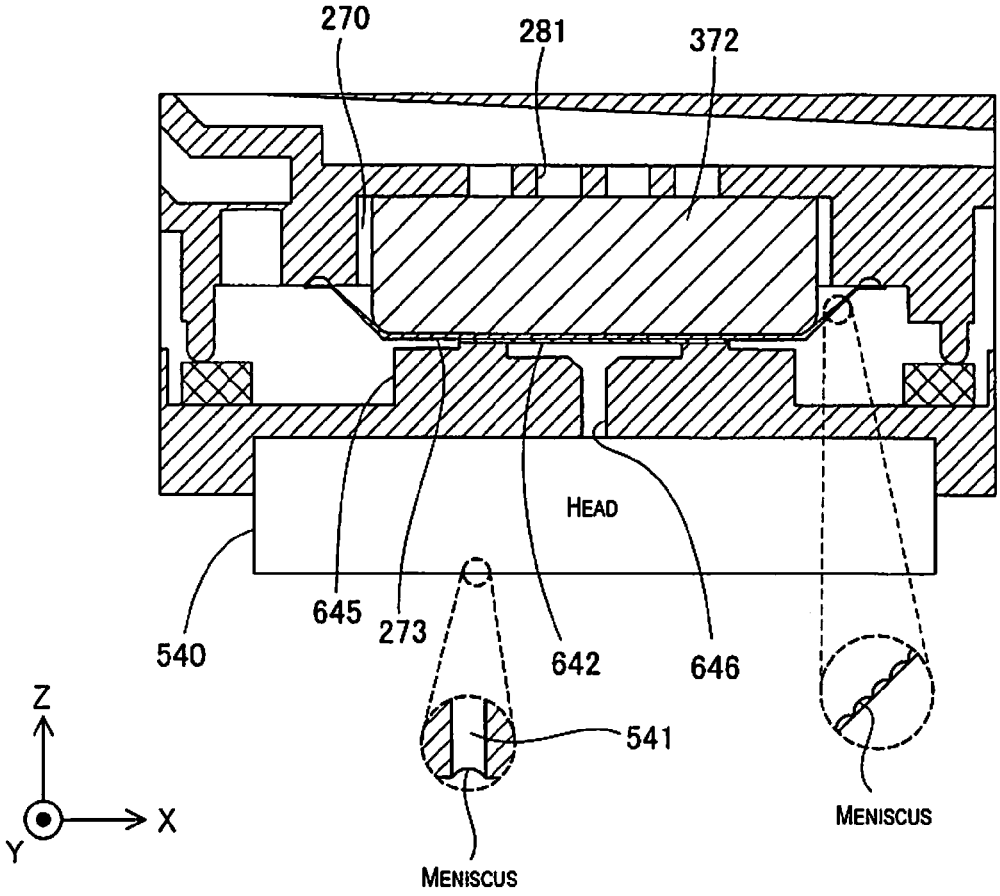
FIG. 15 is a diagram when a plate spring and the foam shown in FIG. 6 are replaced to a support foam.

Further, in the present embodiment, the plate spring 271 integrally formed with the biasing member 274 and the support member 275 is used, but it is not limited to the plate spring 271 as long as it has the function to project the container-side-filter 273 to the outside. For example, a support foam 372 which is greater thickness than the container-side-filter 273 may be used (see FIG. 15). FIG. 15 is a diagram showing the support foam 372 which substitutes from the plate spring 271 and the foam 272 in FIG. 6A. Communication openings 281 between the support foam 372 and the liquid storage part 200 are positioned. A part of the support foam 372 is arranged in the inside of the recessed part 270, and another part is projected to the outside from the recessed part 270. With this, even when the circumference of the device-side-filter 642 is greater, and the device-side-filter 642 cannot be fitted in the recessed part 270 of the case 22, another part of the support foam 372 is projected to the outside from the recessed part 270, so that the container-side-filter 273 is easily pressed against the device-side-filter 642.

Here, when the bubble point pressure of the support foam 372 is too low, the air is easily entered from the liquid supply part 280 to the liquid storage part 200. However, when the bubble point pressure is too high, the pressure loss becomes large, so that the ink supply from the cartridges 20 to the print head 540 becomes difficult. The container-side-filter 273 in which the bubble point pressure is set to be greater than the bubble point pressure of the support foam 372 is used, and therefore, while it prevents the air from entering to the liquid storage part 200, the cartridge 20 which supplies ink while suppressing the pressure loss can be provided.

The container-side-filter 273 is a porous member which is thinner than the support foam 372, and it is welded to the case 22 and covers the support foam 372 to prevent the support foam 372 from coming off from the recessed part 270. A foam as a negative pressure generation member may be arranged in the liquid storage part 200, but it is preferable that at least the communication opening 281 functions as an ink chamber in which the negative pressure generation member is not arranged. The container-side-filter 273 can be omitted.

B. Second Embodiment

In the second embodiment of the present invention, in addition to the aforementioned 1$^{st}$ embodiment, a filter that satisfies the conditions described below is employed as the container-side-filter 273. Specifically, as shown in the following formula (1), the filter having meniscus pressure PBf which is smaller than the value in which the biasing force F applying from the biasing member 274 to the container-side-filter 273 is divided by the contact area A between the container-side-filter 273 and the device-side-filter 642 is employed as the container-side-filter 273.

$$PBf<F/A \quad (1)$$

Further, in the present embodiment, as shown in the following formula (2), a filter having meniscus pressure PBf which is smaller than meniscus pressure PBr of the device-side-filter 642 is employed as the container-side-filter 273.

$$PBf<PBr \quad (2)$$

Figure 11:
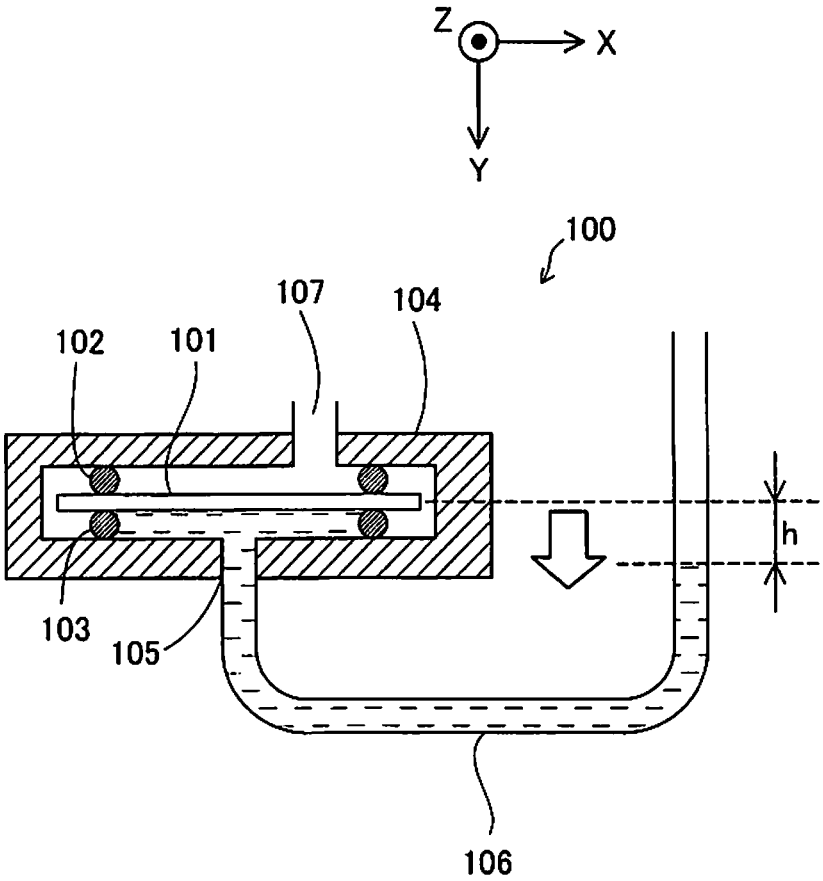
FIG. 11 is an explanatory diagram showing a schematic configuration of a measurement device for measuring a meniscus pressure.

FIG. 11 is an explanatory diagram showing a schematic configuration of a measurement device 100 for measuring a meniscus pressure of the container-side-filter 273. The measurement device 100 is provided with seal rubbers 102, 103 holding a filter 101 for measurement object from the upper surface and the lower surface, a housing 104 surrounding the peripheral of the filter 101 and the seal rubbers 102, 103, and a tube 106 in which the back end is connected to a liquid inflow port 105 provided on the lower surface of the housing 104. The upper surface of the housing 104 is provided with an atmosphere communicating port 107 communicating to the atmosphere, and the upper surface of the filter 101 is exposed to the atmosphere. The tube 106 is bent in a U-shape, and the top end is directed upwardly.

When such measurement device 100 is prepared, initially, the filter 101 of a measurement object is arranged inside the housing 104, and the ink is injected from the top end. When the ink is injected, in a position where the ink is stabilized inside the tube 106, the tube 106 is lowered vertically downward. In this way, at a height where the tube 106 is lowered, the air is taken into the inside of the ink via the filter 101 from the upper surface of the filter 101 and the air bubble is generated. When the generation of the air bubble is confirmed, the difference h between the height of the liquid surface inside the housing 104 when the air bubble starts generating and the height of the liquid surface inside the tube is measured. With such measurement, a meniscus pressure PB of the filter 101 of the measurement object is measured from drop amount h of the liquid surface of the ink inside the tube 106.

$$PB=\rho*g*h \quad (3)$$

(ρ represents a density of the ink. g represents a gravity acceleration.)

In the present embodiment, the meniscus pressures of various filers are measured by such measurement method, and among them, the filter satisfying the aforementioned formulas (1) and (2) is employed as the container-side-filter 273. The meniscus pressure measurement of the filter is not limited to such method, and it may be measured by other methods.

FIG. 12 is an explanatory diagram showing an effect obtained by which the meniscus pressure PBf of the container-side-filter 273 satisfies the aforementioned formulas (1) and (2). In the present embodiment, as shown in the aforementioned formula (1), the pressing force by the biasing member 274 is greater than the meniscus pressure PBf of the container-side-filter 273. Therefore, in a case in which the air bubble is entered between the container-side-filter 273 and the device-side-filter 642 when the cartridges 20 are mounted on the holder 60 (see FIG. 12A), the large pressure is applied to the air bubble from the peripheral by the pressing force of the biasing member 274. Therefore, the air bubble entered between the container-side-filter 273 and the device-side-filter 642 cannot be accumulated between the container-side-filter 273 and the device-side-filter 642. And, as shown in the aforementioned formula (2), in the present embodiment, since the meniscus pressure PBf of the container-side-filter 273 is smaller than the meniscus pressure PBr of the device-side-filter 642, the air bubble to which the pressing force is applied from the biasing member 274 is taken into the side of the container-side-filter 273 having smaller meniscus pressure (see FIG. 12B). As a result, the occurrence of the defects such as nozzle-out due to the air bubble entering to the nozzles 541 of the print head 540, unstable printing, etc. can be prevented.

With this, when the defects of the nozzles 541 are prevented, the processes solving the defects of the nozzles 541 by the printer 50 are not necessary to be performed when the cartridges 20 are mounted on the holder 60. Therefore, the printing process can be promptly started. As the processes solving the defects of the nozzles 541, for example, after the ink in the cartridges 20 was suctioned from the print head 540 side and a predetermined amount of the ink was discharged, a cleaning process that wipes off the top end of the nozzles 541 is performed. This cleaning process when the cartridges 20 are mounted is called as "replacement cleaning process". According to the present embodiment, since the execution of this replacement cleaning process is not required, the ink consumption due to the execution of the replacement cleaning process which is not the purpose of printing can be suppressed.

Further, in the present embodiment, in the same manner as the first embodiment, it has a configuration in which the ink is transferred from the liquid storage part 200 to the recessed part 270 and stores in the container-side-filter 273. Since the thickness of the container-side-filter 273 is thin, the meniscus is formed on the surface and the wet condition is kept. In the case in which the cartridges 20 are mounted on the holder 60, when the container-side-filter 273 contacts with the device-side-filter 642, the transmission of the ink immediately starts. Therefore, with such configuration, since there is no space in which the ink is not existed between the container-side-filter 273 and the device-side-filter 642, the execution of the replacement cleaning process is not required.

Here, in the cleaning process, the ink which is greater amount than the amount used in the normal printing operation is suctioned to the print head 540. At this time, when the suction amount of the ink per unit of time exceeds a predetermined amount, the absolute value of the negative pressure between the container-side-filter 273 and the device-side-filter 642 becomes greater than the absolute value of the meniscus pressure PBf of the container-side-filter 273, so that the meniscus of the container-side-filter 273 is broken, and the air is entered inside the container-side-filter 273 from the outside. Then, a flow channel in which the air entered to the inside from the inclined part 273*c* is suctioned out to the device-side-filter 642 via the central part 273*b* is created, and therefore, the cleaning does not function. In this time, the predetermined amount which is the threshold value is called as a cleaning limit flow rate. At the time of the cleaning process, as the cleaning limit flow rate becomes greater, the inside air is expanded due to the high negative pressure inside the print head 540, so that the air can be easily discharged. Therefore, the effect in which the defects of the nozzles 541 are suppressed can be obtained by setting the cleaning limit flow rate to be greater. Accordingly, it is preferable to set the meniscus pressure PBf of the container-side-filter 273 in the manner in which the absolute value of the meniscus pressure PBf of the container-side-filter 273 becomes greater than the absolute value of the negative pressure between the container-side-filter 273 and the device-side-filter 642 caused by the cleaning limit flow rate.

Further, in the present embodiment, in the same manner as the first embodiment, the bubble point pressure of the container-side-filter 273 is higher than the bubble point pressure of the foam 272. For example, the equivalent diameter of the cross-sectional surface on the surface configured in the X-axis and Y-axis of the holes formed on the surface of the +Z-axis direction side (foam 272 side) is greater than the equivalent diameter of the cross-sectional surface on the surface configured in the X-axis and Y-axis of the holes formed on the surface (side of the device-side-filter 642) of the −Z-axis direction side. Further, the equivalent diameter of the cross-sectional surface on the surface configured in the X-axis and Y-axis of the holes formed in the foam 272 is greater than the equivalent diameter of the cross-sectional surface on the surface configured in the X-axis and Y-axis of the holes formed in the container-side-filter 273. Therefore, in a case in which the air bubble is taken into the inside from the container-side-filter 273, blocking the rising of the air bubble due to buoyancy by the existence of the container-side-filter 273 or the foam 272 can be suppressed. As a result, it can further suppress entering the air bubble into the inside of the print head 540.

In the present embodiment, the filter that satisfies both conditions of the aforementioned formulas (1) and (2) was employed as the container-side-filter 273, but the filter that satisfies either one of the formulas may be employed as the container-side-filter 273.

C. Third Embodiment

In the Third embodiment of the present invention, in addition to the aforementioned 1$^{st}$ embodiment, a filter that satisfies conditions described below is employed as the container-side-filter 273. Specifically, when the cartridges 20 are detached from the holder 60, regardless the speed of the detachment, the container-side-filter 273 in which the meniscus is easily broken than the meniscus formed in the nozzles 541 of the print head 540 is employed.

The meniscus pressure PBf of such container-side-filter 273 can be represented as the following formula (4). That is, the meniscus pressure P of the container-side-filter 273 in the present embodiment becomes a pressure smaller than the value that subtracts value α from the meniscus pressure PBn of the nozzles 541.

$$PBf<PBn-\alpha \quad (4)$$

Here, the value α represents the total value of at least one of the following values (a) to (c).

(a) Difference between the dynamic meniscus pressure and the static meniscus pressure of the nozzles 541.

(b) Pressure loss inside nozzles 541 caused when the cartridges 20 are detached from the holder 60.

(c) Pressure reduction value due to the mechanical compliance of the inside of the nozzles 541 caused when the cartridges 20 are detached from the holder 60.

The dynamic meniscus pressure means the pressure in which the meniscus is capable of enduring pressure when the pressure is rapidly applied to the meniscus, and the static meniscus pressure means the pressure in which the meniscus is capable of enduring pressure when the pressure is gradually applied to the meniscus.

Figure 14:
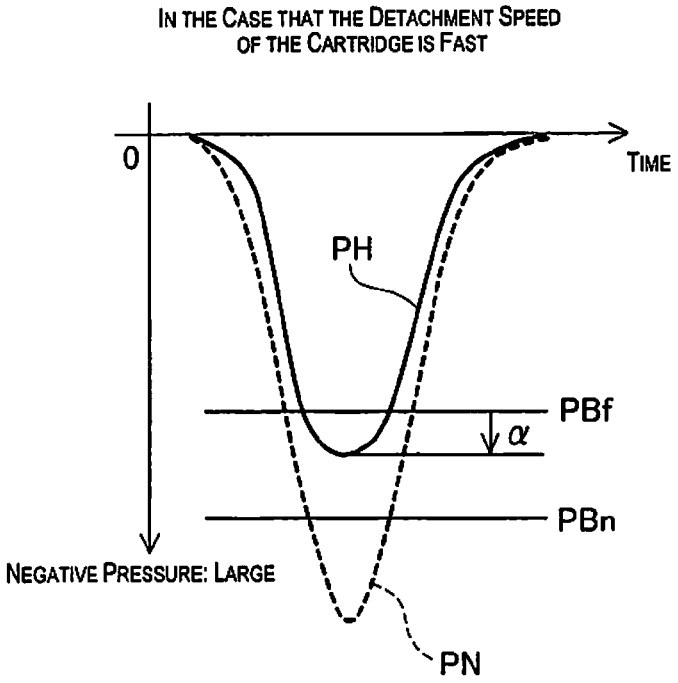
FIG. 14 is a diagram showing pressure changes in each part when a detachment speed of the cartridge is fast.

FIG. 13 is a diagram showing pressure changes in each part in a case in which the detachment speed of the cartridge 20 is slow. Further, FIG. 14 is a diagram showing pressure changes in each part in a case in which the detachment speed of the cartridge 20 is fast. In the graphs shown in these drawings, the horizontal axis represents time, and the vertical axis represents pressure (negative pressure). In FIG. 13 and FIG. 14, each symbol represents the following values.

PBf: Meniscus pressure of the container-side-filter 273.

PBn: Meniscus pressure of the nozzles 541.

PN: Pressure inside the liquid supply part 280 in a case in which the air is not taken from the outside is assumed.

PH: Actual pressure inside the nozzles 541.

As shown in FIG. 13, in the case that the detachment speed of the cartridge 20 is slow, the pressure PN (negative pressure) inside the liquid supply part 280 and the pressure PH (negative pressure) inside the nozzles 541 become greater in accordance with the lapse time when the cartridge 20 is detached because the pressing force by the biasing member 274 is released in accordance with the detachment of the cartridge 20. However, these pressures PN, PH never exceeds the meniscus pressure PBf of the container-side-filter 273 and the meniscus pressure PBn of the nozzles 541. Further, these pressures PN, PH become approximately the same pressure and show approximately the same pressure changes because the liquid supply part 280 and the nozzles 541 are connected by the container-side-filter 273 and the device-side-filter 642.

With this, in the case in which the detachment speed of the cartridge 20 is slow, since the pressure PN inside the liquid supply part 280 and the pressure PH inside the nozzles 541 never exceed the meniscus pressure PBn of the nozzles 541, the condition in which the meniscus of the nozzles 541 is not broken can be represented as the following formula (5). That is, when the actual pressure PH inside the nozzles 541 is smaller than the meniscus PBn of the nozzles 541, the meniscus of the nozzles 541 is not broken.

$$PH<PBn \quad (5)$$

On the other hand, as shown in FIG. 14, in the case in which the detachment speed of the cartridge 20 is fast, when it assumes that the air is not taken from the outside, in accordance with the lapse time when the cartridge 20 is detached, the pressure PN inside the liquid supply part 280 and the pressure PH inside the nozzles 541 exceed the meniscus pressure PBn of the nozzles 541, so that the meniscus of the nozzles 541 is broken. However, in fact, at the time of exceeding the meniscus pressure of the container-side-filter 273, the meniscus of the container-side-filter 273 (more specifically, the meniscus of the inclined part 273*c* of the container-side-filter 273) is broken, so that the air is entered into the liquid supply part 280 and the nozzles 541. Therefore, even though the actual pressure PH inside the nozzles 541 exceeds the value α from the meniscus pressure PBf of the container-side-filter 273, it becomes the pressure which does not reach the meniscus pressure PBn of the nozzles 541. That is, in the case in which the detachment speed of the cartridge 20 is fast, as shown in the following formula (6), the actual pressure PH inside the nozzles 541 becomes the pressure to be greater by value α from the meniscus pressure PBf of the container-side-filter 273.

$$PH=PBf+\alpha \quad (6)$$

As described above, the value α represents the total value of the difference between the dynamic meniscus pressure and the static meniscus pressure of the nozzles 541, the pressure loss inside nozzles 541 generated when the cartridge 20 is detached, and the pressure reduction value due to the mechanical compliance of the inside of the nozzles 541 generated when the cartridge 20 is detached. The value α can be calculated by an actual simulation. In general, the dynamic meniscus pressure is greater than the static meniscus pressure.

With this, when the actual pressure PH inside the nozzles 541 in the case in which the detachment speed of the cartridge 20 is fast represents as the aforementioned formula (6), the following formula (7) is obtained by substituting this formula (6) into the aforementioned formula (5) indicating the condition in which the meniscus of the nozzles 541 is not broken. And, the aforementioned formula (4) is come up by transposing a in the left member of the following formula (7) to the right member, and therefore, the meniscus pressure PBf of the container-side-filter 273 employed in the present embodiment is calculated.

$$PBf+\alpha<PBn \quad (7)$$

According to the Third embodiment described above, by making the meniscus pressure PBf of the container-side-filter 273 smaller than the pressure by subtracting the value α from the meniscus pressure PBn of the nozzles 541, regardless the detachment speed of the cartridge 20, the meniscus of the container-side-filter 273 is broken easier than the meniscus of the nozzles 541. Therefore, even though the detachment speed of the cartridge 20 is different depending on the user, the breakage of the meniscus of the nozzles 541 can be suppressed. As a result, when the cartridge 20 is replaced, the aforementioned replacement cleaning process is not required, so that it becomes possible to promptly perform the printing, and further, the ink consumption, which is used for the purpose other than the printing, by the execution of the replacement cleaning process can be suppressed. The condition of the meniscus pressure PBf of the container-side-filter 273 described in the present embodiment can be combined with the condition of the meniscus pressure PBf of the container-side-filter 273 described in the second embodiment.

D. Fourth Embodiment

Figure 16:
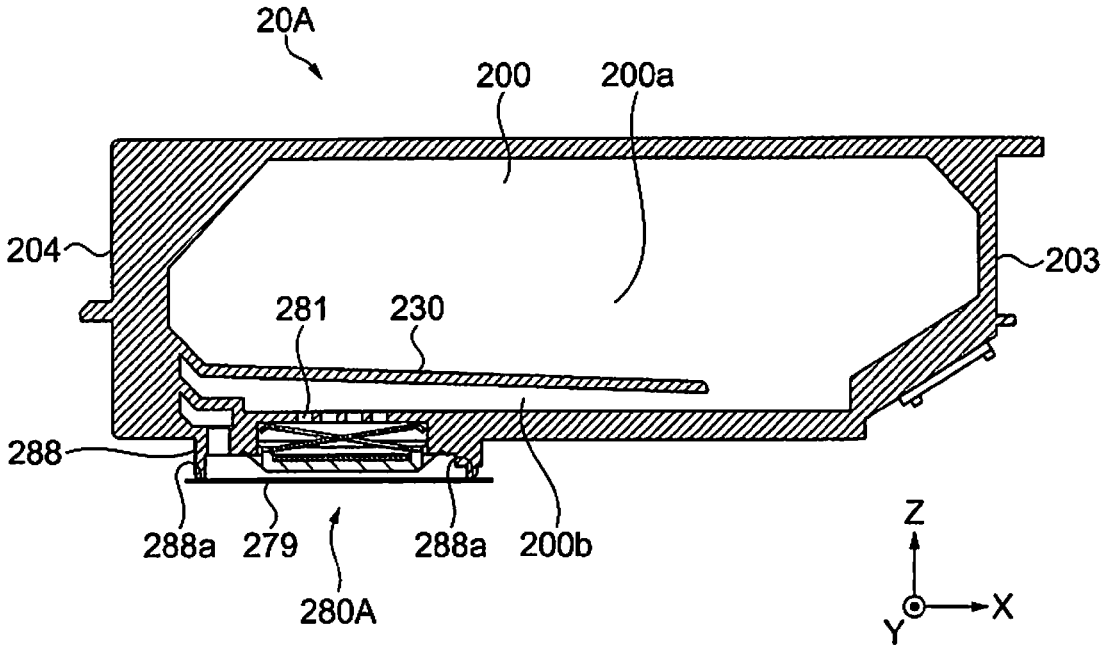
FIG. 16 is a diagram showing a ZX cross-sectional surface of a cartridge according to the fourth embodiment.
Figure 18:
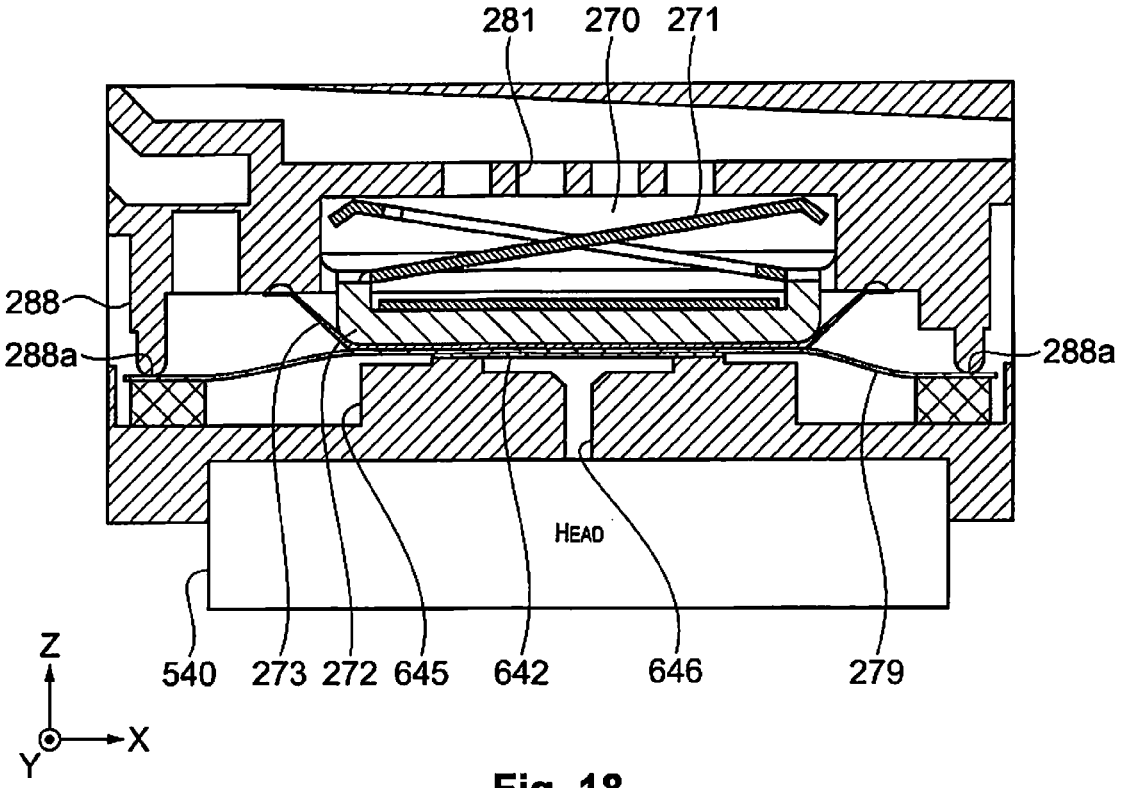
FIG. 18 is a ZX cross-sectional view showing a state in which the liquid supply part contacts with the liquid introduction part.

In the fourth embodiment of the present invention, in addition to the aforementioned 1st embodiment, the second container-side-filter 279 is employed. The fourth embodiment is the same as the first embodiment except that the second container-side-filter 279 is employed. In FIG. 16 and FIG. 18, for the same structural parts of the first embodiment, the same symbols as used in the description of the first embodiment are allotted, and the detailed descriptions are omitted.

Figure 17:
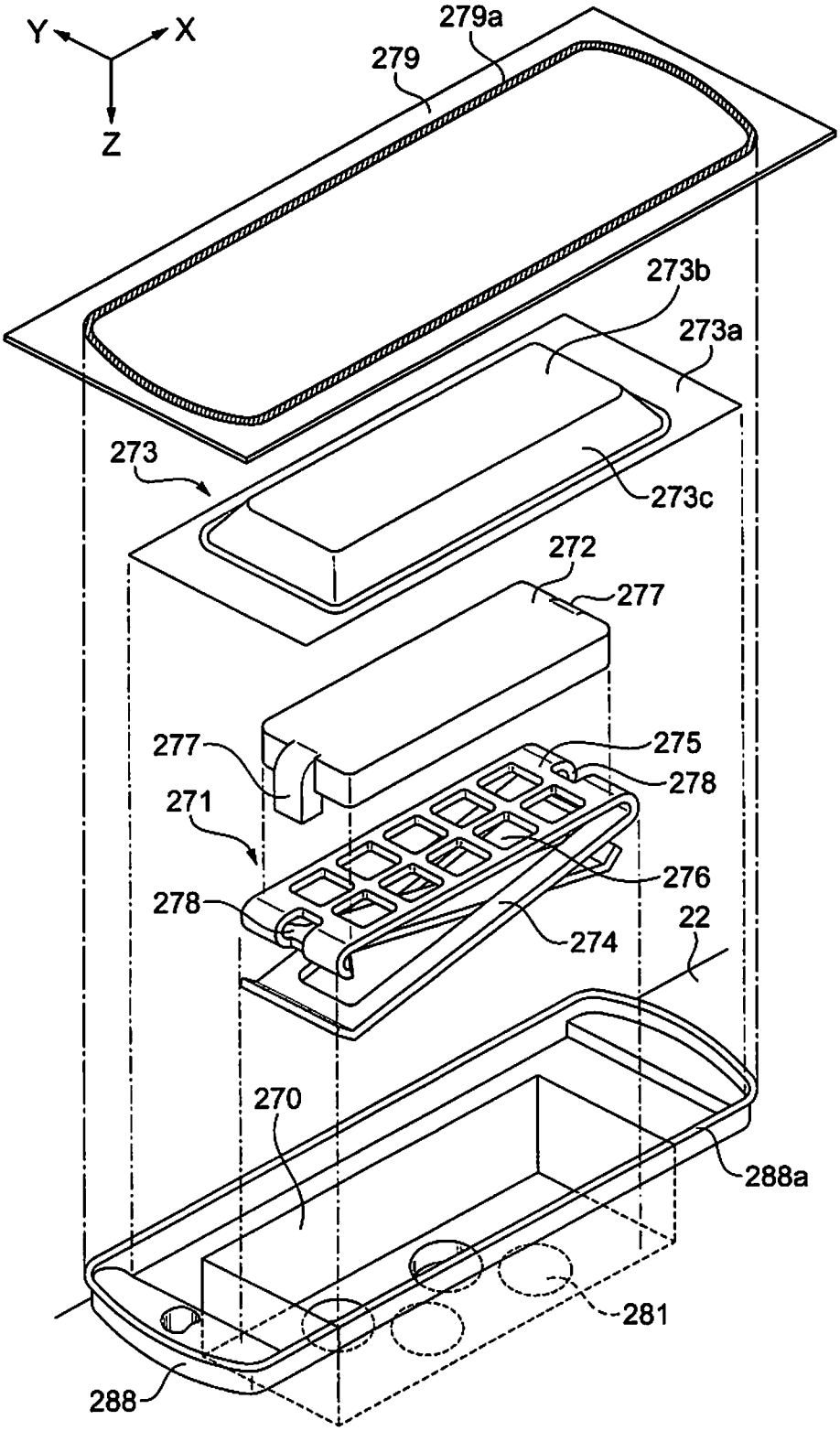
FIG. 17 is an exploded perspective view of a liquid supply part.

FIG. 16 is a diagram showing a ZX cross-sectional surface of a cartridge 20A of the fourth embodiment. FIG. 17 is an exploded perspective view of the liquid supply part 280A. FIG. 18 is the ZX cross-sectional view showing a state in which the liquid supply part 280A contacts the liquid introduction part 640.

As shown in these drawings, in the same manner as the cartridge of the first embodiment, the liquid supply part 280 of the cartridge 20A of the fourth embodiment is provided with a plate spring 271, a foam 272 as a flow channel formation member, and a container-side-filter 273 as a porous member in container side. The plate spring 271, the foam 272 and the container-side-filter 273 are arranged in the recessed part 270 provided on the bottom surface 201 of the case 22. That is, the plate spring 271, the foam 272, and the container-side-filter 273 are provided inside the container-side-cylindrical-body 288 configuring the liquid supply part 280. In addition, the liquid supply part 280 of the cartridge 20A of the fourth embodiment is provided with the second container-side-filter 279 as the porous member in container side. The second container-side-filter 279 is provided in the top end (end part in the −Z-axis direction) of the liquid supply part 280. That is, the second container-side-filter 279 is provided in the outside of the container-side-cylindrical-body 288. The second container-side-filter 279 is provided to cover the opening of the top end (end part in the −Z-axis direction) of the liquid supply part 280. The area of the second container-side-filter 279 is greater than the area of the opening of the top end (end part in the −Z-axis direction) of the liquid supply part 280. The second container-side-filter 279 is fixed on the top end of the liquid supply part 280, that is, top end 288*a* (end part in the −Z-axis direction) of the container-side-cylindrical-body 288, by heat welding. FIG. 17 shows the welding part 279*a* between the second container-side-filter 279 and the top end 288*a* of the container-side-cylindrical-body 288 in slanting line.

As shown in FIG. 18, in a state in which the cartridge 20A is mounted on the holder 60, the device-side-filter 642 provided in the holder 60 contacts with the central part of the second container-side-filter 279. The central part 273*b* of the container-side-filter 273 contacts with the device-side-filter 642 via the second container-side-filter 279. At this point, the central part of the second container-side-filter 279 is pulled upwardly (+Z-axis direction) by the device-side-cylindrical-body 645. The second container-side-filter 279 is the planar shaped filter. However, in order to prevent the breakage from pulling by the device-side-cylindrical-body 645, it is fixed in the top end 288*a* of the container-side-cylindrical-body 288 in a state in which the central part is capable of being slightly deformed. As a material of the second container-side-filter 279, the same material of the container-side-filter 273 can be employed.

In the first embodiment, the container-side-filter 273 is a porous member and is provided in the outermost of the liquid supply part 280. It is configured in the manner in which the capillary force of the container-side-filter 273 is higher than the capillary force of the foam 272, or the capillary force in the outside (side of the device-side-filter 642) of the container-side-filter 273 is higher than the capillary force in the inside (foam 272 side). In the fourth embodiment, physically, the second container-side-filter 279 is a porous member and is provided in the outermost surface of the liquid supply part 280. Therefore, it is configured in the manner in which the capillary force of the second container-side-filter 279 is higher than the capillary force of the foam 272 and the container-side-filter 273, or the capillary force in the outside (side of the device-side-filter 642) of the second container-side-filter 279 is higher than the capillary force in the inside (side of the container-side-filter 273), so that when the cartridge 20 is mounted on the holder 60, the liquid can be smoothly supplied to the print head 540.

On the other hand, in the fourth embodiment, the capillary force of the second container-side-filter 279 is set lower than the capillary force of the container-side-filter 273 in a level that can ignore the liquid flow channel resistance, and in this case, the porous member provided in the outermost surface of the actual liquid supply part 280 can be deemed as the container-side-filter 273. In this case, the properties of the container-side-filter 273 are set in the same manner as the first embodiment, so that the liquid can be smoothly supplied to the print head 540.

In addition, in the fourth embodiment, in a state in which both of the two container-side-filters 273, 279 contact to each other, in order to obtain the same properties in the same manner as the container-side-filter 273 of the first embodiment, the properties of these container-side-filters 273, 279 can be set.

The concept of the property of the capillary force described above can be applied in the same manner related to the property of the bubble point pressure.

Further, the concept of the property of the capillary force described above can be applied in the same manner related to the property of the meniscus pressure PBf of the second embodiment and the Third embodiment. That is, in a case in which the second container-side-filter 279 actually becomes the porous member provided in the outermost surface of the liquid supply part 280, by setting the meniscus pressure PBf of the second container-side-filter 279 as the second embodiment and the Third embodiment, the same effects as the second embodiment and the Third embodiment can be obtained. Further, in the case in which the flow channel resistance of the second container-side-filter 279 can be ignored, by setting the meniscus pressure PBf of the container-side-filter 273 as the second embodiment and the Third embodiment, the same effects as the second embodiment and the Third embodiment can be obtained. In addition, in a state in which the container-side-filters 273, 279 contact to each other, when the same properties as the container-side-filter 273 of the first embodiment are obtained, by setting the meniscus pressure PBf in the state of contacting these filters as the second embodiment and the Third embodiment, the same effects as the second embodiment and the Third embodiment can be obtained.

According to the cartridge 20A of the fourth embodiment, the second container-side-filter 279 is provided downstream farther than the container-side-filter 273. In a state in which the cartridge 20A is mounted on the holder 60, the container-side-filter 273 contacts with the device-side-filter 642 via the second container-side-filter 279. That is, the filter that contacts with the device-side-filter 642 is configured by a double structure, so that the structure of the liquid supply part 280 can be reinforced. Specifically, even when the attachment and detachment of the cartridge 20A are repeated, the filters 273, 279 are hard to be broken or damaged, and the cartridge 20A can be continuously used for a long term. More specifically, the container-side-filter 273 does not contact with the device-side-filter 642 directly, and therefore, it is hard to be broken or damaged.

Further, according to the cartridge 20A of the fourth embodiment, the second container-side-filter 279 is fixed in the top end 288*a* (end part of the −Z-axis direction) of the container-side-cylindrical-body 288 configuring the liquid supply part 280. Therefore, for example, even when the second container-side-filter 279 is broken or damaged, it is possible to easily replace it to a new filter. Thus, the cartridge 20A can be continuously used for a long term.

E. Fifth Embodiment

Figure 19:
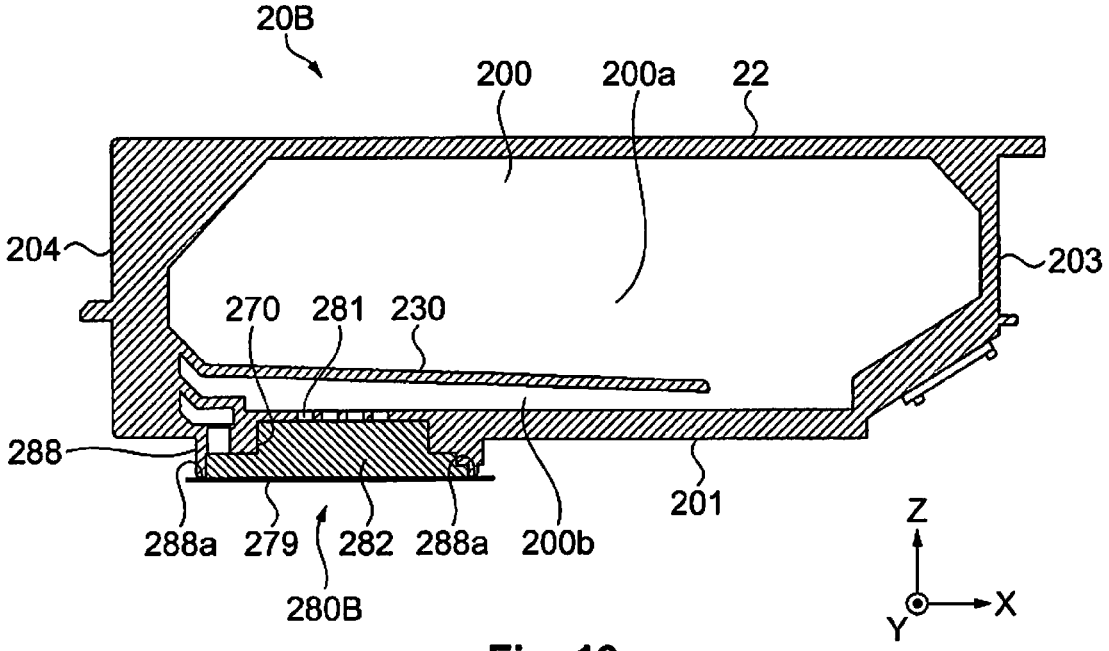
FIG. 19 is a diagram showing a ZX cross-sectional surface of a cartridge according to the fifth embodiment.

In the fifth embodiment of the present invention, in addition to the plate spring 271, the foam 272, and the container-side-filter 273 of the configuration of the aforementioned $4^{th}$ embodiment, a foam 282 is employed as a flow channel formation member. Except this point, the fifth embodiment is the same structure as the fourth embodiment. In FIG. 19, for the same structural parts of the fourth embodiment, the same symbols as used in the description of the fourth embodiment are allotted, and the detailed descriptions are omitted.

FIG. 19 is a diagram showing a ZX cross-sectional surface of a cartridge 20B of the fifth embodiment. As shown in FIG. 19, in addition to the plate spring 271, the foam 272, and the container-side-filter 273 of the cartridge 20A of the fourth embodiment, the liquid supply part 280 of the cartridge 20B of the fifth embodiment is provided with the foam 282 as a flow channel formation member. Further, the liquid supply part 280B of the cartridge 20B of the fifth embodiment is provided with the container-side-filter 279 as a porous member in container side in the same manner as the cartridge 20A of the fourth embodiment. The foam 282 is arranged in the recessed part 270 provided on the bottom surface 201 of the case 22. The foam 282 is provided to fill the space inside the container-side-cylindrical-body 288. The foam 282 is provided between the communication opening 281 provided on the bottom surface 201 of the liquid storage part 200 and the container-side-filter 279. The foam 282 is the porous member. The foam 272 supplies the liquid, which is supplied from the inside of the liquid storage part 200 via the communication opening 281 provided on the bottom surface 201 of the liquid storage part 200, to the container-side-filter 279. As the flow channel formation member, any material may be used as long as the liquid is supplied to the container-side-filter 279, and in addition to the foam 282, a liquid holding body such as a felt, a woven fabric, etc. can be employed. For the structure and the material of the container-side-filter 279, it has been already described in the fourth embodiment. Further, the foam 282 is provided in any configuration as long as the liquid supplied from the inside of the liquid storage part 200 can be supplied to the container-side-filter 279, so that it may not be filled in the entire space of the inside of the container-side-cylindrical-body 288. The foam 282 may be provided in a part of the space of the inside of the container-side-cylindrical-body 288. It is possible to smoothly supply the liquid to the container-side-filter 279 as long as the foam 282 is provided in the manner in which at least, the communication openings 281 and the container-side-filter 279 are connected by the foam 282.

In the present embodiment, the porous member is provided in the outermost surface of the liquid supply part 280. Thus, for the capillary force or the bubble point pressure, the property of the container-side-filter 279 may be set in the same manner as the container-side-filter 273 of the first embodiment. Further, for the meniscus pressure PBf of the second embodiment and the Third embodiment, a biasing force F applying from the biasing member 274 to the container-side-filter 273 can be applied by replacing to the biasing force F applying from the foam 282 to the container-side-filter 279. That is, in a state in which the biasing force F is replaced to the biasing force F applying from the foam 282 to the container-side-filter 279, the same effects of the second embodiment and the Third embodiment can be obtained by setting the meniscus pressure PBf of the container-side-filter 279 in the same manner as the setting in the second embodiment and the Third embodiment.

According to the cartridge 20B of the fifth embodiment, since the liquid supply part 280 includes the flow channel formation member (foam 282) provided in the space inside the container-side-cylindrical-body 288 and the porous member in container side provided in the top end 288*a* (end part of the −Z-axis direction) of the container-side-cylindrical-body 288, the structure of the cartridge 20B can be simplified.

Further, according to the cartridge 20B of the fifth embodiment, the container-side-filter 279 is fixed in the top end 288*a* (end part of the −Z-axis direction) of the container-side-cylindrical-body 288. Therefore, for example, even when the container-side-filter 279 is broken or damaged, it can be easily replaced to a new filter. Therefore, the cartridge 20B can be continuously used for a long term.

F. Sixth Embodiment

A cartridge 20F according to the sixth embodiment will be described. According to the sixth embodiment, for the same structure of the first embodiment, the same symbols of the first embodiment are allotted and the detailed descriptions are omitted.

Figure 20:
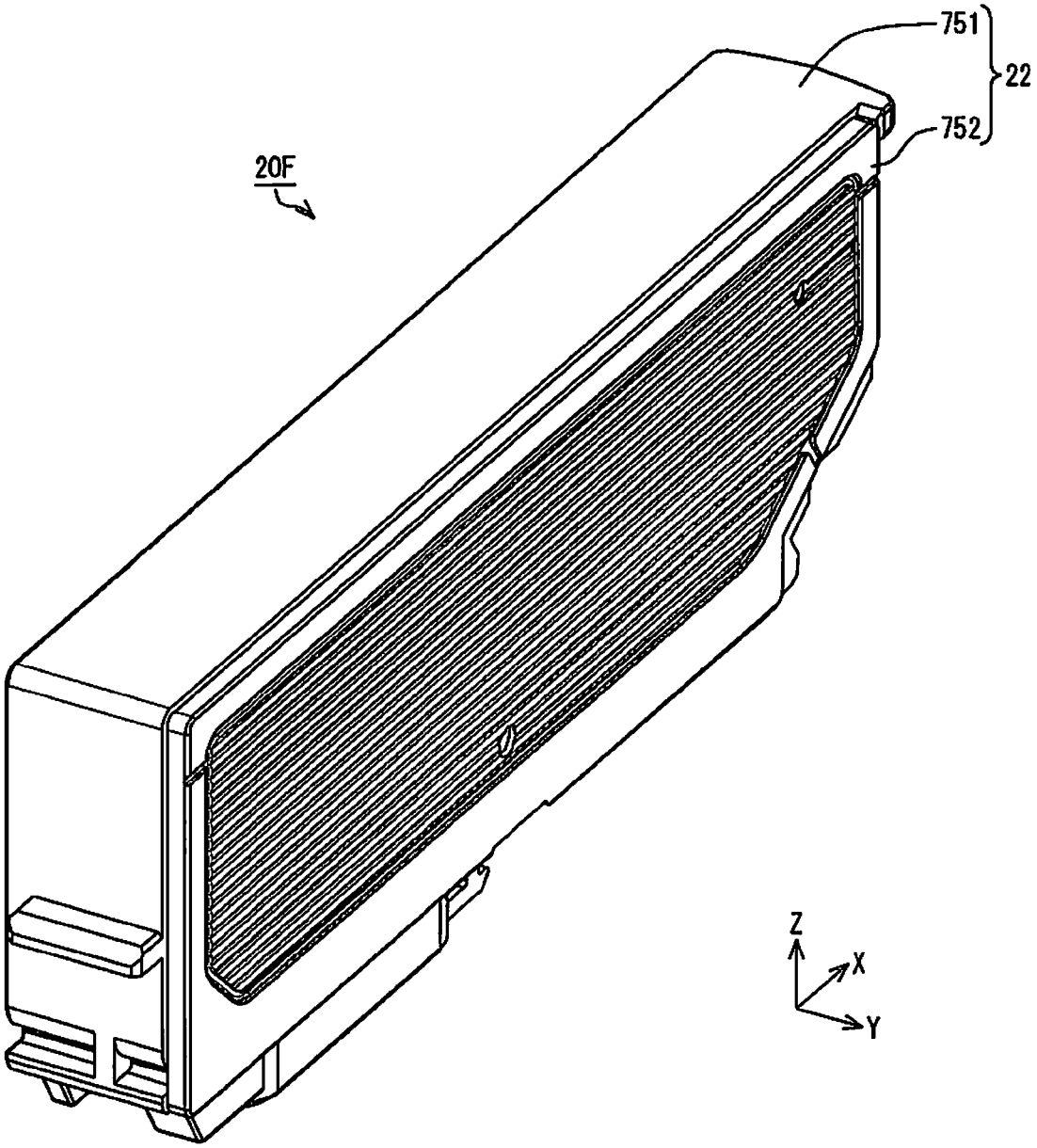
FIG. 20 is a perspective view showing a cartridge according to the sixth embodiment.
Figure 21:
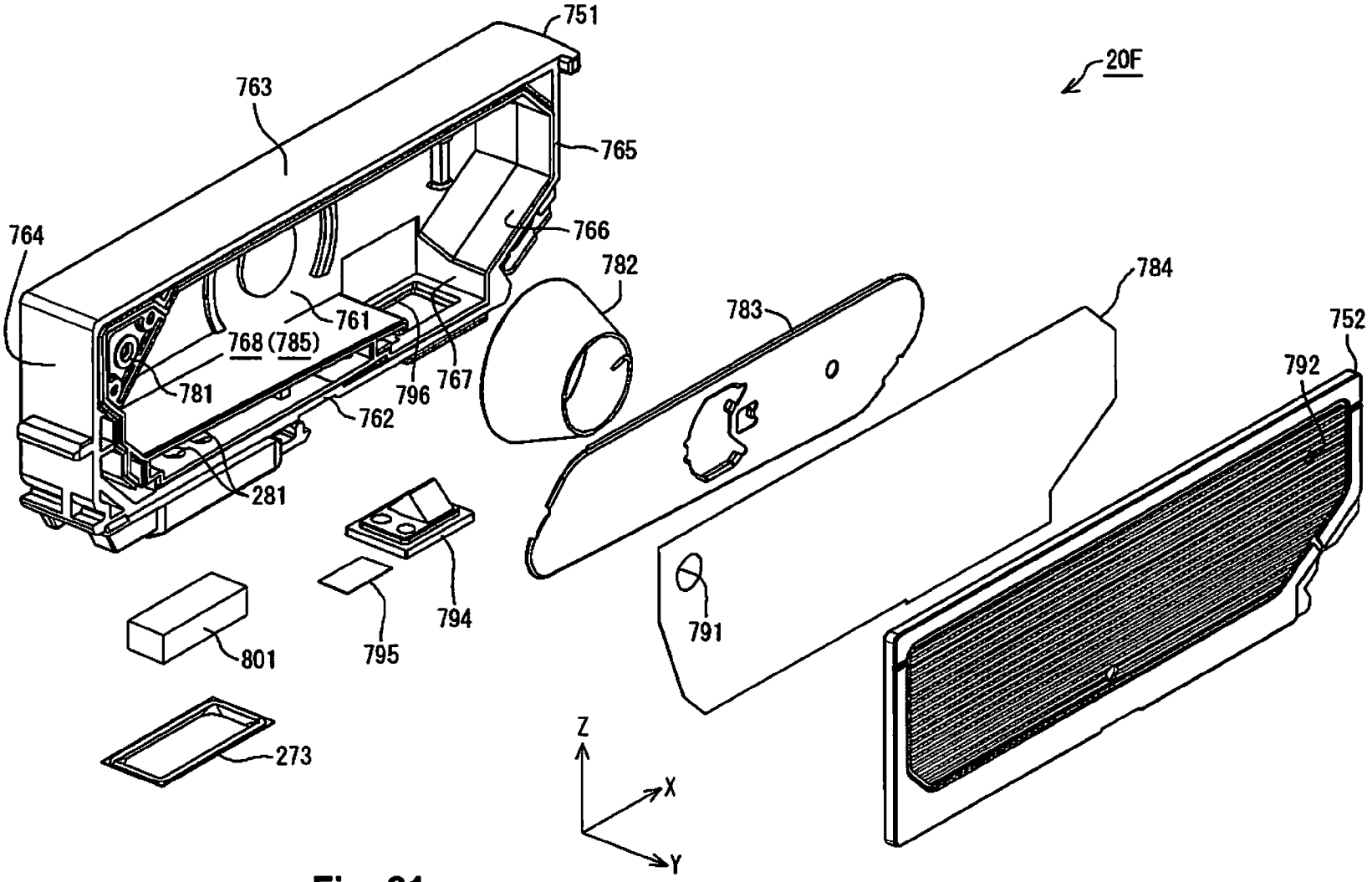
FIG. 21 is a perspective view showing a configuration of a cartridge according to the sixth embodiment.

In the cartridge 20F, as shown in FIG. 20, the case 22 includes the first case 751 and the second case 752. In the present embodiment, the outer shell of the cartridge 20F is configured by the first case 751 and the second case 752. As shown in FIG. 21, the first case 751 includes the first wall 761, the second wall 762, the third wall 763, the fourth wall 764, the fifth wall 765, the sixth wall 766, and the seventh wall 767. The second wall 762 to the seventh wall 767 are respectively intersected with the first wall. The second wall 762 to the seventh wall 767 are projected in a direction from the first wall 761 to the +Y-axis direction side, that is, a direction from the first wall 761 to the second case 752 side.

The second wall 762 and the third wall 763 are positioned to stand face to face to each other through the first wall 761 in the Z-axis direction. The fourth wall 764 and the fifth wall 765 are positioned to stand face to face to each other through the first wall 761 in the X-axis direction. The fourth wall 764 and the fifth wall 765 are respectively intersected to the third wall 763. Further, the fourth wall 764 is intersected to the second wall 762 in the opposite side from the third wall 763 side.

The sixth wall 766 is intersected with the fifth wall 765 in the second wall 762 side of the fifth wall 765 in the Z-axis direction, that is, in the opposite side from the third wall 763 side of the fifth wall 765. The seventh wall 767 is intersected with the sixth wall 766 in the opposite side from the fifth wall 765 side of the sixth wall 766. Further, the seventh wall 767 is intersected with the second wall 762 in the opposite side from the fourth wall 764 side of the second wall 762. The sixth wall 766 is inclined with respect to each of the fifth wall 765 and the second wall 762. The sixth wall 766 is inclined in a direction closer to the fourth wall 764 as approaching from the third wall 763 side to the second wall 762 side.

According to the aforementioned structure, the first wall 761 is surrounded by the second wall 762 to the seventh wall 767. The second wall 762 to the seventh wall 767 are projected in a direction from the first wall 761 to the +Y-axis direction. Therefore, the first case 751 is configured in a recessed shape by the second wall 762 to the seventh wall 767 and by forming the first wall 761 as a bottom. The recessed part 768 is configured by the first wall 761 to the seventh wall 767. The recessed part 768 is provided to be recessed in the −Y-axis direction. The recessed part 768 opens in the +Y-axis direction, that is, a direction of the second case 752 side. The recessed part 765 is covered by the sheet member 784 which will be described later. The ink is stored inside the recessed part 768 covered by the sheet member 784. Therefore, the recessed part 768 functions as the storage section of the ink. Hereinafter, the surface of the inside of the recessed part 768 is sometimes indicated as an inner surface 769.

Figure 22:
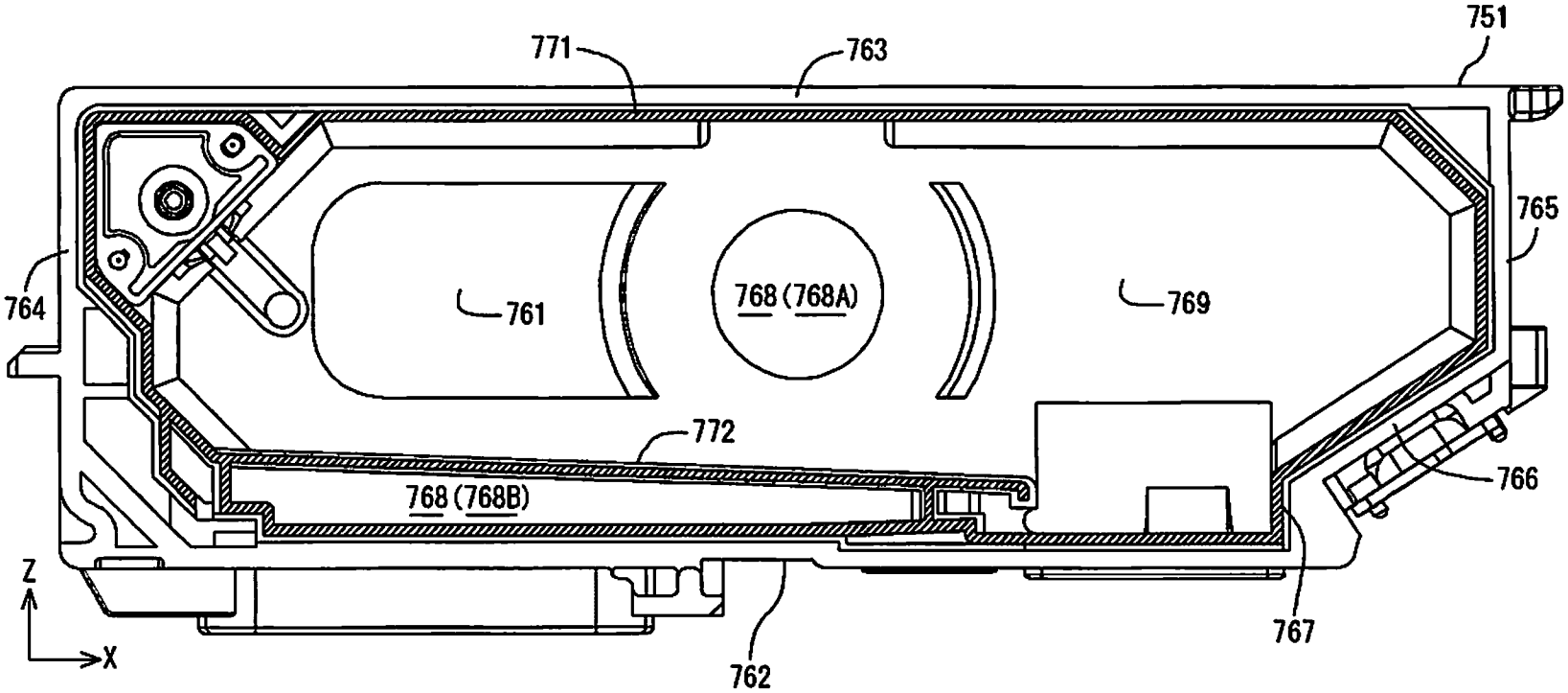
FIG. 22 is a plan view showing the first case according to the sixth embodiment.

As shown in FIG. 22, in the first case 751, a welding part 771 along the outline of the recessed part 768 is provided. The welding part 771 is provided along the second wall 762 to the seventh wall 767, and the sheet member 784 is the part to be welded. Further, in the first case 751, a partition wall 772 that partitions the recessed part 768 into the first recessed part 768A and the second recessed part 768B. The welding part 771 is also provided in the partition wall 772. In FIG. 22, in order to simplify the configuration, a hatching is provided to the welding part 771. A region surrounded by the third wall 763, the fifth wall 765, the seventh wall 767, a part of the second wall 762, a partition wall 772, and a part of the fourth wall 764 within the recessed part 768 is defined as the first recessed part 768A. Further, a region surrounded by another part of the second wall 762, the partition wall 772, and another part of the fourth wall 764 within the recessed part 768, that is, the region except the region from the recessed part 768 to the first recessed part 768A, is defined as the second recessed part 768B.

Figure 23A:
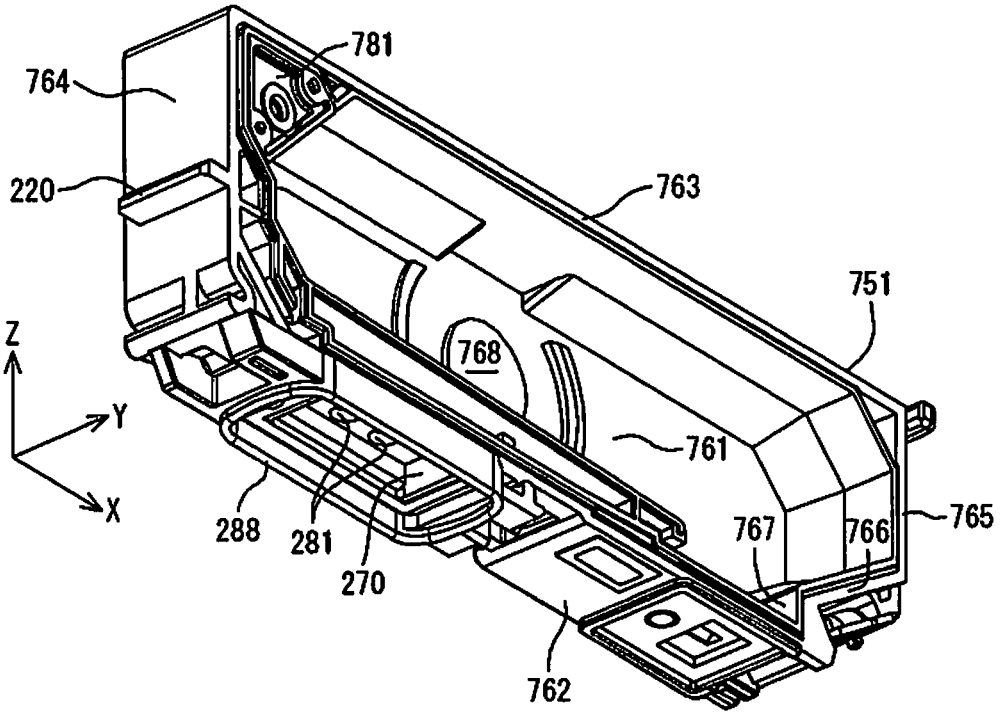
FIGS. 23A and 23B are perspective views showing the first case according to the sixth embodiment.

Further, as shown in FIG. 21, in the second wall 762, the communication openings 281 penetrating through between the inside of the recessed part 768 and the outside of the first case 751 is provided. The ink stored in the recessed part 768 is discharged to the outside of the cartridge 20F from the communication opening 281. Further, as shown in FIG. 23A, in the opposite side from the recessed part 768 side of the second wall 762, that is, the outside of the second wall 762, the container-side-cylindrical-body 288 surrounding the communication opening 281 is provided. The container-side-cylindrical-body 288 projects from the second wall 762 in a direction of the opposite side (−Z-axis direction side) of the third wall 763 side. The container-side-cylindrical-body 288 surrounds the communication openings 281 from the outside.

Figure 23B:
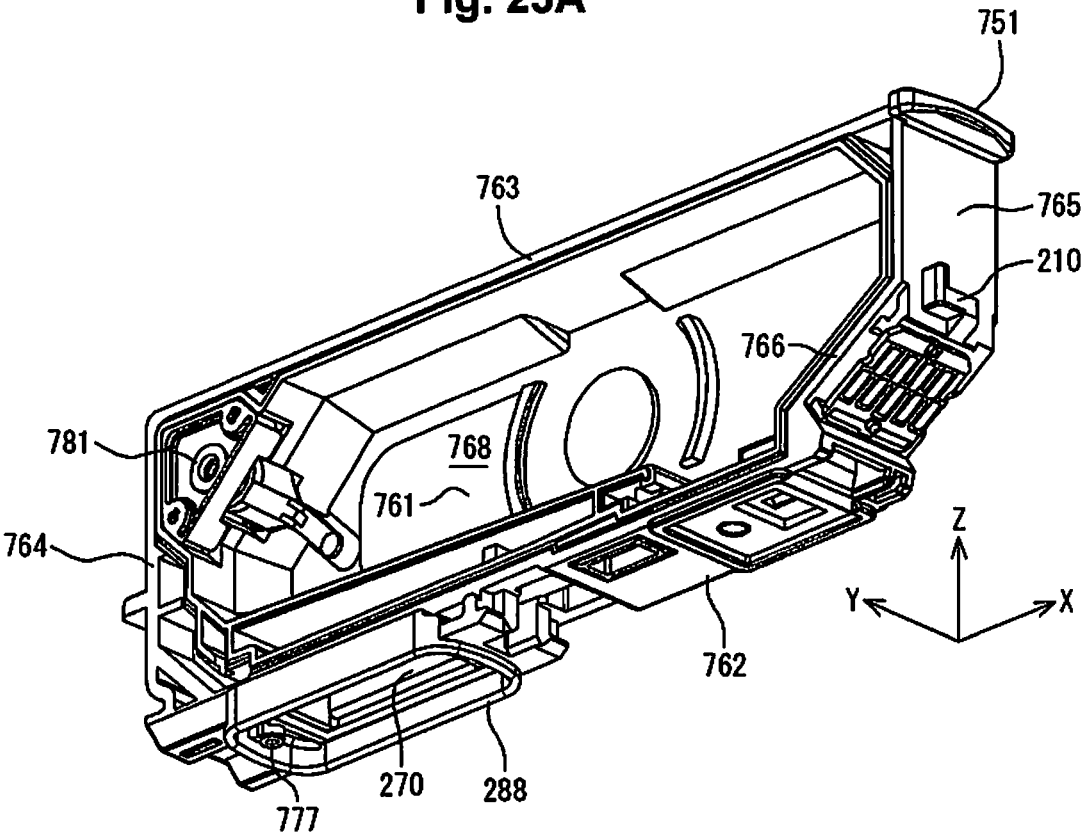

In the fourth wall 764, the second projecting part 220 is provided. The second projecting part 220 projects from the fourth wall 764 in a direction of the opposite side (+X-axis direction side) of the fifth wall 765 side. The second projecting part 220 is positioned between the second wall 762 and the third wall 763 in the Z-axis direction. The second projecting part 220 is fitted in the recessed part 620 as shown in FIG. 2 in a state in which the cartridge 20F is mounted on the holder 60. Further, as shown in FIG. 23B, the first projecting part 210 is provided in the fifth wall 765. The first projecting part 210 projects from the fifth wall 765 in a direction of the opposite side (+X-axis direction side) of the fourth wall 764 side. The first projecting part 210 is locked by the lever 80 shown in FIG. 2 in a state in which the cartridge 20F is mounted on the holder 60. With this, the cartridge 20F is fixed on the holder 60. In the second wall 762, a communication hole 777 is provided within the region surrounded by the container-side-cylindrical-body 288 and the region outside the communication opening 281. The communication hole 777 penetrates between the inside of the recessed part 768 and the outside of the first case 751.

Further, as shown in FIG. 21, the cartridge 20F includes a valve unit 781, a coil spring 782, a pressure receiving plate 783, and a sheet member 784. The sheet member 784 has flexibility and is formed by a synthetic resin (e.g., nylon, polypropylene, etc.). The sheet member 784 is provided in the first case 751 side of the second case 752. The sheet member 784 is bonded to the welding part 771 of the first case 751. In the present embodiment, the sheet member 784 is bonded to the welding part 771 by welding. With this, the recessed part 768 of the first case 751 is closed by the sheet member 784. A region surrounded by the recessed part 768 and the sheet member 784 is called as the liquid storage part 785. The ink is stored in the recessed part 768 closed by the sheet member 784, that is, the inside of the liquid storage part 785. Therefore, in the present embodiment, the sheet member 784 configures a part of the wall of the liquid storage part 785.

As shown in FIG. 22, as described above, in the first case 751, the recessed part 768 is partitioned into the first recessed part 768A and the second recessed part 768B by the partition wall 772. Therefore, when the sheet member 784 is bonded to the welding part 771, the liquid storage part 785 is partitioned into the first liquid storage part 785A and the second liquid storage part 785B. The first liquid storage part 785A corresponds to the first recessed part 768A. The second liquid storage part 785B corresponds to the second recessed part 768B. As described above, the sheet member 784 has flexibility. Therefore, the volume of the first liquid storage part 785A can be changed. The sheet member 784 is bonded to the first case 751 in a state in which it is pressed and stretched along the inner surface 769 of the recessed part 768 in advance so as to easily follow the change of the volume of the first liquid storage part 785A.

As shown in FIG. 21, the coil spring 782 is provided in the first case 751 side of the sheet member 784, and is stored in the recessed part 768. The coil spring 782 is wound in a cylindrical shape. In FIG. 21, the coil spring 782 is simplified. A pressure receiving plate 783 is provided to the sheet member 784 side of the coil spring 782. That is, the pressure receiving plate 783 is existed between the coil spring 782 and the sheet member 784. The lower bottom part of the coil spring 782 abuts to the first wall 761. The upper bottom part of the coil spring 782 abuts to the surface of the opposite side from the surface of the sheet member 784 side of the pressure receiving plate 783. Further, the upper bottom part of the coil spring 782 abuts to approximately central part of the pressure receiving plate 783. The pressure receiving plate 783 is formed by metals such as synthetic resin or stainless of polypropylene, etc.

The coil spring 782 biases the pressure receiving plate 783 in the direction of the sheet member 784 side. In other words, the coil spring 782 biases the pressure receiving plate 783 in the +Y-axis direction. That is, the coil spring 782 biases the pressure receiving plate 783 in a direction in which the volume of the liquid storage part 785 expands. The second case 752 is provided in the opposite side from the pressure receiving plate 783 side of the sheet member 784. The second case 752 is fitted to the first case 751 to cover the sheet member 784. With this, the sheet member 784 is protected from the outside.

A valve unit 781 is provided inside the recessed part 768. The sheet member 784 covers the recessed part 768 in each of the valve unit 781. In the part overlapping to the valve unit 781 of the sheet member 784, an air hole 791 is formed. The air hole 791 is closed by the valve unit 781. Further, in the second case 752, an atmosphere communication hole 792 is provided. The space between the sheet member 784 and the second case 752 communicates to the outside of the cartridge 20F via the atmosphere communication hole 792. Therefore, the air is existed in the space between the sheet member 784 and the second case 752.

A space between the sheet member 783 and the second case 752 is called as an atmospheric chamber 793. The atmosphere communication hole 792 communicates to the atmospheric chamber 793. In the present embodiment, the communication hole 777 communicates to the atmospheric chamber 793. That is, the space surrounded by the container-side-cylindrical-body 288 communicates to the atmosphere communication hole 792 from the communication hole 777 via the atmospheric chamber 793.

When the ink in the liquid storage part 785 is reduced, the valve unit 781 becomes an open state, so that the air hole 791 is opened. Therefore, the air outside the cartridge 20F may be flowed to the inside of the liquid storage part 785 through the atmosphere communication hole 792, the atmospheric chamber 793, and the air hole 791. By flowing the air into the liquid storage part 785, when the pressure reduction of the liquid storage part 785 is reduced, the valve unit 781 becomes a close state. Therefore, the air hole 791 is closed by the valve unit 781. With such operation, the pressure of the liquid storage part 785 may maintain in an appropriate pressure range for appropriately supplying the ink to the print head 540.

Figure 24:
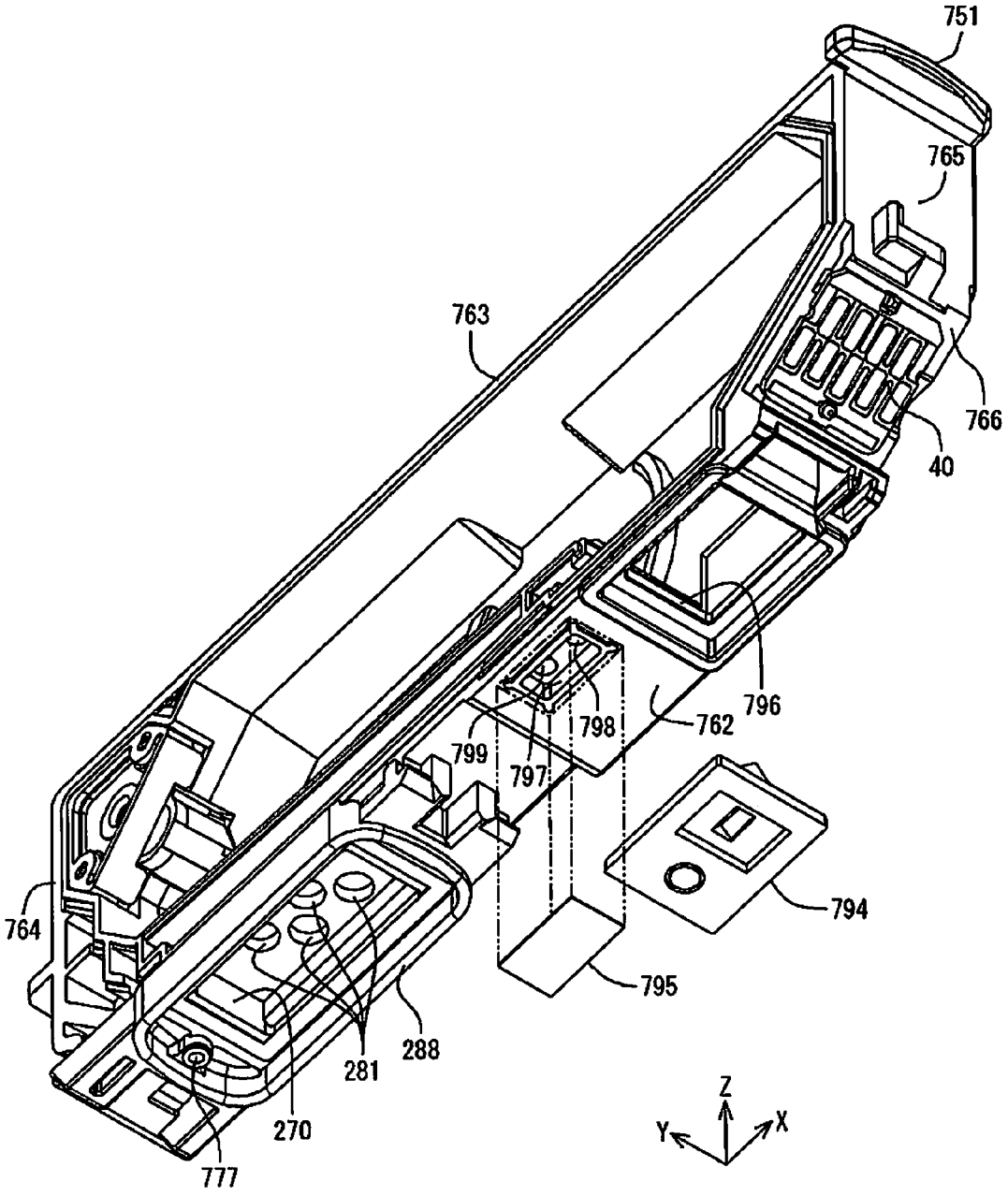
FIG. 24 is a perspective view showing the first case according to the sixth embodiment.
Figure 25:
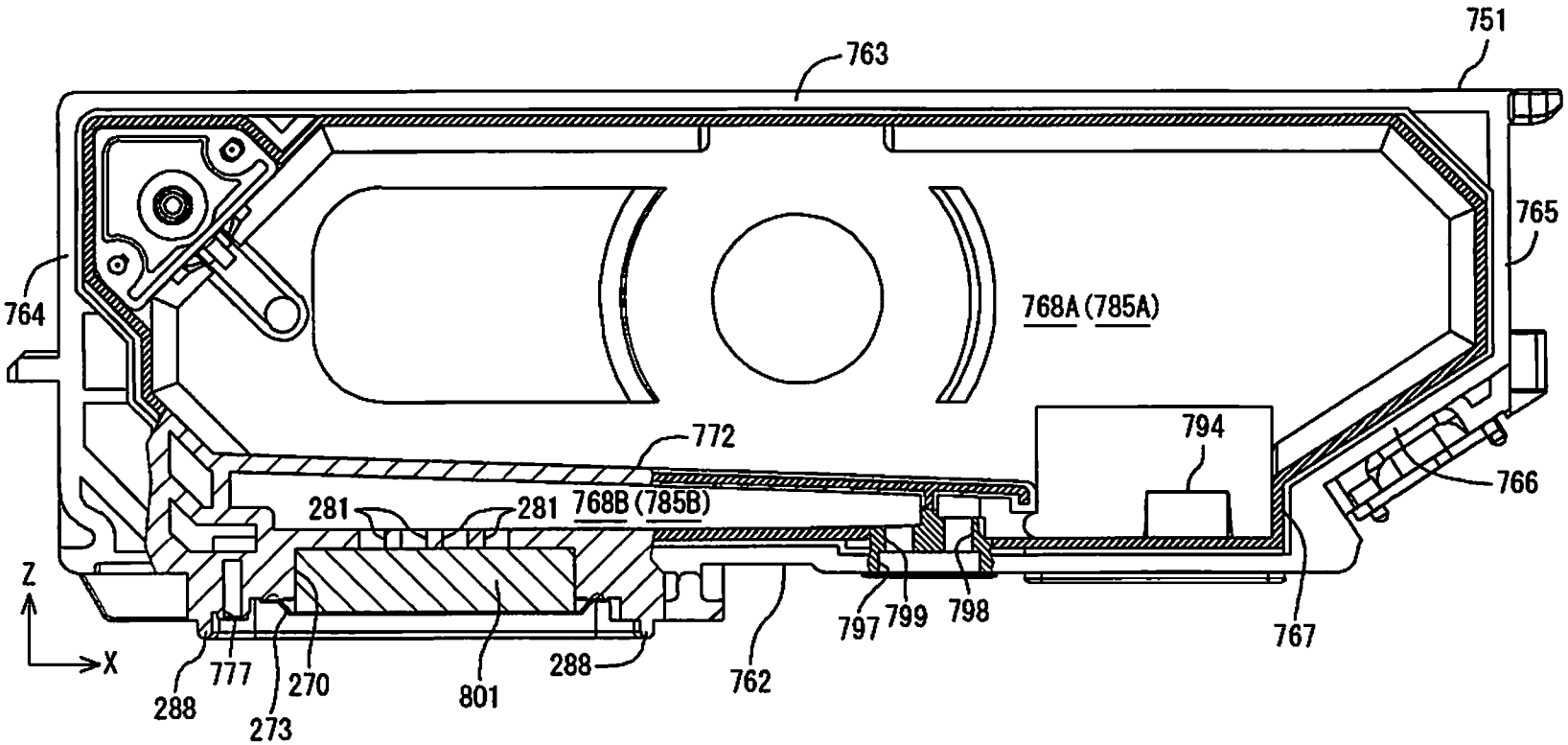
FIG. 25 is an explanatory diagram showing a configuration of the inside of the first case according to the sixth embodiment.

Further, as shown in FIG. 21, the cartridge 20F includes a prism 794 and a sheet member 795. Here, as shown in FIG. 24, in the second wall 762 of the first case 751, an opening part 796 is provided. The inside of the first case 751 and the outside of the first case 751 are communicated via the opening part 796. The prism 794 is provided in a position overlapping the opening part 796 and has a size to cover the opening part 796. The opening part 796 is closed from the outside of the first case 751 by the prism 794. As shown in FIG. 25, the prism 794 projects to the inside of the first case 751 from the outside of the first case 751 via the opening part 796. In the present embodiment, the opening part 796 is closed by the prism 794, so that the leakage of the ink inside the liquid storage part 785 from the opening part 796 is suppressed. Thus, the prism 794 is configured as a part of the inner surface 769 of the liquid storage part 785. Therefore, the prism 794 is deemed as a part of the first case 751.

The prism 794 functions as a liquid detection section to optically detect whether or not the ink is existed. The prism 794 is a material having light permeability and being formed by, for example, synthetic resin of polypropylene, etc. The material configuring the prism 794 may be any material as long as it has appropriate light permeability so that it does not have to be transparent. For example, whether or not the ink is existed inside the liquid storage part 785 is detected as follows. An optical sensor provided with a light emitting element and a light receiving element is provided in the printer 50. The light is emitted from light emitting element to the prism 794. When the ink is existed in the peripheral of the prism 794, the light passes through the prism 794, and is directed to the inside of the liquid storage part 785. On the other hand, when the ink is not existed in the peripheral of the prism 794, the light emitted from the light emitting element is reflected by the two reflection surfaces of the prism 794 so as to reach the light receiving element. Based on whether or not the light reaches to the light receiving element, the printer 50 determines whether or not the ink is existed inside the liquid storage part 785. The existence or non-existence of the ink is determined by the control unit 510.

Further, as shown in FIG. 24, in the second wall 762 of the first case 751, a recessed part 797 being recessed in a direction from the outside of the second wall 762 to the inside of the recessed part 768 is provided between the opening part 796 and the communication opening 281 in the X-axis direction. A communication hole 798 communicating to the inside of the recessed part 768 from the inside of the recessed part 797, and a communication hole 799 are provided in the second wall 762 inside the recessed part 797. The sheet member 795 is provided in a position overlapping to the recessed part 797 and has a size to cover the recessed part 797. The recessed part 797 is closed from the outside of the first case 751 by the sheet member 795. In the present embodiment, since the recessed part 797 is closed by the sheet member 795, the leakage of the ink inside the liquid storage part 785 from the recessed part 797 is suppressed. Thus, the sheet member 795 is deemed to configure a part of the inner surface 769 of the liquid storage part 785. Therefore, the sheet member 795 is deemed as a part of the first case 751.

As shown in FIG. 25, a communication hole 798 communicates from the first recessed part 768A to the inside of the recessed part 797. The communication hole 799 communicates from the inside of the recessed part 797 to the inside of the second recessed part 768B. That is, the first recessed part 768A and the second recessed part 768B communicate to each other via the communication hole 798, the recessed part 797, and the communication hole 799. Therefore, the first liquid storage part 785A and the second liquid storage part 785B communicate to each other via the communication hole 798, the recessed part 797, and the communication hole 799. FIG. 25 shows the cross-sectional surface in the case in which the communication hole 798 and the communication hole 799 are cut in the XZ planer surface.

Further, as shown in FIG. 21, the cartridge 20F includes a flow channel formation member 801 and a container-side-filter 273. Here, as shown in FIG. 24, a recessed part 270 to be recessed from the outside of the second wall 762 to the inside of the recessed part 768 is provided inside the region surrounded by the container-side-cylindrical-body 288 and the region overlapping the communication opening 281. As shown in FIG. 25, the flow channel formation member 801 is stored inside the recessed part 270 entirely. Further, the container-side-filter 273 is provided within the region surrounded by the container-side-cylindrical-body 288 and covers the recessed part 270 from the outside of the second wall 762. The volume of the flow channel formation member 801 is greater than the volume of the foam 272. Further, the ink amount storable in the flow channel formation member 801 is greater than the ink amount storable in the foam 272. Further, as the flow channel formation member 801, other than the same material as the foam 272, various materials can be employed as long as any materials such that the bubble point pressure is lower than the bubble point pressure of the container-side-filter 273. For example, non-woven fabric materials including polyethylene or polypropylene or foamed plastic materials such as polyurethane, etc. may be used.

As shown in FIG. 24, in the opposite side from the recessed part 768 side of the sixth wall 766, that is, the outside of the sixth wall 766, a circuit substrate 40 is provided. The circuit substrate 40 extends along the sixth wall 766. Therefore, the circuit substrate 40 is inclined with respect to each of the second wall 762 and the fifth wall 765. The circuit substrate 40 is inclined in a direction closer to the fourth wall 764 as approaching from the third wall 762 side to the second wall 762 side.

Figure 26:
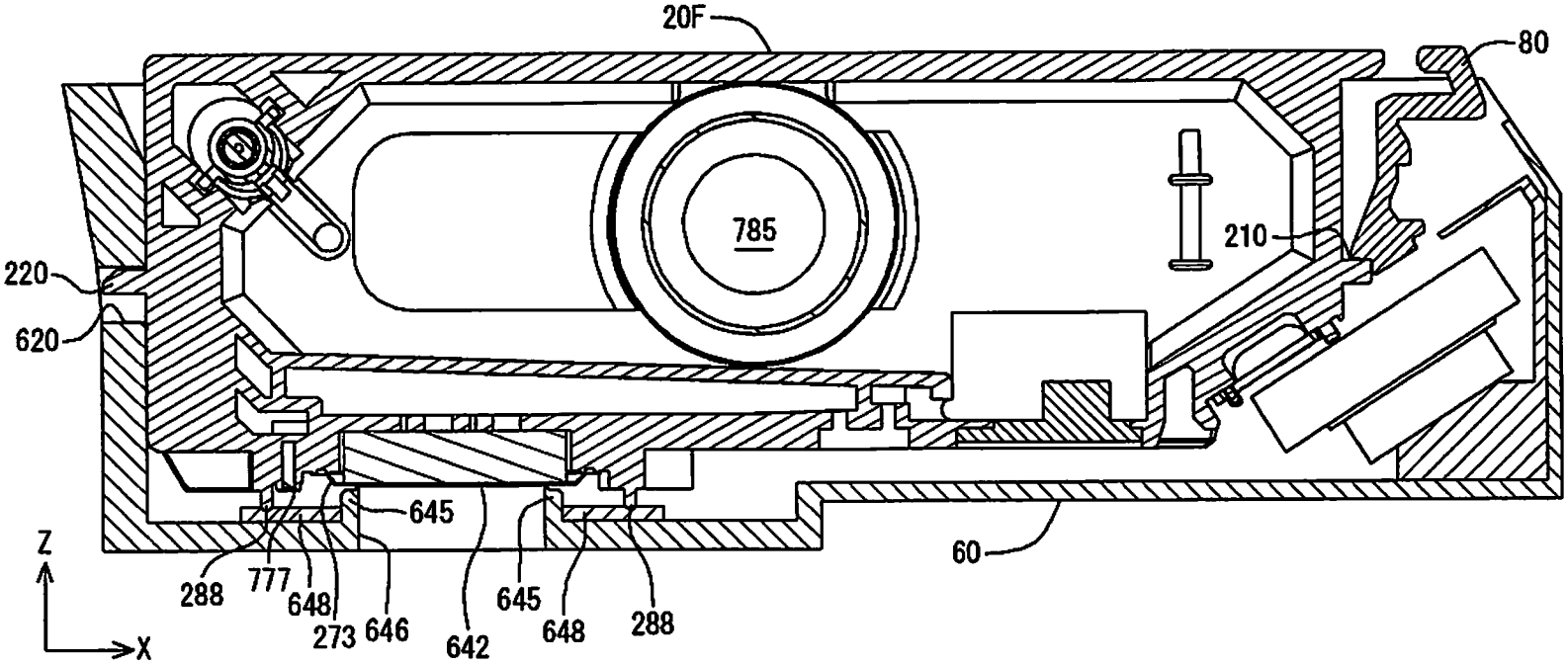
FIG. 26 is a diagram showing a state in which the cartridge according to the sixth embodiment is mounted on the holder.

As shown in FIG. 26, the cartridge 20F having the aforementioned structure is fixed in a position by the lever 80 in the state of being mounted on the holder 60. At this time, the second projecting part 220 is engaged with the recessed part 620, and the first projecting part 210 is engaged with the lever 80. When the cartridge 20F is mounted on the holder 60, the container-side-cylindrical-body 288 abuts to the elastic member 648, and the device-side-cylindrical-body 645 is inserted in the region surrounded by the container-side-cylindrical-body 288. That is, the container-side-cylindrical-body 288 surrounds the ink flow channel 646 from the outside farther than the device-side-cylindrical-body 645. In the region surrounded by the container-side-cylindrical-body 288, the container-side-filter 273 contacts with the device-side-filter 642. Therefore, the ink in the liquid storage part 785 can be supplied from the device-side-filter 642 to the ink flow channel 646 via the flow channel formation member 801 and the container-side-filter 273 from the communication openings 281.

At this time, the container-side-cylindrical-body 288 abuts to the elastic member 648 in a state in which it surrounds the ink flow channel 646 from the outside father than device-side-cylindrical-body 645. Therefore, the air-tightness of the space surrounded by the container-side-cylindrical-body 288 and the elastic member 648 is enhanced. With this, when the ink is supplied from the cartridge 20F to the ink flow channel 646, the ink leaking to the outside of the region surrounded by the device-side-cylindrical-body 645 is blocked by the elastic member 648 and the container-side-cylindrical-body 288.

Figure 27A:
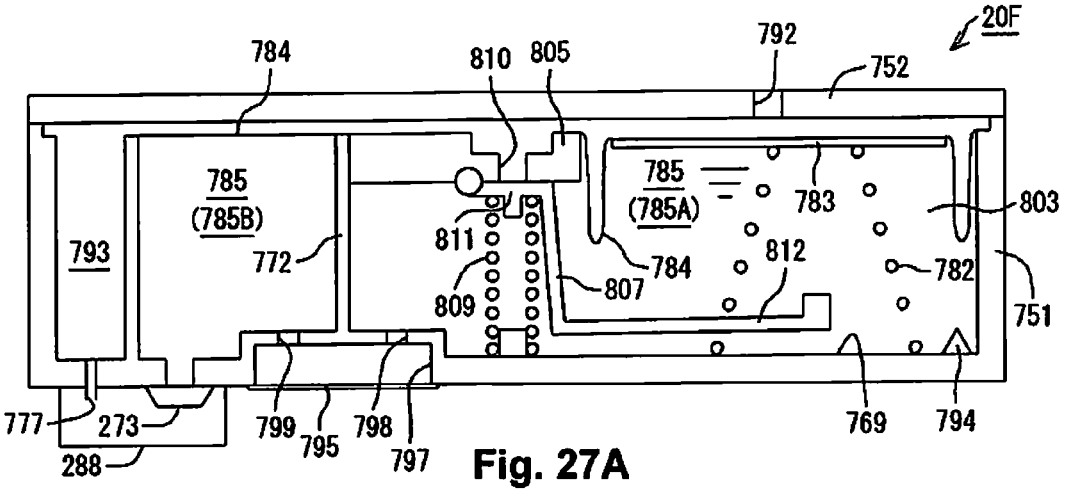
FIGS. 27A to 27C are cross-sectional views schematically showing the inside of the cartridge according to the sixth embodiment.

The ink flow in the cartridge 20F of the present embodiment and the airflow will be described. As shown in FIG. 27A, in the cartridge 20F, the ink 803 is stored in the liquid storage part 785 partitioned by the first case 751 and the sheet member 784. The liquid storage part 785 is partitioned into the first liquid storage part 785A and the second liquid storage part 785B by the partition wall 772. The valve unit 781 (FIG. 21) is provided inside the liquid storage part 785. The valve unit 781 includes a cover valve 805, a lever valve 807, and a spring member 809 as shown in FIG. 27A.

In the cover valve 805, an atmosphere introduction port 810 is provided. The atmosphere introduction port 810 penetrates through the cover valve 805. In the cartridge 20F, the atmosphere introduction port 810 functions as a communication passage to communicate between the inside of the first liquid storage part 785A and the atmospheric chamber 793 in the outside of the liquid storage part 785. A lever valve 807 is provided in the opposite side from the second case 752 side of the cover valve 805. The lever valve 807 includes a valve part 811 and a lever part 812. The valve part 811 overlaps with the atmosphere introduction port 810 of the cover valve 805. The lever part 812 extendedly exists in the region between the pressure receiving plate 783 and the inner surface 769 of the first wall 761. The spring member 809 is provided in the opposite side from the cover valve 805 side of the lever valve 807. The spring member 809 biases the valve part 811 of the lever valve 807 in a direction of the cover valve 805 side. Therefore, the atmosphere introduction part 810 of the cover valve 805 is closed by the valve part 811. Hereinafter, the state in which the atmosphere introduction port 810 is closed by the valve part 811 represents as the close state of the valve unit 781.

Figure 27B:
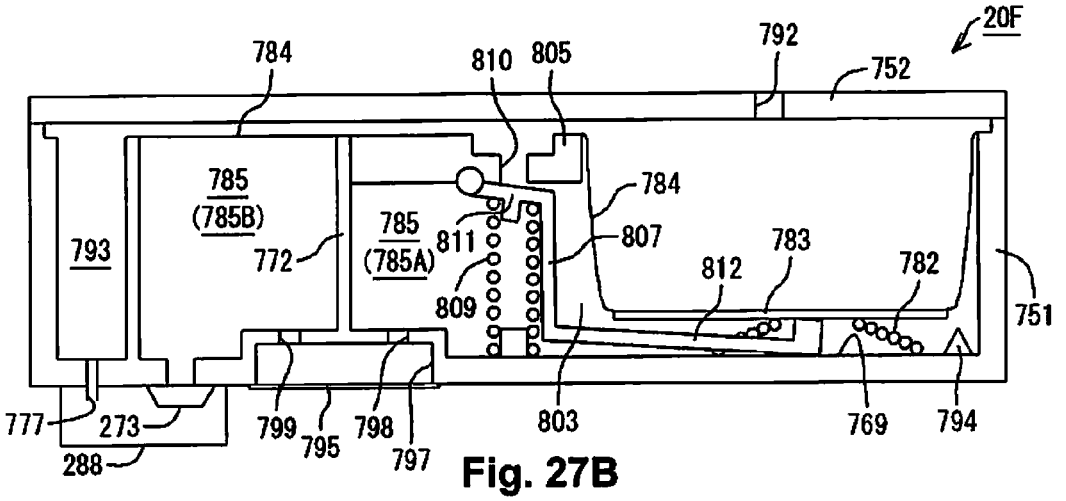

When the ink 803 in the liquid storage part 785 is consumed, as shown in FIG. 27B, the pressure receiving plate 783 displaces toward the inner surface 769 side of the first wall 761. When the pressure receiving plate 783 displaces toward the inner surface 769 side of the first wall 761, the pressure receiving plate 783 presses the lever part 812 toward the inner surface 796 side of the first wall 761. Therefore, the posture of the valve part 811 displaces, and a gap between the valve part 811 and the cover bulb 805 is generated. With this, the atmosphere introduction port 810 and the first liquid storage part 785A are communicated. Hereinafter, the state in which the atmosphere introduction port 810 and the liquid storage part 785 are communicated by generating a gap between the valve part 811 and the cover bulb 805 represents as the open state of the valve unit 781. When the valve unit 781 becomes the open state, the air of the atmospheric chamber 793 in the outside of the liquid storage part 785 is flowed into the inside of the first liquid storage part 785A through the atmosphere introduction port 810.

Figure 27C:
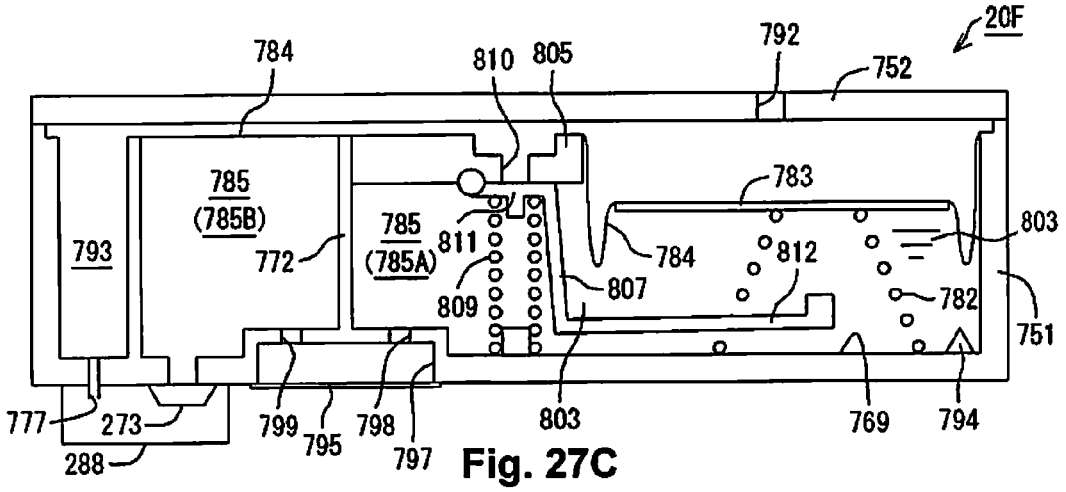

When the air is flowed into the inside of the first liquid storage part 785A through the atmosphere introduction port 810, the pressure receiving plate 783 displaces toward the second case 752 side as shown in FIG. 27C. That is, the volume of the first liquid storage part 785A increases in compared with the condition shown in FIG. 27B by flowing the air to the inside of the first liquid storage part 785A through the atmosphere introduction port 810. With this, the negative pressure inside the liquid storage part 785A is reduced (approaching the atmospheric pressure). When the certain amount of air is entered into the first liquid storage part 785A, the pressure receiving plate 783 is separated from the lever part 812. With this, the valve part 811 closes the atmosphere introduction port 810. That is, the valve unit 781 becomes the close state. The lever valve 807 temporarily becomes the open state when the negative pressure inside liquid storage part 785 becomes large in accordance with the consumption of the ink 803 in the liquid storage part 785, so that it is possible to maintain the pressure inside the liquid storage part 785 within an appropriate pressure range.

In the present embodiment, the communication hole 777 communicates to the atmospheric chamber 793 through the second wall 762 of the first case 751 from the inside of the region surrounded by the container-side-cylindrical-body 288. That is, the inside of the region surrounded by the container-side-cylindrical-body 288 and the atmospheric chamber 793 are communicated through the communication hole 777. The atmospheric chamber 793 communicates to the atmosphere communication hole 792 through the gap between the second case 752 and the sheet member 784. Therefore, the inside of the region surrounded by the container-side-cylindrical-body 288 communicates to the outside of the first case 751 through the inside of the first case 751. Accordingly, when the inside of the region surrounded by the container-side-cylindrical-body 288 is sealed from the outside of the cartridge 20F, the difference between the pressure inside the region surrounded by the container-side-cylindrical-body 288 and the pressure (atmospheric pressure) of the outside of the first case 751 can be reduced.

In the present embodiment, when the cartridge 20F is mounted on the printer 50, in the inside of the holder 60, it becomes a state in which the region surrounded by the container-side-cylindrical-body 288 is sealed. In a state in which the region surrounded by the container-side-cylindrical-body 288 is sealed, the container-side-filter 273 inside the region surrounded by the container-side-cylindrical-body 288 abuts to the device-side-filter 642 (FIG. 2) of the printer 50 side. Therefore, the leakage of the ink 803 to the outside from the inside of the region surrounded by the container-side-cylindrical-body 288 can be suppressed. In the case the region surrounded by the container-side-cylindrical-body 288 is sealed when the cartridge 20F is mounted on the printer 50, the pressure inside the region surrounded by the container-side-cylindrical-body 288 sometimes becomes high. At this time, by rising the pressure inside the region surrounded by the container-side-cylindrical-body 288, the air inside the region surrounded by the container-side-cylindrical-body 288 is sometimes flowed into the inside of the liquid storage part 785 through the container-side-filter 273. When the air is flowed into the inside of the liquid storage part 785, it seems that the flowed air becomes air bubble and reaches to the print head 540. When the air bubble is entered inside the print head 540, the ejection capability of the ink 803 is reduced by the air bubble.

For such problem, in the present embodiment, the inside of the region surrounded by the container-side-cylindrical-body 288 communicates to the outside of the first case 751 through the communication hole 777, the atmospheric chamber 793, and the atmosphere communication hole 792. Therefore, in the case in which the region surrounded by the container-side-cylindrical-body 288 is sealed when the cartridge 20F is mounted on the printer 50, even when the pressure inside the region surrounded by the container-side-cylindrical-body 288 becomes high, the air inside the region surrounded by the container-side-cylindrical-body 288 can be released to the outside of the first case 751 through the communication hole 777, the atmospheric chamber 793, and the atmosphere communication hole 792. Further, for example, when the pressure of the space surrounded by the container-side-cylindrical-body 288 is raised by the air expansion due to the temperature changes, the air in the space surrounded by the container-side-cylindrical-body 288 can be released to the outside of the cartridge 20F. With this, the difference between the pressure inside the region surrounded by the container-side-cylindrical-body 288 and the pressure (atmospheric pressure) of the outside of the first case 751 can be reduced. As a result, the ejection capability of the ink in the print head 540 can be easily maintained.

Further, in the present embodiment, even when the empty of the ink remaining amount inside the first liquid storage part 785A is determined through the prism 7, the second liquid storage part 785B is provided, so that the ink remained inside the second liquid storage part 785B can be used to continue printing for a certain period of time.

In the present embodiment, when the ink inside the first liquid storage part 785A (FIG. 27C) is reduced, the air is flowed into the inside of the first liquid storage part 785A through the atmosphere introduction port 810. At this time, it seems that the air flowed into the inside of the first liquid storage part 785A may be flowed into the inside of the second liquid storage part 785B through the recessed part 797 as the air bubble. Further, it seems that the air bubble flowed into the inside of the second liquid storage part 785B may be entered to the recessed part 270 through the communication opening 281 (FIG. 25). At this time, in the case in which the plate spring 271 and the foam 272 according to the first embodiment are employed instead of the flow channel formation member 801 provided inside the recessed part 270, the air bubble is easily accumulated inside the recessed part 270. Therefore, in the configuration of the plate spring 271 and the foam 272 according to the first embodiment, the ink flow from the first liquid storage part 785A to the container-side-filter 273 is easily stopped by the air bubble entered inside the recessed part 270. As a result, even though the ink is still remained inside the first liquid storage part 785A, it seems that the ink may not be supplied to the print head 540.

For such problem, in the sixth embodiment, the flow channel formation member 801 inside the recessed part 270 is provided, so that even when the air bubble is flowed into the inside of the second liquid storage part 785B, the ink is easily supplied to the print head 540. This is because the volume in which the air inside the recessed part 270 can be existed as the air bubble is smaller than the configuration of the plate spring 271 and the foam 272, or the retainable ink amount in the flow channel formation member 801 is greater than the retainable ink amount in the foam 272, etc.

Figure 28:
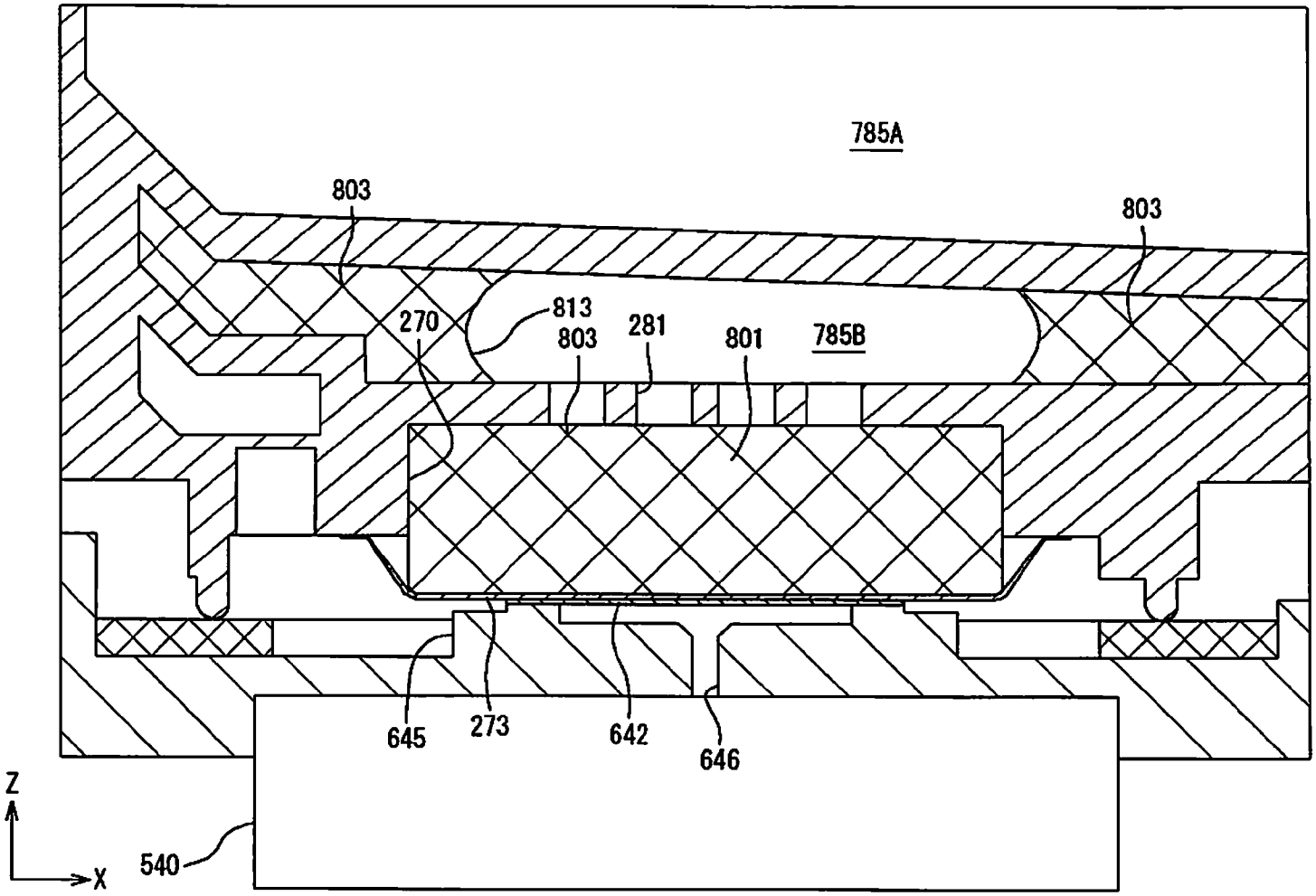
FIG. 28 is a ZX-cross-sectional view showing a state in which the liquid supply part according to the sixth embodiment contacts with the liquid introduction part.
Figure 29:
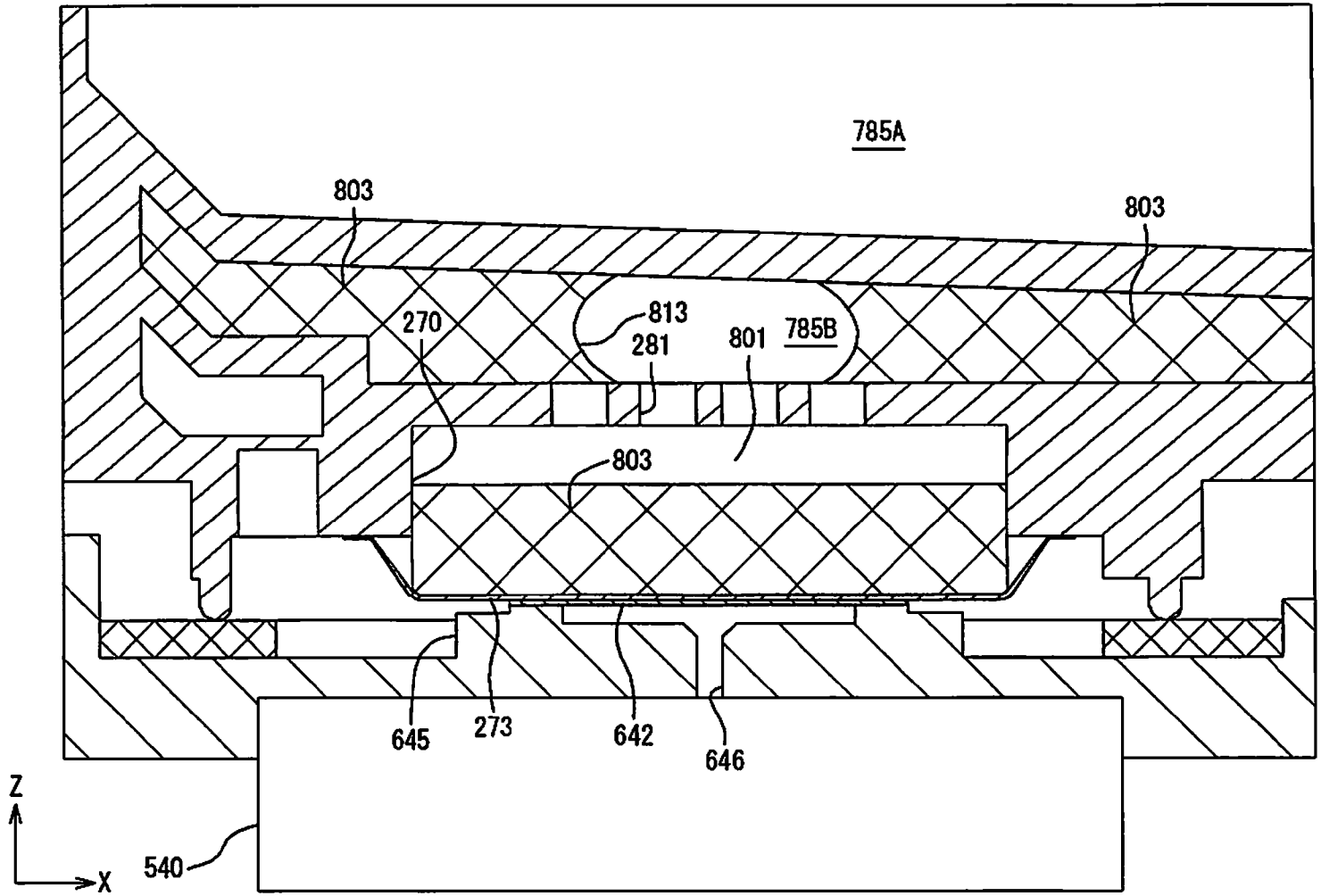
FIG. 29 is a ZX-cross-sectional view showing a state in which the liquid supply part according to the sixth embodiment contacts with the liquid introduction part.

As shown in FIG. 28, even when the air bubble 813 is flowed into the inside of the second liquid storage part 785B, the ink 803 stored in the flow channel formation member 801 can be supplied to the print head 540 for a certain period of time. When the ink 803 stored in the flow channel formation member 801 is supplied to the print head 540, as shown in FIG. 29, the air bubble inside the second liquid storage part 785B is absorbed to the inside of the flow channel formation member 801 from the +Z-axis direction side of the flow channel formation member 801 in a gas state. Then, the volume of the air bubble 813 inside the second liquid storage part 785B becomes smaller. With this, the ink 803 is injected into the inside of the second liquid storage part 785B from the first liquid storage part 785A side. The ink 803 injected inside the second liquid storage part 785B reaches to the flow channel formation member 801, so that the ink flow from the first liquid storage part 785A to the container-side-filter 273 is recovered.

That is, even when the ink flow from the first liquid storage part 785A to the flow channel formation member 801 is stopped by entering the air bubble inside the second liquid storage part 785B, while the ink stored in the flow channel formation member 801 is supplied to the print head 540, the ink flow from the first liquid storage part 785A to the flow channel formation member 801 is easily recovered. Therefore, in the sixth embodiment, it is hard to stop the ink supply to the print head (the ink supply to the print head is easily maintained) even when the air bubble is flowed into the inside of the second liquid storage part 785B. Further, in the sixth embodiment, since the flow channel formation member 801 is fully stored inside the recessed part 270, it easily prevents the air as the air bubble from flowing into the inside of the recessed part 270 through the inside of the container-side-cylindrical-body 288 from the outside of the cartridge 20F.

G. Seventh Embodiment

Figure 30:
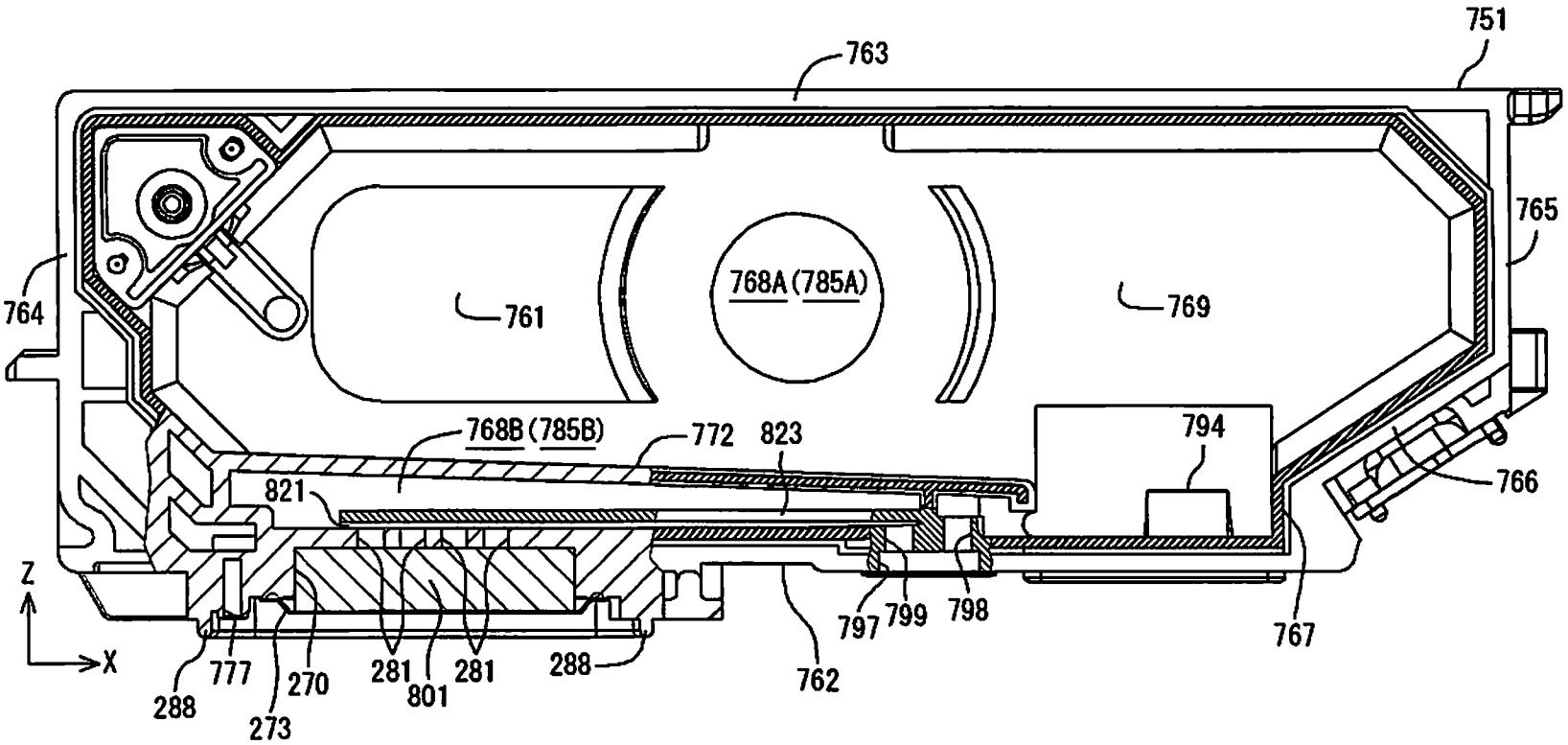
FIG. 30 is an explanatory diagram showing a configuration of the inside of the first case according to the seventh embodiment.

A cartridge 20G according to the seventh embodiment will be described. As shown in FIG. 30, the cartridge 20G according to the seventh embodiment has the same configuration as the cartridge 20F according to $6^{th}$ embodiment except a groove 821 is provided as an example of a capillary force generation configuration. Therefore, hereinafter, for the same structure of the sixth embodiment, the same symbols of the sixth embodiment are allotted, and the detailed descriptions are omitted.

The groove 821 is provided in the first case 751. In the first case 751, the groove 821 is provided in the second recessed part 768B (second liquid storage part 785B). The groove 821 extendedly exists along the second wall 762 from the position overlapping with the communication hole 799 to the position being a flow communication capability with the flow channel formation member 801. In the second recessed part 768B (second liquid storage part 785B), a projecting part 823 is provided along the X-axis direction between the partition wall 772 to the second wall 762. In the present embodiment, the projection amount of the projecting part 823 from the inner surface 769 is smaller than the projection amount of the partition wall 772 or the second wall 762 from the inner surface 769.

The projecting part 823 is projected toward the +Y-axis direction side from the inner surface 769 of the first wall 761, that is, from the inner surface 769 of the first wall 761 to the second case 752 (FIG. 21) side. The region between the projecting part 823 and the second wall 762 in the Z-axis direction is configured as the groove 821. By the groove 821, the capillary force applies to the ink inside the groove 821. With this, the ink inside the second recessed part 768B (second liquid storage part 785B) can be easily guided from the communication hole 799 side to the flow channel formation member 801 side along the groove 821. Therefore, the ink inside the second recessed part 768B (second liquid storage part 785B) can be easily guided to the flow channel formation member 801. As a result, in the seventh embodiment, even when the air bubble is flowed into the inside of the second liquid storage part 785B, it is hard to further stop the ink supply to the print head 540 (the ink supply to the print head 540 is easily maintained).

H. Eighth Embodiment

Figure 31:
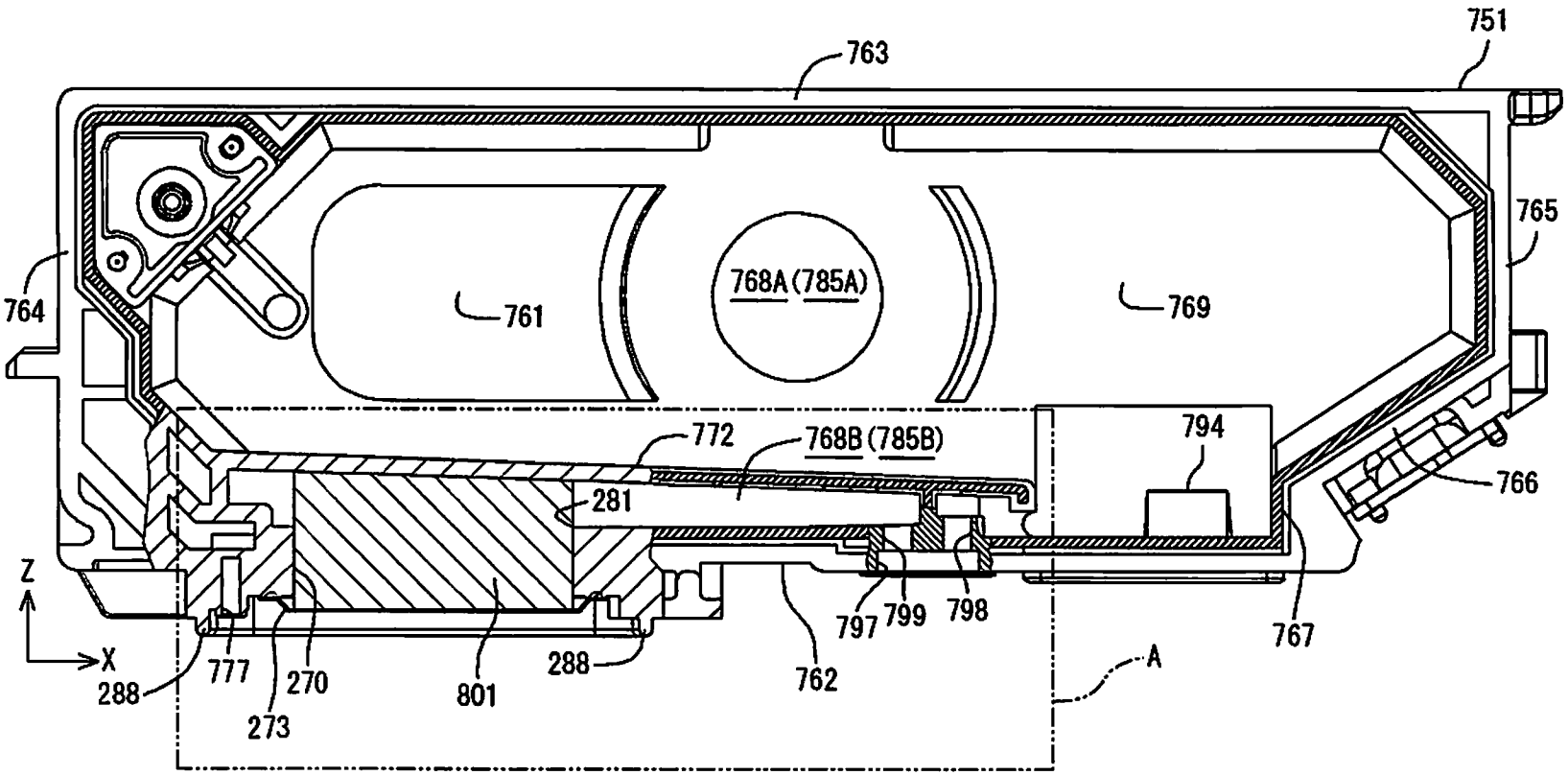
FIG. 31 is an explanatory diagram showing a configuration of the inside of the first case according to the eighth embodiment.

The cartridge 20H according to the eighth embodiment will be described. As shown in FIG. 31, the cartridge 20G according to the eighth embodiment has the same configuration of the cartridge 20F according to the sixth embodiment except the flow channel formation member 801 inside recessed part 270 extends to the second recessed part 768B. Therefore, hereinafter, for the same structure of the sixth embodiment, the same symbols of the sixth embodiment are allotted, and the detailed descriptions are omitted.

In the eighth embodiment, in the first case 751, the recessed part 270 communicates to the second recessed part 768B (second liquid storage part 785B) in the same opening size of the recessed part 270. That is, the communication opening 281 has the same size of the opening size of the recessed part 270. The flow channel formation member 801 stored in the recessed part 270 extends from the inside of the recessed part 270 to the inside of the second recessed part 768B. That is, in the present embodiment, the flow channel formation member 801 is provided across the recessed part 270 and the second recessed part 768B.

Figure 32:
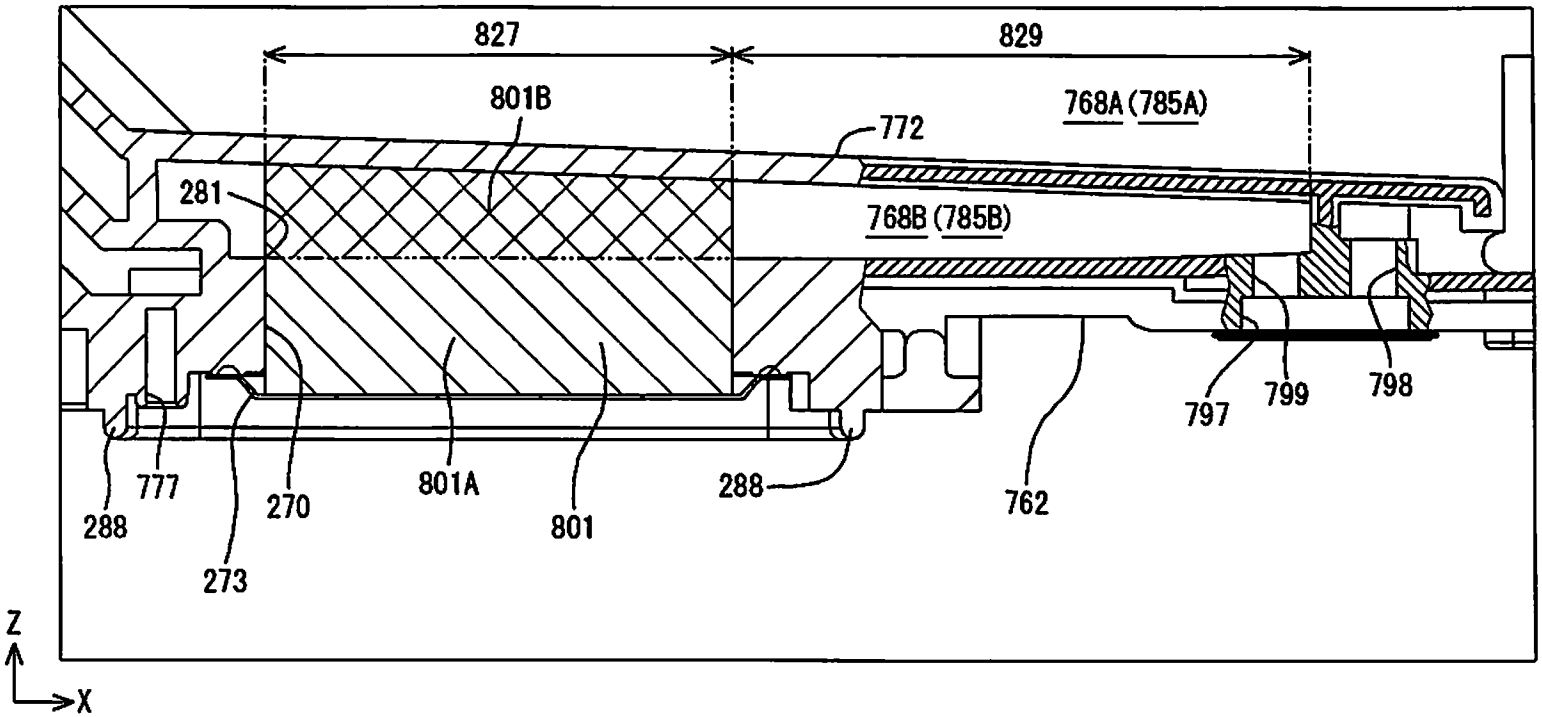
FIG. 32 is an enlarged view showing an A part in FIG. 31.

Here, as shown in FIG. 32, the flow channel formation member 801 may be divided into the first part 801A and the second part 801B. The first part 801A is a part positioned inside the recessed part 270 within the flow channel formation member 801. The second part 801B is a part positioned inside the second recessed part 768B (second liquid storage part 785B) within the flow channel formation member 801. In FIG. 32, in order to simplify the configuration, the hatching type of the first part 801A and the second part 801B of the flow channel formation member 801 is changed.

Further, the second recessed part 768B (second liquid storage part 785B) is divided into the first part 827 and the second part 829. The first part 827 is the region occupied by the first part 801A of the flow channel formation member 801 within the second recessed part 768B (second liquid storage part 785B). The second part 829 is the region upstream side father than the first part 827, that is, the recessed part 797 side farther than the first part 827.

In the eighth embodiment, the first part 801A of the flow channel formation member 801 is positioned inside the recessed part 270, and the second part 801B of the flow channel formation member 801 is positioned in the first part 827 of the second recessed part 768B (second liquid storage part 785B). In the eighth embodiment, even though the air bubble is flowed into the inside of the second liquid storage part 785B, the ink is easily supplied to the print head 540 as compared with the sixth embodiment. This is because the volume in which the air inside the second recessed part 768B (second liquid storage part 785B) can be existed as the air bubble is smaller than the volume in the sixth embodiment, or the retainable ink amount in the flow channel formation member 801 is greater than the retainable ink amount in the sixth embodiment. As a result, in the eighth embodiment, even though the air bubble is flowed into the inside of the second liquid storage part 785B, it is hard to further stop the ink supply to the print head 540 (the ink supply to the print head 540 is easily maintained).

In the present embodiment, the first part 801A and the second part 801B are configured in one flow channel formation member 801, but the structure of the flow channel formation member 801 is not limited to this. The flow channel formation member 801 may be configured in a plurality of flow channel formation members. In this case, for example, the second part 801B of the flow channel formation member 801 may be configured in another flow channel formation member (second flow channel formation member) which is different from the flow channel formation member 801. In this case, the flow channel formation member 801 is separately configured in the first part 801A and the second part 801B.

At this time, in FIG. 32, the second part 801B of the recessed part 270 may be arranged in the manner in which the flow can be communicated with the first part 801A of the flow channel formation member 801. Therefore, in the present embodiment, it is not limited to the structure shown in FIG. 32, and it is not necessary to extendedly exist the second part 801B of the flow channel formation member 801 across the first part 827 of the second recessed part 768B (second liquid storage part 785B), so that it may be a configuration in which it is existed in a partial position of the first part 827 of the second recessed part 768B. Further, it may be a configuration in which a part of the second part 801B of the flow channel formation member 801 is positioned in the first part 827 of the second recessed part 768B, and another part is positioned in the second part 829 of the second recessed part 768B (second liquid storage part 785B). Therefore, the second part 801B of the flow channel formation member 801 can be relatively and freely arranged in the first part 827 of the second recessed part 768B.

I. Ninth Embodiment

Figure 33:
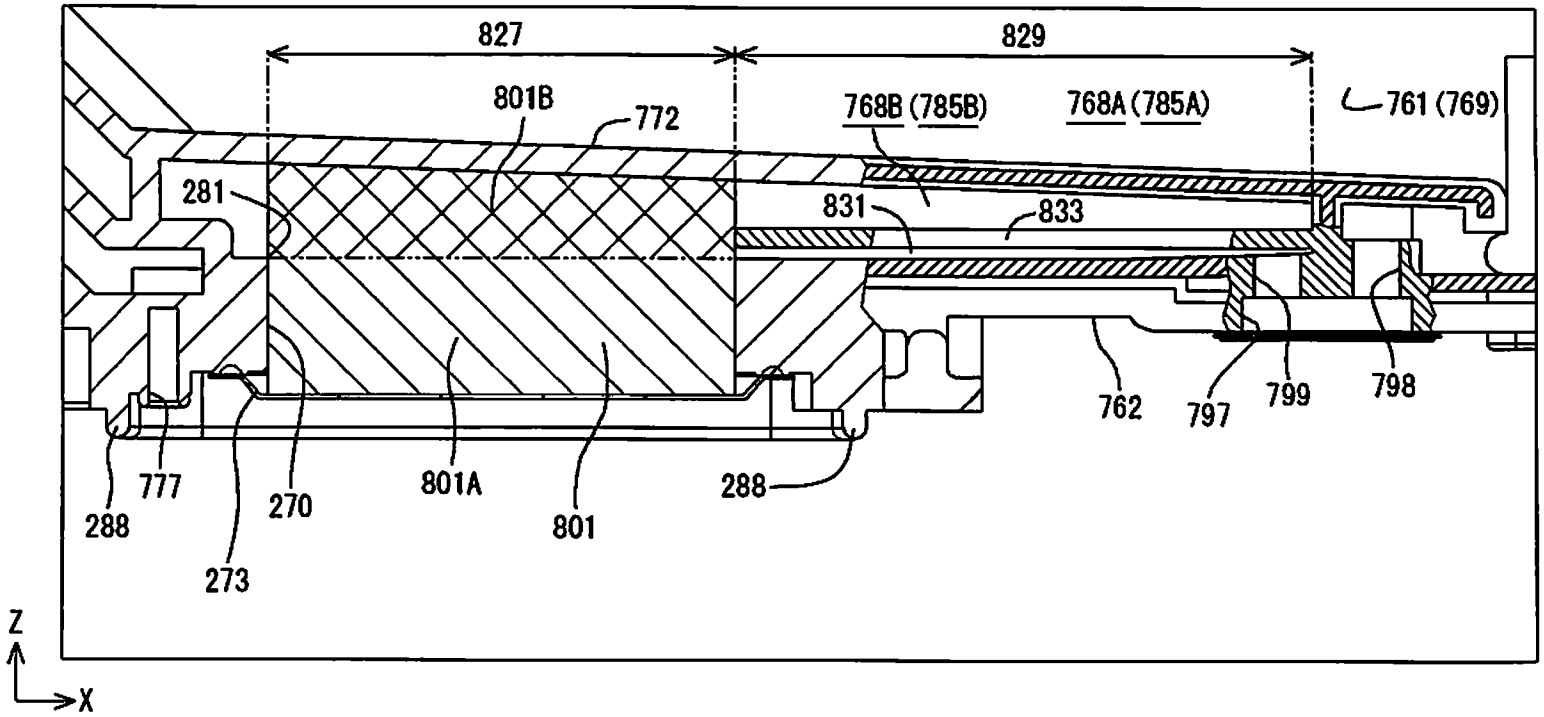
FIG. 33 is an explanatory diagram showing a configuration of a cartridge according to the ninth embodiment.

A cartridge 20I according to the ninth embodiment will be described. As shown in FIG. 33, the cartridge 20I according to the ninth embodiment has the same configuration as the cartridge 20H according to the eighth embodiment except a groove 831 as an example of a capillary force generation configuration is provided. Therefore, hereinafter, for the same structure of the eighth embodiment, the same symbols of the eighth embodiment are allotted, and the detailed descriptions are omitted.

The groove 831 is provided in the first case 751. In the first case 751, the groove 831 is provided inside the second part 829 within the inside of the second recessed part 768B (second liquid storage part 785B). The groove 831 extendedly exists from the position overlapping with the communication hole 799 to the position of the flow channel formation member 801. The flow channel formation member 801 contacts with the groove 831. In the second part 7688 (second liquid storage part 785B), a projecting part 833 is provided along the X-axis direction between the partition wall 772 and the second wall 762. In the present embodiment, the projection amount of the projecting part 833 from the inner surface 769 is smaller than the projection amount of the partition wall 772 and the second wall 762 from the inner surface 769.

The projecting part 833 is projected toward the +Y-axis direction side from the inner surface 769 of the first wall 761, that is, the second case 752 (FIG. 21) side from the inner surface 769 of the first wall 761. The region between the projecting part 833 and the second wall 762 in the Z-axis direction is configured as the groove 831. By the groove 831, the capillary force affects to the ink inside the groove 831. With this, the ink inside the second recessed part 768B (second liquid storage part 785B) can be easily guided along the groove 831 from the communication hole 799 side to the flow channel formation member 801 side. Since the flow channel formation member 801 contacts with the groove 831, the ink inside the second recessed part 768B (second liquid storage part 785B) can be easily guided to the flow channel formation member 801. As a result, in the ninth embodiment, even when the air bubble is flowed into the inside the second liquid storage part 785B, it is hard to further stop the ink supply to the print head 540 (the ink supply to the print head 540 is easily maintained).

J. Tenth Embodiment

Figure 34:
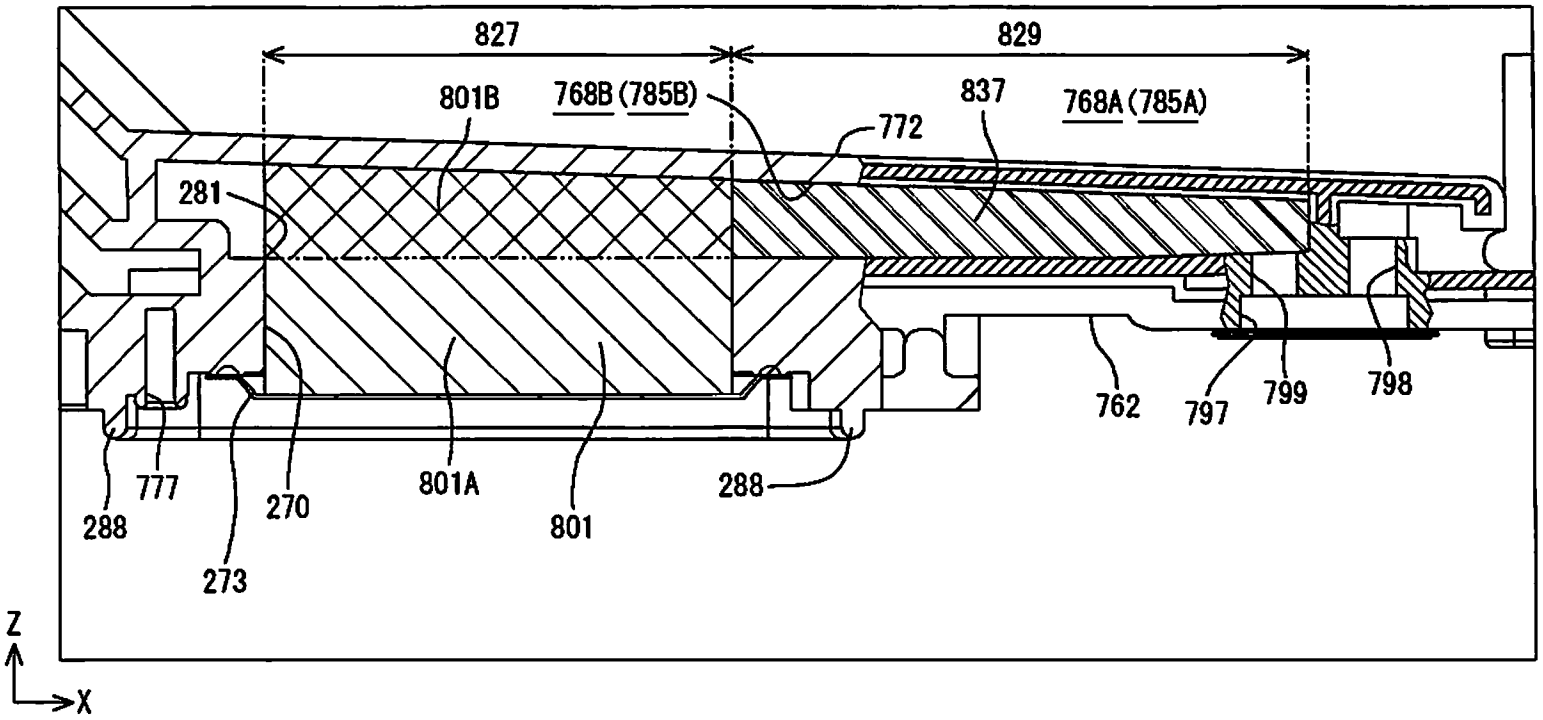
FIG. 34 is an explanatory diagram showing a configuration of a cartridge according to the tenth embodiment.

A cartridge 20J according to the tenth embodiment will be described. As shown in FIG. 34, the cartridge 20I according to the tenth embodiment has the same structure as the cartridge 20H according to the eighth embodiment except the second flow channel formation member 837 as an example of the capillary force generation configuration is provided. Therefore, hereinafter, for the same structure of the eighth embodiment, the same symbols of the eighth embodiment are allotted, and the detailed descriptions are omitted.

The second flow channel formation member 837 is provided in the first case 751. In the first case 751, the second flow channel formation member 837 is provided inside the second part 829 within the inside of the second recessed part 768B (second liquid storage part 785B). The second flow channel formation member 837 is provided across the inside of the second part 829 within the inside of the second recessed part 768B (second liquid storage part 785B). The second flow channel formation member 837 extendedly exists from the position overlapping with the communication hole 799 to the position of the flow channel formation member 801. The flow channel formation member 801 contacts with the second flow channel formation member 837. As the second flow channel formation member 837, the same material as the flow channel formation member 801 can be employed.

The capillary force affects to the ink inside the second part 829 by the second flow channel formation member 837. With this, the ink inside the second recessed part 768B (second liquid storage part 785B) can be easily guided from the communication hole 799 side to the flow channel formation member 801 side along the second flow channel formation member 837. Since the flow channel formation member 801 contacts with the second flow channel formation member 837, the ink inside the second recessed part 769B (second liquid storage part 785B) can be easily guided to the flow channel formation member 801. Further, since the second part 829 is occupied by the second flow channel formation member 837, a space in which the air can be existed as the air bubble is not provided in the first part 827 and the second part 829 in the second recessed part 768B (second liquid storage part 785B). Therefore, in the tenth embodiment, the air bubble flowing into the first part 827 and the second part 829 can be suppressed. Therefore, in the tenth embodiment, it is hard to further stop the ink supply to the print head 540 (the ink supply to the print head 540 is easily maintained).

On the other hand, for example, when the air bubble is flowed into the inside of the second liquid storage part 785 in the cartridge 20F, the volume of the second liquid storage part 785B cannot be effectively used. When the air bubble is flowed into the inside of the second liquid storage part 785B, the retainable ink amount inside the second liquid storage part 785B is reduced by the volume of the air bubble inside the second liquid storage part 785B. Therefore, when the air bubble is flowed into the inside of the second liquid storage part 785B, the volume of the second liquid storage part 785B cannot be effectively used. When such problem occurs, the period of time in which the printing can be continued from the time when the empty of the ink remaining amount inside the first liquid storage part 785A was detected through the prism 794 (hereinafter referred to as continuing period) becomes short. However, for such problem, in the tenth embodiment, since the air bubble flowing into the first part 827 and the second part 829 can be suppressed, this easily avoids the occurrence in which the continuing period becomes short. With this, in the tenth embodiment, the variations of the continuing periods can be reduced.

K. Eleventh Embodiment

Figure 35:
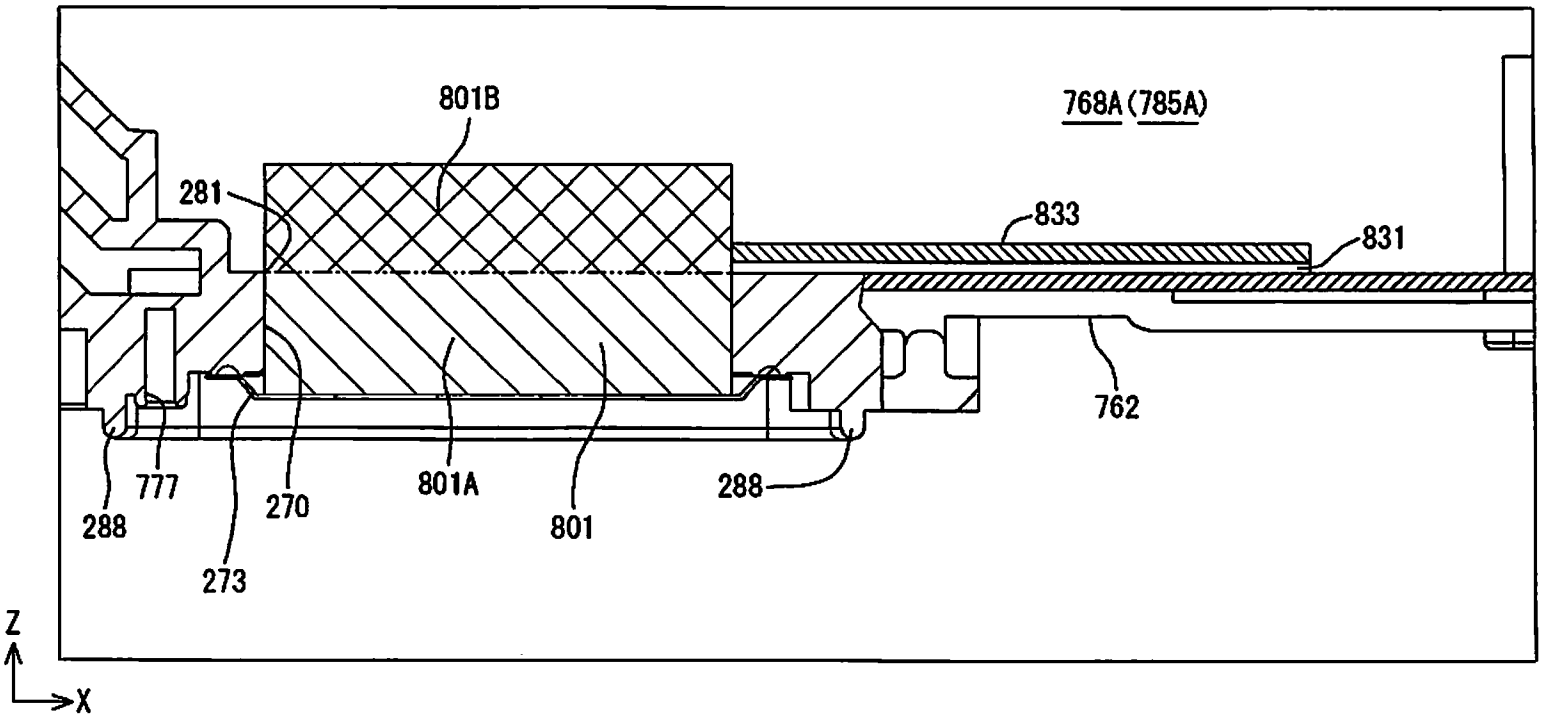
FIG. 35 is an explanatory diagram showing a configuration of a cartridge according to the eleventh embodiment.

A cartridge 20K according to the eleventh embodiment will be described. As shown in FIG. 35, the cartridge 20K according to the eleventh embodiment omits the second recessed part 768B (second liquid storage part 785B), the communication hole 798, the communication hole 799, and the recessed part 797 (FIG. 33) according to the ninth embodiment. Except this point, the cartridge 20K according to the eleventh embodiment has the same structure as the cartridge 20I according to the ninth embodiment. Therefore, hereinafter, for the same structure as the ninth embodiment, the same symbols of the ninth embodiment are allotted, and the detailed descriptions are omitted. In the present embodiment, by omitting the partition wall 772 (FIG. 33) according to the ninth embodiment, the second recessed part 768B (second liquid storage part 785B) according to the ninth embodiment is omitted.

According to the eleventh embodiment, when the empty of the ink remaining amount inside the first liquid storage part 785A was detected through the prism 794, a printing can be continued for a certain period of time by using the remaining ink inside the groove 831B and the flow channel formation member 801. That is, in the eleventh embodiment, since the flow channel formation member 801 and the groove 831 are provided, the second liquid storage part 785B can be omitted. The period of time in which the printing can be continued from the time when the ink remaining amount was empty can be appropriately adjusted by adjusting the path length of the groove 831, the depth of the groove 831, the volume of the flow channel formation member 801, etc.

L. Twelfth Embodiment

Figure 36:
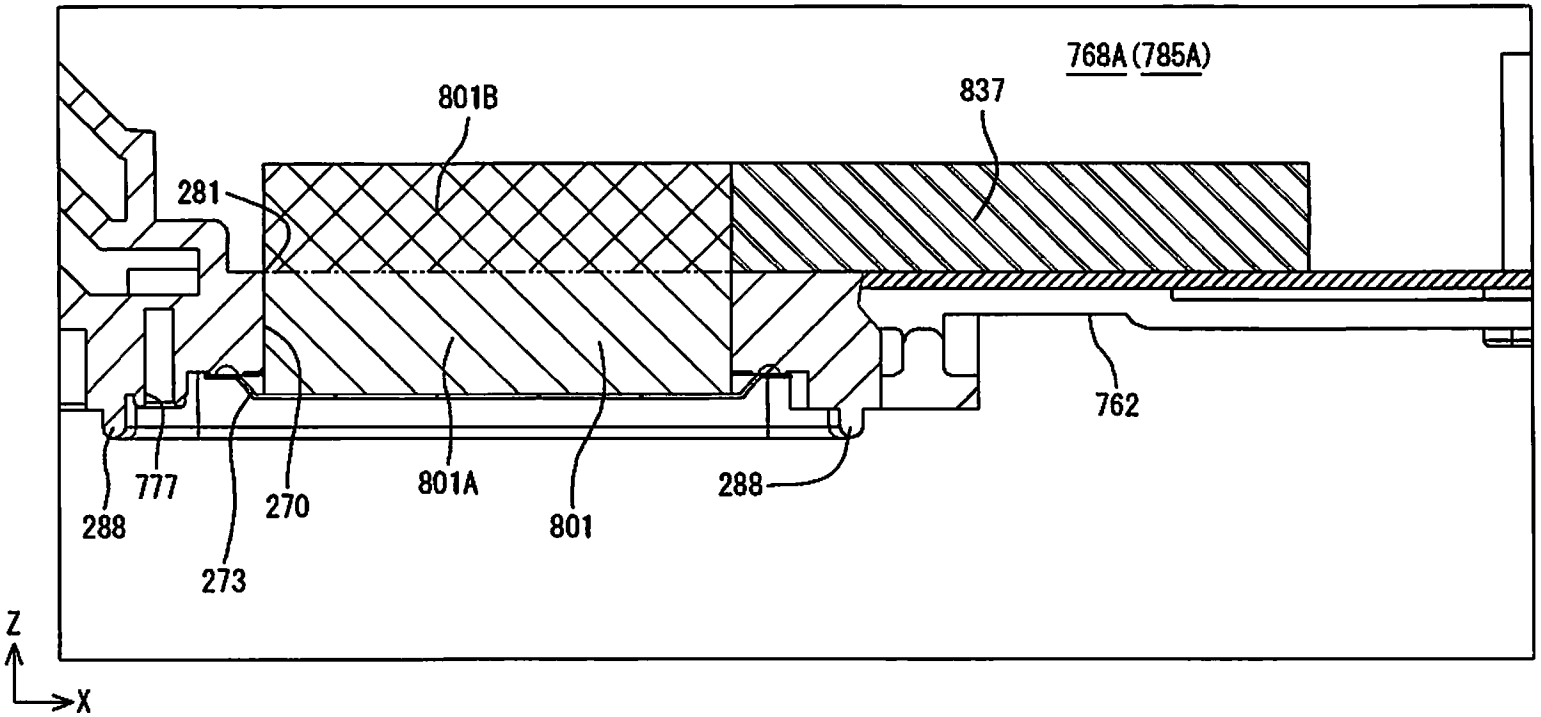
FIG. 36 is an explanatory diagram showing a configuration of a cartridge according to the twelfth embodiment.

A cartridge 20L according to the twelfth embodiment will be described. As shown in FIG. 36, the cartridge 20L according to the twelfth embodiment omits the second recessed part 768B (second liquid storage part 785B), the communication hole 798, the communication hole 799, and the recessed part 797 (FIG. 34) according to the tenth embodiment. Except this point, the cartridge 20L according to the twelfth embodiment has the same structure as the cartridge 20J according to the tenth embodiment. Therefore, hereinafter, for the same structure as the tenth embodiment, the same symbols as the tenth embodiment are allotted, and the detailed descriptions are omitted. In the present embodiment, by omitting the partition wall 772 (FIG. 34) according to the tenth embodiment, the second recessed part 768B (second liquid storage part 785B) according to the tenth embodiment is omitted.

According to the twelfth embodiment, when the empty of the ink remaining amount inside the first liquid storage part 785A is detected through the prism 794, the printing can be continued for a certain period of time by using the remaining ink inside the second flow channel formation member 837 and the flow channel formation member 801. That is, in the eleventh embodiment, since the flow channel formation member 801 and the second flow channel formation member 837 are provided, the second liquid storage part 785B can be omitted. The period of time in which the printing can be continued from the time when the ink remaining amount was empty can be appropriately adjusted by adjusting the volume of the second flow channel formation member 837, the volume of the flow channel formation member 801, etc.

M. Thirteenth Embodiment

Figure 37:
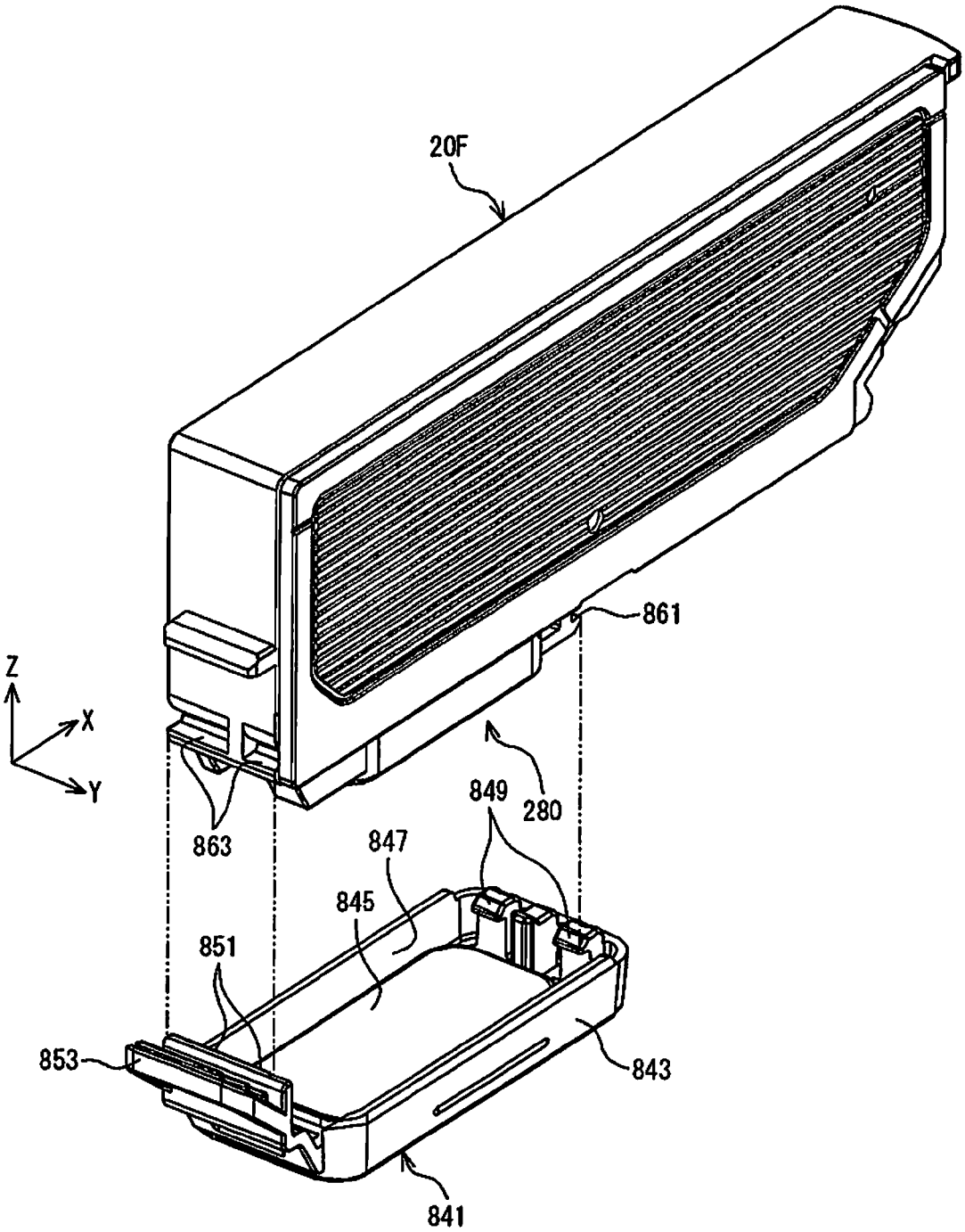
FIG. 37 is a perspective view showing a cartridge and a cap according to the thirteenth embodiment.

As shown in FIG. 37, in the thirteenth embodiment, a cap 841 is added to the cartridge 20F. In the thirteenth embodiment, for the same structure of the sixth embodiment, the same symbols as the sixth embodiment are allotted and the detailed descriptions are omitted. In a state in which the cartridge 20F is unused, the cap 841 covers the liquid supply part 280. The liquid supply part 280 can be shielded by the cap 841. By shielding the liquid supply part 280 by the cap 841, this can suppress the leakage of the ink from the liquid supply part 280 low, or this can suppress the evaporation of the liquid component of the ink from the liquid supply part 280 low. When the cartridge 20F is mounted on the printer 50, the operator removes the cap 841 from the liquid supply part 280 and mounts the cartridge 20F to the printer 50. That is, the cartridge 20F is mounted on the printer 50 in a state in which the cap 841 is removed from the liquid supply part 280.

Figure 38:
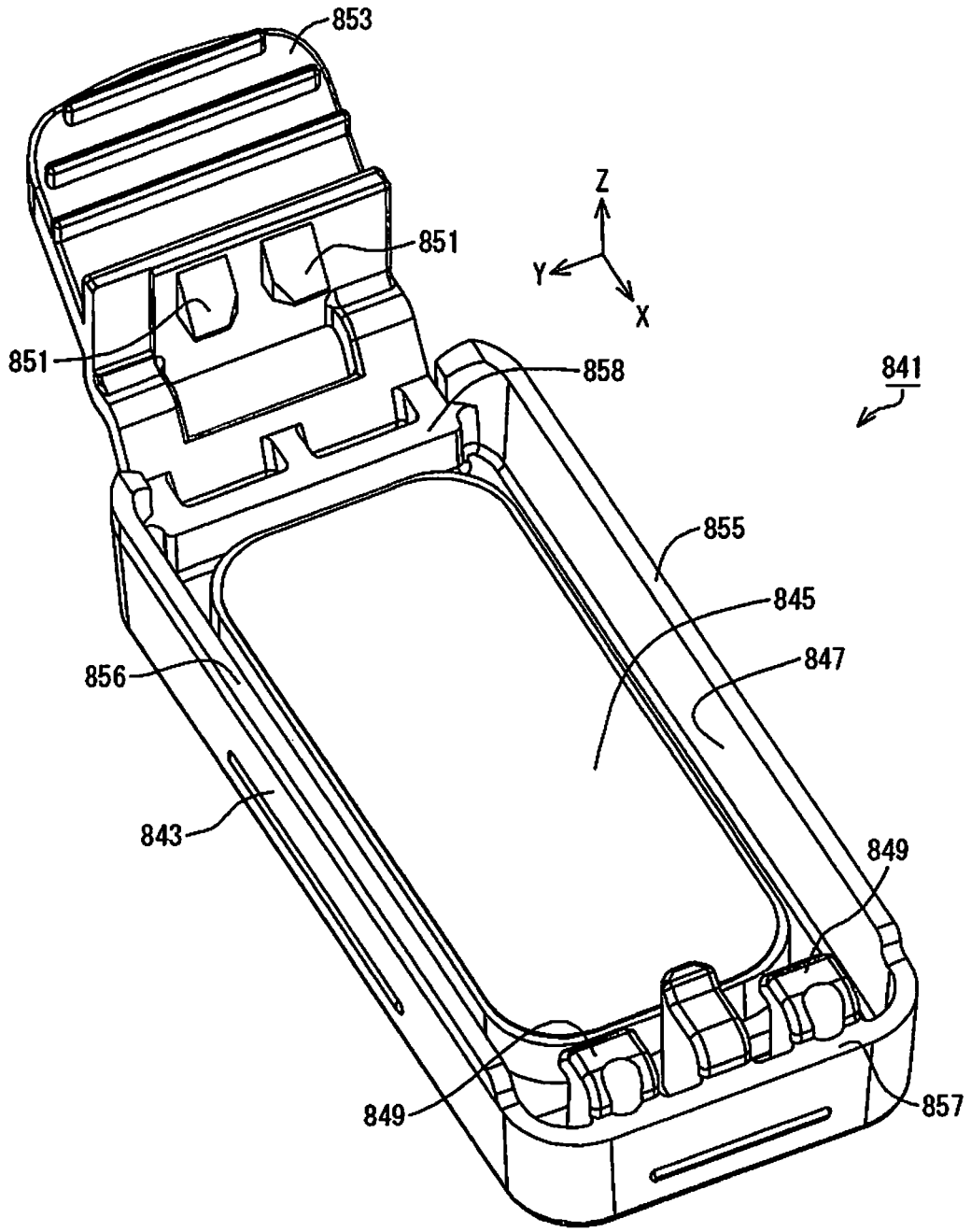
FIG. 38 is a perspective view showing the cap according to the thirteenth embodiment.

The cap 841 includes a cover 843 and a seal member 845. The cover 843 is formed by, for example, synthetic resin such as nylon, polypropylene, etc. A recessed part 847, engaging pawls 849, engaging pawls 851, and an attachment and detachment lever 853 are provided in the cover 843. The recessed part 847 is provided to be recessed in the −Z-axis direction. As shown in FIG. 38, the recessed part 847 are surrounded by the partition wall 855, the partition wall 856, the partition wall 857, and the partition wall 858. The partition wall 855 and the partition wall 856 are faced to each other in a state of providing a gap to each other in the Y-axis direction. The partition wall 857 and the partition wall 858 are faced to each other in a state of providing a gap to each other in the X-axis direction.

The seal member 845 is stored inside the recessed part 847. The engaging pawls 849 are provided in the partition wall 858 side of the partition wall 857. A gap is provided between the engaging pawls 849 and the partition wall 858. The seal member 845 is stored between the engaging pawls 849 and the partition wall 858. Therefore, the engaging pawls 849 are provided between the partition wall 857 and the seal member 845. The engaging pawls 851 are provided in the opposite side from the seal member 845 side of the partition wall 858. That is, the engaging pawls 851 are provided in the outside of the region in the recessed part 847 in a plan view. The engaging pawls 849 and the engaging pawls 851 are faced to each other through the seal member 845 and the partition wall 858 in a plan view.

The attachment and detachment lever 853 is provided in the opposite side from the seal member 845 side of the partition wall 858. The attachment and detachment lever 853 extends in a leaving direction from the partition wall 858 to the outside of the recessed part 847 and in the positive Z-axis direction. The engaging pawls 851 are provided in the attachment and detachment lever 853. As shown in FIG. 37, by engaging the engaging pawls 849 to the engaged part 861 of the cartridge 20F and engaging the engaging pawls 851 to the engaged part 863 of the cartridge 20F, the cap 841 is installed in the cartridge 20F.

Figure 39:
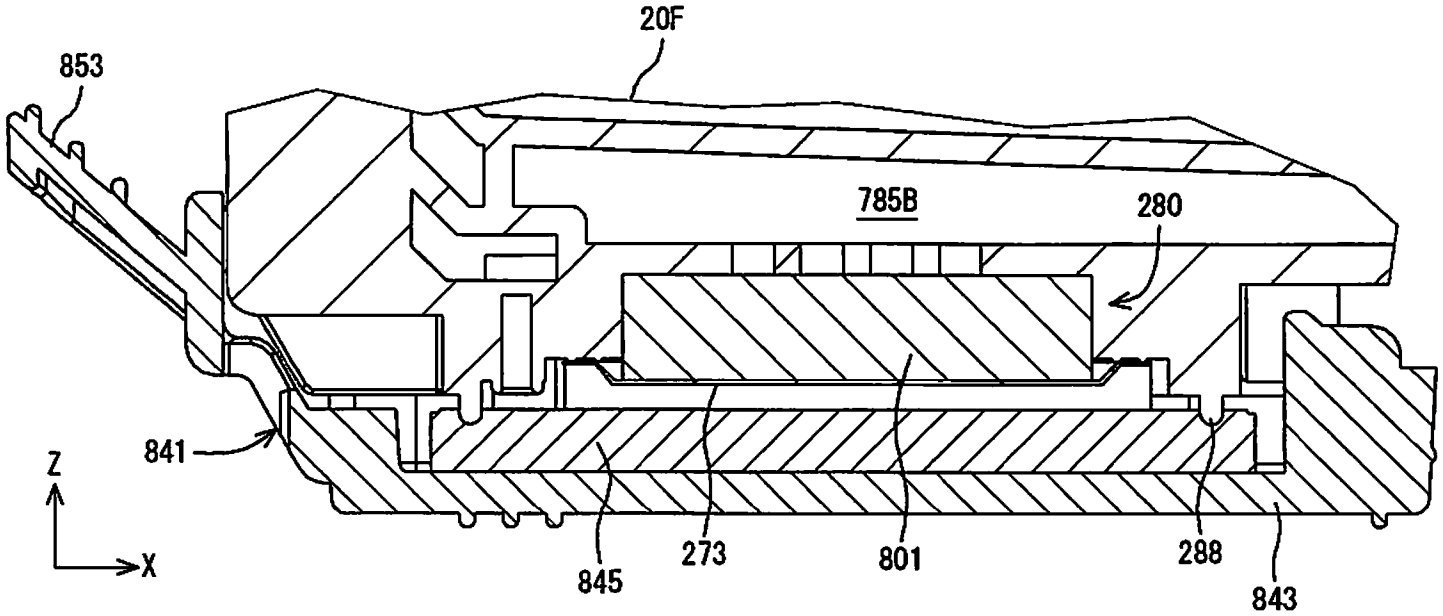
FIG. 39 is a partial cross-sectional view when the cap is mounted to the cartridge according to the thirteenth embodiment.

In a state in which the cap 841 is installed in the cartridge 20F, as shown in FIG. 39, the liquid supply part 280 is covered from the outside by the cover 843 of the cap 841. In a state that the cap 841 is installed in the cartridge 20F, by turning the attachment and detachment lever 853 to the opposite side (−Z-axis direction) from the cartridge 20F side, the engaging pawls 851 can be released from the engaged part 863. With this, the cap 841 can be removed from the cartridge 20F. In a state in which the cap 841 is mounted on the cartridge 20F, the seal member 845 faces to the liquid supply part 280. The seal member 845 is made of a material having elasticity such as, for example, rubber, elastomer, etc. In a state in which the seal member 845 is pressed to the container-side-cylindrical-body 288, the liquid supply part 280 is sealed by the seal member 845. In a state in which the liquid supply part 280 is sealed by the seal member 845, a part where the container-side-cylindrical-body 288 of the seal member 845 contacts is recessed. Therefore, in the state in which the liquid supply part 280 is sealed by the seal member 845, the airtightness of the liquid supply part 280 is enhanced. The space surrounded by the container-side-cylindrical-body 288 and the seal member 845 is called as a seal chamber 865.

In the cartridge 20F, as described above, the coil spring 782 (FIG. 27A) biases the pressure receiving plate 783 in a direction in which the volume of the first liquid storage part 785A expands. Therefore, the pressure inside the liquid storage part 785 keeps lower than the pressure (atmospheric pressure) of the outside of the cartridge 20F. That is, when the atmospheric pressure is defined as a reference, the pressure in the liquid storage part 785 is kept in a negative pressure. With this, the pressure inside the second liquid storage part 785B shown in FIG. 39 and the region surrounded by the container-side-filter 273 and the recessed part 270 is kept in a negative pressure condition.

On the other hand, the pressure in the seal chamber 864 is higher than the pressure in the second liquid storage part 785B and it is the same as the approximate atmospheric pressure. Hereinafter, the space surrounded by the container-side-filter 273 and the recessed part 270 is called as a liquid supply chamber 870. In the cartridge 20F, the seal chamber 865 and the liquid supply chamber 870 are partitioned by the container-side-filter 273. In the present embodiment, as a material of the container-side-filter 273, a material having meniscus pressure greater than the difference between the pressure in the seal chamber 865 and the pressure in the liquid supply chamber 870 is employed. In a case in which PS represents the difference between the pressure in the seal chamber 865 and the pressure in the liquid supply chamber 870, and PBf represents the meniscus pressure of the container-side-filter 273, it is defined as the relationship of the following formula (8). With this, the leakage of the ink from the liquid supply chamber 870 to the seal chamber 865 side can be suppressed.

$$PBf > PS \tag{8}$$

In a condition in which the pressure in the liquid supply chamber 870 is lower than the pressure in the case 22 and the pressure (atmospheric pressure) of the outside, it is not limited to the condition in the thirteenth embodiment, but also the same condition in each of the sixth embodiment to the twelfth embodiment. In these cases, the pressure difference PS is defined as the difference between the pressure of the outside (rather than the case 22) and the pressure in the liquid supply chamber 870. The relationship of the above formula (8) is also applied to each of the sixth embodiment to the twelfth embodiment.

By the way, in the configuration in which two spaces having different pressures are divided by a sheet-shaped part, a phenomenon transmitting the air through the sheet-shaped part in molecular level in a direction from the space having a high pressure to the space having a low pressure may occur. In the case that the space having a low pressure is filled by the liquid, the air transmitting through the sheet-shaped part in the molecular level is collected in the liquid, and it becomes the air bubble. This phenomenon is called as bubble growth.

In the cartridge 20F, when the pressure difference PS is greater than the meniscus pressure PBm of the flow channel formation member 801, the bubble growth sometimes occurs. When the pressure difference PS is greater than the meniscus pressure PBm of the flow channel formation member 801, the molecular of air transmitted through the filter container side 273 is collected in the flow channel formation member 801, and the air bubble becomes a size to be stored in the hole of the flow channel formation member 801. When the molecular of air is further collected in the flow channel formation member 801, and when the air bubble stored in the hole of the flow channel formation member 801 is grown larger which exceeds the size of the hole, the air bubble is continuously grown while breaking the meniscus of the liquid adjacent to the air bubble.

Therefore, when the pressure difference PS is greater than the meniscus pressure PBm, the bubble growth easily occur in the flow channel formation member 801. Contrarily, when the pressure difference PS is smaller than the meniscus pressure PBm, the bubble growth is easily suppressed in the flow channel formation member 801. This is because when the pressure difference PS is smaller than the meniscus pressure PBm, the breakage of the meniscus in the flow channel formation member 801 is easily suppressed, so that the growth of the air bubble is easily prevented. Therefore, in the present embodiment, as a material of the flow channel formation member 801, a material having the meniscus pressure PBm greater than the pressure difference PS is employed. This is shown as the relationship of the following formula (9). With this, the flowing of the air bubble into the liquid supply chamber 870 from the seal chamber 865 side can be suppressed.

$$PBm > PS \tag{9}$$

Further, in the present embodiment, the relationship of the following formula (10) has the meniscus pressure PBf of the container-side-filter 273 and the meniscus pressure PBm of the flow channel formation member 801. The meniscus pressure PBf of the container-side-filter 273 is greater than the meniscus pressure PBm of the flow channel formation member 801, so that the pressure loss in the case of the ink supply to the print head 540 can be reduced. When the relationship between the meniscus pressure PBf of the container-side-filter 273 and the meniscus pressure PBm of the flow channel formation member 801 is organized, the relationship of the following formula (11) is shown.

$$PBr>PBm \quad (10)$$

$$PBf>PBm>PS \quad (11)$$

The relationships of the aforementioned formula (10) and the formula (11) are applied to each of the sixth embodiment to the twelfth embodiment. Further, from the viewpoint of reducing the pressure loss, in the cartridge 20J of the tenth embodiment, the meniscus pressure PBm2 of the second foam 837 is preferably lower than the meniscus pressure PBm and higher than the pressure difference PS as shown in the following formula (12). Further, from the viewpoint of reducing the pressure loss, in the configuration in which the flow channel formation member 801 is separated into the first part 801A and the second part 801B, the relationship shown in the following formula (13) is preferable. In the formula (13), PBmA represents the meniscus pressure of the first part 801A, and PBmB represents the meniscus pressure of the second part 801B. This indicates that in the configuration in which the ink is guided from the liquid supply part 280 via the plurality of porous members, the meniscus pressure of the plurality of porous members is preferably lowered in a direction from the liquid supply part 280 side to the upstream side of the ink flow.

$$PBf>PBm>PBm2>PS \quad (12)$$

$$PBf>PBmA>PBmB>PBm2>PS \quad (13)$$

N. Fourteenth Embodiment

A cartridge 20N according to the fourteenth embodiment has the same structure as the cartridge 20F according to the sixth embodiment except the density of the flow channel formation member 801 is different depending on a part of the flow channel formation member 801. Therefore, hereinafter, for the same structure as the sixth embodiment, the same symbols as the sixth embodiment are allotted and the detailed descriptions are omitted.

Figure 40:
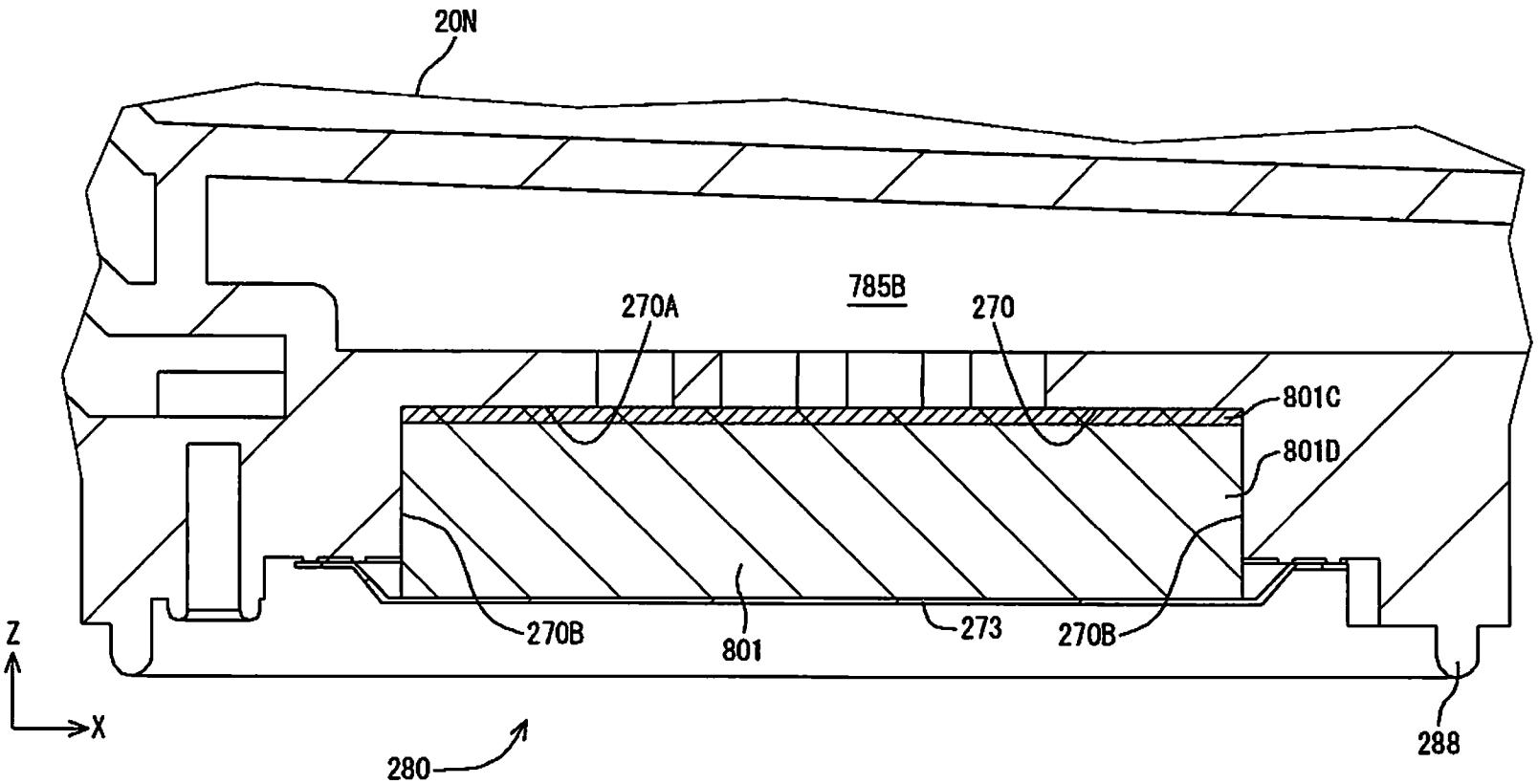
FIG. 40 is an explanatory diagram showing a configuration of a cartridge according to the fourteenth embodiment.

In the cartridge 20P, as shown in FIG. 40, the flow channel formation member 801 may be divided into the third part 801C and the fourth part 801D. The third part 801C is the part along the upper surface 270A of the recessed part 270 in the flow channel formation member 801 and it is the part facing to the upper surface 270A. The fourth part 801D is the part in the side of the container-side-filter 273, rather than the third part 801C, in the flow channel formation member 801. The upper surface 270A is the surface facing to the container-side-filter 273 within the recessed part 270.

In the cartridge 20N, the ink may be existed in a gap between the fourth part 801D and the container-side-filter 273. The bubble growth may occur in the ink existed in the gap between the fourth part 801D and the container-side-filter 273. However, in the cartridge 20N, the density of the third part 801C is higher than the density of the fourth part 801D. With this, the airtightness of the third part 801C is enhanced than the airtightness of the fourth part 801D. Therefore, even when the air bubble generated in the gap between the fourth part 801D and the container-side-filter 273 is flowed into the inside of the flow channel formation member 801, the growth of the air bubble, which is flowed into the inside of the flow channel formation member 801, in the second liquid storage part 785B can be suppressed. That is, the flow of the air bubble, which is flowed into the inside of the flow channel formation member 801, into the inside of the second liquid storage part 785B is prevented by the airtightness of the third part 801C. As a result, in the fourteenth embodiment, it is hard to further stop the ink supply to the print head 540 (the ink supply to the print head 540 is easily maintained). In the fourteenth embodiment, the relationship of the aforementioned formula (11) is also applied.

Example N1

As a method for making the density of the third part 801C higher than the density of the fourth part 801D, for example, the method in which the flow channel formation member 801 is fitted into the recessed part 270 in a compressed state may be employed. That is, this method is the method for pressing the flow channel formation member 801 into the recessed part 270. Hereinafter, the example in which the flow channel formation member 801 is fitted into the recessed part 270 in a compressed state is referred to as Example N1. According to Example N1, the flow channel formation member 801 can be compressed by the upper surface 270A and the container-side-filter 273, and the density of the third part 801C can be enhanced. Therefore, the density of the third part 801C can be made higher than the density of the fourth part 801D.

Example N2

As a method for making the density of the third part 801C higher than the density of the fourth part 801D, for example, the method for providing the flow channel formation member 801 made of materials having different densities in the third part and the fourth part may be employed. This method is the method for providing the flow channel formation member 801 by two different materials which have different densities. Hereinafter, the example in which the flow channel formation member 801 is provided by the materials having different densities from each other is referred to as Example N2. In Example N2, the fourth part 801D is made of the material having low density, and the third part 801C is made of the material having high density. According to Example N2, the density of the third part 801C can be made higher than the density of the fourth part 801D. In Example N2, any of the method in which the third part 801C and the fourth part 801D are formed in separate bodies to each other and the method in which the third part 801C and the fourth part 801D are integrally formed may be employed.

P. Fifteenth Embodiment

A cartridge 20P according to the fifteenth embodiment has the same structure as the cartridge 20F according to the sixth embodiment except the densities of the flow channel formation member 801 are different depending on a part of the flow channel formation member 801. Therefore, hereinafter, for the same structure as the sixth embodiment, the same symbols as the sixth embodiment are allotted, and the detailed descriptions are omitted.

Figure 41:
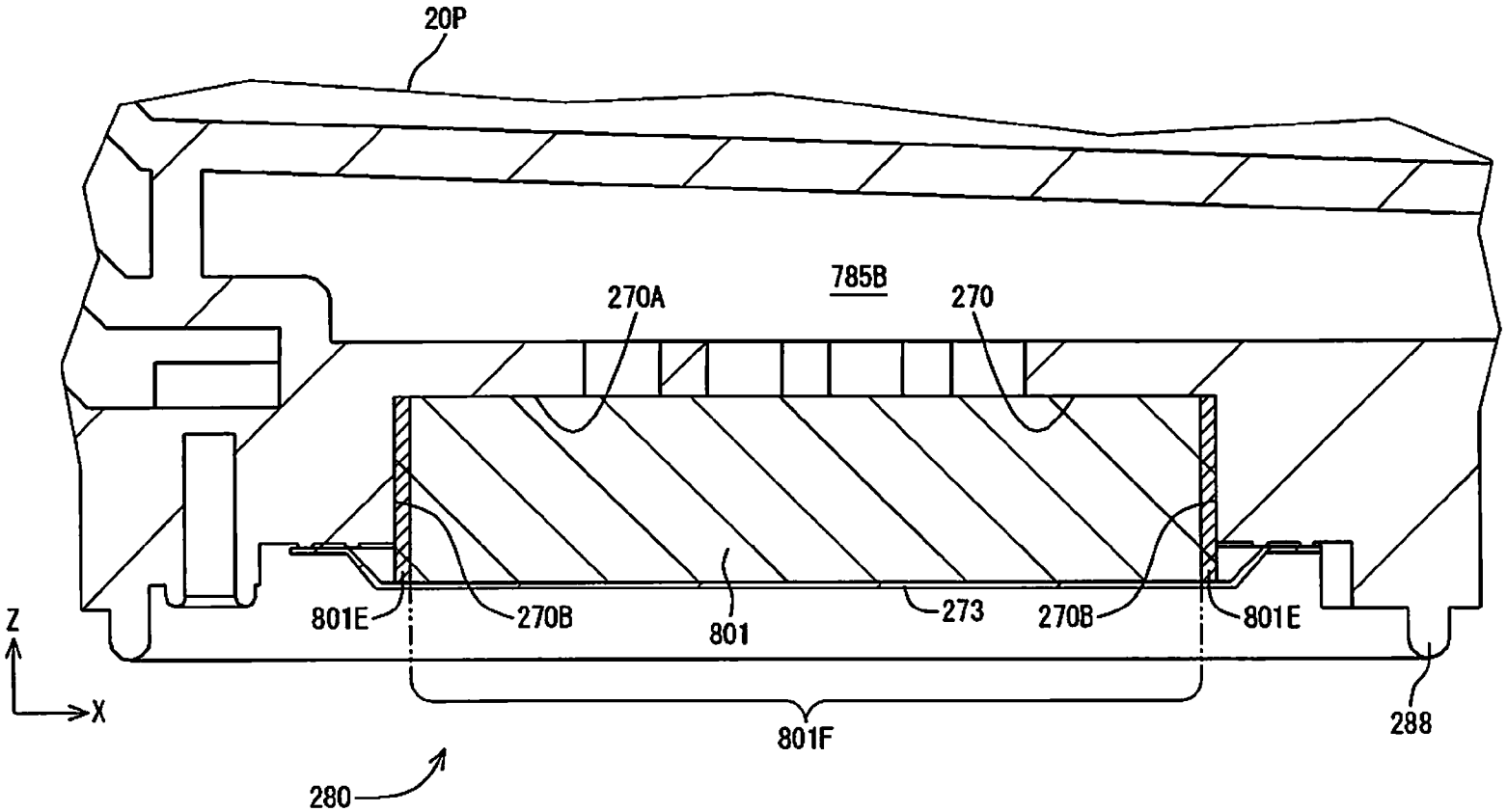
FIG. 41 is an explanatory diagram showing a configuration of a cartridge according to the fifteenth embodiment.

In the cartridge 20P, as shown in FIG. 41, the flow channel formation member 801 may be divided into the fifth part 801E and the sixth part 801F. The fifth part 801E is the part along the side surface 270B of the recessed part 270 in the flow channel formation member 801, and when the flow channel formation member 801 is planarly viewed in the XY plane surface, the fifth part 801E is the part configuring the outer periphery of the flow channel formation member 801. The sixth part 801F is the part in the region surrounded by the fifth part 801E in the flow channel formation member 801. The side surface 270B is the side surface inside the recessed part 270. The side surface 270B is the surface intersecting the upper surface 270A.

In the cartridge 20P, the density of the fifth part 801E is higher than the density of the sixth part 801F. The airtightness of the fifth part 801E is higher than the airtightness of the sixth part 801F. Therefore, the bubble growth can be suppressed in the gap between the fifth part 801E and the container-side-filter 273. The ink may be existed in the gap between the fifth part 801E and the container-side-filter 273. The bubble growth may occur in the ink existed in the gap between the fifth part 801E and the container-side-filter 273.

However, the airtightness of the fifth embodiment 801E is enhanced in the cartridge 20P, so that the growth of the air bubble generated in the gap between the fifth part 801E and the container-side-filter 273 and exceeding a certain volume can be suppressed. The flow of the air bubble, which is generated in the gap between the fifth part 801E and the container-side-filter 273, into the inside of the flow channel formation member 801 is blocked by the airtightness of the fifth part 801E. As a result, in the fifteenth embodiment, it is hard to stop the ink supply to the print head 540 (the ink supply to the print head 540 is easily maintained). The relationship of the aforementioned formula (11) is also applied to the fifteenth embodiment.

Example P1

As a method for making the density of the fifth part 801E higher than the density of the sixth part 801F, for example, a method for fitting the flow channel formation member 801 into the recessed part 270 in a compressed state may be employed. That is, this method is the method to press the flow channel formation member 801 into the recessed part 270. Hereinafter, an example in which the flow channel formation member 801 is fitted into the recessed part 270 in a compressed state is referred to as Example P1. According to Example P1, the density of the peripheral side of the flow channel formation member 801 can be enhanced when the flow channel formation member 801 is planarly viewed in the XY plane surface. With this, the density of the fifth part 801E can be made higher than the density of the sixth part 801F.

Example P2

As a method for making the density of the fifth part 801E higher than the density of the sixth part 801F, for example, a method for providing the flow channel formation member 801 with materials having different densities to each other may be employed. This method is the method for providing the flow channel formation member 801 with two types of materials having different densities. Hereinafter, an example in which the flow channel formation member 801 is provided in the materials having different densities to each other is referred to as Example P2. In Example P2, the sixth part 801F is configured by the material having low density, and the fifth part 801E is configured by the material having high density. According to Example P2, the density of the peripheral side of the flow channel formation member 801 can be enhanced when the flow channel formation member 801 is planarly viewed in the XY plane surface. With this, the density of the fifth part 801E can be higher than the density of the sixth part 801F. In Example P2, any of the method in which the fifth part 801E and the sixth part 801F are formed in separate bodies to each other and the method in which the fifth part 801E and the sixth part 801F are integrally formed may be employed.

For the fourteenth embodiment and the fifteenth embodiment, the fourteenth embodiment and the fifteenth embodiment can be individually employed or the fourteenth embodiment and the fifteenth embodiment can be employed in combination.

Q. Modified Example

As described above, some embodiments of the present invention were described, but it is not limited to these embodiments, and various structures can be adopted unless it deviates from the spirits of the invention. For example, the following modifications can be made.

Modified Example 1

The support member 275 and the foam 272 according to the aforementioned $1^{st}$ to $4^{th}$ embodiments may be integrally formed by using, for example, a hard porous member. Further, the container-side-filter 273 and the foam 272 may be integrally formed.

Modified Example 2

The porous structure may not be provided in the container-side-filter 273 and the inclined part 273*c* according to the $1^{st}$ to $15^{th}$ embodiments. That is, the porous structure may be provided in only the part contacting the device-side-filter 642, and the porous structure may not be provided in other parts.

Modified Example 3

In the first embodiment to the fifteenth embodiment, the container-side-filter 273 has a structure projecting in a direction of the device-side-filter 642. On the other hand, for example, the container-side-filter 273 may be a structure recessed to the inside. That is, the container-side-filter 273 may be projected toward the opposite side of the device-side-filter 642. However, in this case, the generation of the air bubble is suppressed at the time of the attachment and detachment of the cartridges 20, so that the device-side-filter 642 is preferably projected in a direction of the container-side-filter 273. Further, in the structure in which the container-side-filter 273 is projected in a direction of the device-side-filter 642, the device-side-filter 642 may be projected in a direction of the container-side-filter 273 or may be projected in a direction of the opposite side of the container-side-filter 273.

Modified Example 4

Modified Example 4 shows that the meniscus pressure of the container-side-filter 273 and the meniscus pressure of the nozzles 541 are equal, or the meniscus pressure of the nozzles 541 is smaller than the meniscus pressure of the container-side-filter 273. The $2^{nd}$ to $15^{th}$ embodiments show the container-side-filter 273 having a condition in which the meniscus pressure of the nozzles 541 is greater than the meniscus pressure of the container-side-filter 273, but it is not limited to this. It may be substituted to Modified Example 4. With the substitution of the aforementioned $2^{nd}$ to $15^{th}$ embodiments, the filter satisfying the conditions described blow may be employed as the container-side-filter 273.

In Modified Example 4, the state in which the cartridges 20 are mounted on the holder 60 is defined as "at the time of mounted state". Further, a border between the container-side-filter 273 and the device-side-filter 642 is existed in the middle of the ink flow channel from the cartridges 20 to the print head 540. In this border, a contacting part where the container-side-filter 273 and the device-side-filter 642 are physically contacted and an ink layer surrounding the peripheral of the contacting part are existed. The contacting part and the ink layer are defined as "contact region". Further, a case in which the ink amount per unit time suctioned from the cartridge 20 to the print head 540 is the maximum is defined as "at the time of maximum flow rate".

In Modified Example 4, the following symbols are defined.

PBf(4): Meniscus pressure of the container-side-filter 273.

PBn(4): Meniscus pressure of the nozzle 541.

Ps(4): Meniscus pressure of the meniscus formed on the interfacial surface between the ink and the atmosphere when the ink is existed in the contact region at the time of mounted state.

P1(4): Absolute value of the maximum pressure generated in a direction from the device-side-filter 642 to the nozzles 541 in the contact region at the time of maximum flow rate.

P2(4): Absolute value of the maximum pressure (value subtracting the absolute value of the pressure loss of the cartridges 20 at the time of maximum flow rate from the absolute value of the maximum negative pressure in the liquid storage part 200) generated from the container-side-filter 273 to the liquid storage part 200, and generated in the contact region at the time of maximum flow rate.

P3(4): Negative pressure generated in the contact region at the time of maximum flow rate.

The meniscus pressure PBf of the container-side-filter 273 can be shown as the following formulas (13) to (16).

$$P3(4)=P1(4)+P2(4) \quad (13)$$

$$Ps(4)>P3(4) \quad (14)$$

In a case in which the formulas (13) and (14) are satisfied, when the ink is supplied from the cartridges 20 to the print head 540, the meniscus pressure Ps(4) generated on the interfacial surface between the ink and the atomosphere in the contact region becomes more than the negative pressure P3(4) generated between the container-side-filter 273 and the device-side-filter 642. With this, at the time of maximum flow rate, the meniscus generated in the interfacial surface between the ink and the atomosphere in the contact region is not broken. That is, the air is not entered to the contact region. As a result, the mixture of the air into the ink flow channel in a direction from the cartridges 20 to the print head 540 can be suppressed.

$$PBf(4)>P2(4)>P1(4) \quad (15)$$

In a case in which the formula (15) is satisfied, at the time of maximum flow rate, the meniscus of the container-side-filter 273 is not broken. Therefore, at the time of maximum flow rate, the entering of the air into the inside of the liquid supply part 280 from the outside of the cartridges 20 via the container-side-filter 273 can be prevented. As a result, the mixture of the air into the ink flow channel in a direction from the cartridges 20 to the print head 540 can be suppressed.

$$Ps(4)>PBf(4) \quad (16)$$

In a case in which the formula (16) is satisfied, at the time of mounted state, the ink inside the liquid storage part 200 passes through the container-side-filter 273 and the ink can be transferred to the contact region by contacting the container-side-filter 273 with the device-side-filter 642. By trasferring the ink to the contact region, the meniscus is formed on the interfacial surface between the ink and the atomosphere in the contact region. Therefore, the mixture of the air into the ink flow channel in a direction from the cartridges 20 to the print head 540 can be suppressed.

The invention claimed is:

1. A liquid storage container configured and arranged to be mounted to a liquid consumption device having a liquid introduction part including a device-side filter, the liquid storage container comprising:

a liquid storage part configured and arranged to store liquid; and a liquid supply part configured and arranged to be attached to the liquid introduction part to supply the liquid to the liquid consumption device via the device-side filter, the liquid supply part including a foam configured and arranged to allow the liquid to pass therethrough, a container-side filter contacting the foam and configured and arranged to allow the liquid, which has passed through the foam, to pass therethrough, the container-side filter being further configured and arranged to contact the device-side filter when the liquid storage container is mounted to the liquid consumption device, and a biasing member biasing the foam toward the container-side filter from a side of the liquid storage part so that the foam contacts the container-side filter.

2. The liquid storage container according to claim 1, wherein the foam is made of porous material, and the container-side filter is made of porous material.

3. The liquid storage container according to claim 1, wherein the foam is made of porous material, and the container-side filter is made of fabric material.

4. The liquid storage container according to claim 1, wherein the biasing member includes a support member supporting the foam, and the support member includes a plurality of flow holes configured and arranged to flow the liquid from the liquid storage part.

5. The liquid storage container according to claim 1, wherein the foam has a first capillary force, and the container-side filter has a second capillary force greater than the first capillary force.

6. The liquid storage container according to claim 1, wherein the biasing member is comprised of a spring.

7. The liquid storage container according to claim 1, wherein the biasing member is comprised of a plate spring, and the plate spring includes a support member supporting the first member.

8. The liquid storage container according to claim 1, wherein the container-side filter includes a peripheral edge part, a central part and an inclined part disposed between the peripheral edge part and the central part, and the central part is disposed further away from the liquid storage part than the peripheral edge part.

* * * * *